US012258170B2

(12) United States Patent
Clark

(10) Patent No.: US 12,258,170 B2
(45) Date of Patent: Mar. 25, 2025

(54) LOW DEPTH DAIRY CRATE

(71) Applicant: Rehrig Pacific Company, Los Angeles, CA (US)

(72) Inventor: Suzanne Whitfield Clark, Santa Monica, CA (US)

(73) Assignee: Rehrig Pacific Company, Monterey Park, CA (US)

( * ) Notice: Subject to any disclaimer, the term of this patent is extended or adjusted under 35 U.S.C. 154(b) by 1063 days.

(21) Appl. No.: 16/442,377

(22) Filed: Jun. 14, 2019

(65) Prior Publication Data

US 2020/0156817 A1 May 21, 2020

Related U.S. Application Data

(63) Continuation of application No. 14/723,946, filed on May 28, 2015, now Pat. No. 10,322,838.

(60) Provisional application No. 62/072,779, filed on Oct. 30, 2014, provisional application No. 62/004,854, filed on May 29, 2014.

(51) Int. Cl.

| | |
|---|---|
| ***B65D 71/70*** | (2006.01) |
| ***B65D 1/22*** | (2006.01) |
| ***B65D 1/24*** | (2006.01) |
| ***B65D 21/02*** | (2006.01) |
| ***B65D 21/04*** | (2006.01) |

(52) U.S. Cl.

CPC ..... *B65D 1/243* (2013.01); *B65D 21/04* (2013.01); *B65D 21/0209* (2013.01); *B65D 21/0212* (2013.01); *B65D 21/0231* (2013.01); *B65D 2501/24006* (2013.01); *B65D 2501/24019* (2013.01); *B65D 2501/24127* (2013.01); *B65D 2501/24343* (2013.01); *B65D 2501/24515* (2013.01); *B65D 2501/24694* (2013.01)

(58) Field of Classification Search

CPC .. B65D 21/0233; B65D 21/048; B65D 21/04; B65D 21/0209; B65D 21/0212; B65D 21/0231; B65D 1/34; B65D 1/243; B65D 85/80; B65D 2501/24006; B65D 2501/24019; B65D 2501/24127; B65D 2501/24343; B65D 2501/24515; B65D 2501/24694; B65D 2501/24267; B65D 71/70; B65D 1/36; B65D 21/0224

USPC ..... 206/427, 203, 509, 503, 821, 518, 515; 220/519, 509, 514, 516, 676; 53/473

See application file for complete search history.

(56) References Cited

U.S. PATENT DOCUMENTS 2,813,656 A * 11/1957 Anderson ..... B65D 21/046 206/507
3,349,943 A * 10/1967 Box ..... B65D 1/243 220/519
3,409,169 A * 11/1968 Levenhagen ..... B65D 21/045 206/507
3,420,402 A * 1/1969 Frater ..... B65D 21/045 206/507
3,430,806 A * 3/1969 Munk ..... B65D 21/045 206/511
3,547,309 A * 12/1970 Pusey ..... B65D 21/0235 220/23.6

(Continued)

*Primary Examiner* — Gideon R Weinerth

(74) *Attorney, Agent, or Firm* — Carlson, Gaskey & Olds, P.C.

(57) ABSTRACT

A crate for storing containers includes a plurality of walls and a base connected to the plurality of walls. The base includes a plurality of recessed areas each having a first container contact surface spaced from a second container contact surface.

27 Claims, 52 Drawing Sheets

(56) References Cited

U.S. PATENT DOCUMENTS 3,734,341 A * 5/1973 Levenhagen ..... B65D 21/045 211/126.7
3,791,552 A * 2/1974 Hayes ..... B65D 21/0224 206/502
3,825,114 A * 7/1974 Johnson ..... B65D 21/045 206/507
3,934,724 A * 1/1976 Johnson ..... B65D 21/045 206/507
3,937,327 A * 2/1976 Carroll ..... B65D 21/041 206/507
4,079,077 A * 3/1978 David ..... B65D 1/38 206/504
4,189,052 A * 2/1980 Carroll ..... B65D 21/041 206/507
4,320,837 A * 3/1982 Carroll ..... B65D 21/041 206/505
4,932,532 A * 6/1990 Apps ..... B65D 71/70 206/503
5,035,326 A * 7/1991 Stahl ..... B65D 21/041 206/507
5,038,961 A * 8/1991 Watanabe ..... B65D 71/70 220/519
5,060,819 A * 10/1991 Apps ..... B65D 1/243 220/519
5,263,605 A * 11/1993 Caton ..... B65D 71/70 206/203
5,305,884 A * 4/1994 Apps ..... B65D 1/243 206/505
5,377,862 A * 1/1995 Oakes ..... B65D 71/70 206/433
5,421,477 A * 6/1995 Hammett ..... B65D 1/243 206/203
5,673,792 A * 10/1997 Aikio ..... B65D 71/70 206/509
5,823,376 A * 10/1998 McGrath ..... B65D 1/243 220/516
5,826,712 A * 10/1998 Aikio ..... B65D 71/70 206/203
5,913,424 A * 6/1999 Kelly ..... B65D 21/0209 206/509
6,394,274 B1 * 5/2002 Cheeseman ..... B65D 21/045 206/503
7,699,172 B2 * 4/2010 McTavish ..... B65D 21/0213 206/511
7,837,037 B2 * 11/2010 McTavish ..... B65D 1/22 206/509
8,833,594 B2 * 9/2014 Stahl ..... A47F 3/14 220/571
10,836,534 B2 * 11/2020 Guerry ..... B65D 71/70
D925,913 S * 7/2021 Pereira Ruiz ..... B65D 21/045 D3/314
11,111,064 B2 * 9/2021 Clark ..... B65D 21/0224
11,352,181 B2 * 6/2022 Apps ..... B65D 1/22
2005/0279651 A1 * 12/2005 Perret ..... B65D 71/70 206/203
2006/0260971 A1 * 11/2006 Rivera ..... B65D 21/0231 206/509
2006/0283755 A1 * 12/2006 Slat ..... B65D 21/0231 206/509
2007/0144931 A1 * 6/2007 McTavish ..... B65D 21/046 206/503
2009/0108002 A1 * 4/2009 Delbrouck ..... B65D 19/42 220/519
2010/0213095 A1 * 8/2010 Eiten ..... B65D 71/0096 206/499
2012/0317929 A1 * 12/2012 Ramberg ..... B65D 71/70 53/473
2013/0199953 A1 * 8/2013 Lindstrom ..... B65D 85/00 206/427
2014/0174976 A1 * 6/2014 Ramberg ..... B65D 71/70 206/511
2014/0291196 A1 * 10/2014 Lindstrom ..... B65D 1/34 206/557
2014/0367297 A1 * 12/2014 Kelly ..... B65D 71/0096 206/509
2015/0183552 A1 * 7/2015 Kelly ..... B65D 71/70 206/433
2015/0344167 A1 * 12/2015 Clark ..... B65D 1/243 206/427
2016/0130057 A1 * 5/2016 Stahl ..... B65D 1/243 206/427
2016/0185486 A1 * 6/2016 Baltz ..... A47F 3/14 206/600
2016/0200480 A1 * 7/2016 Clark ..... B65D 21/0233 206/427
2017/0341811 A1 * 11/2017 Guerry ..... B65D 85/80
2018/0244422 A1 * 8/2018 Clark ..... B65D 1/243
2022/0355966 A1 * 11/2022 Kastelic ..... B65D 1/243

* cited by examiner

FIG. 4
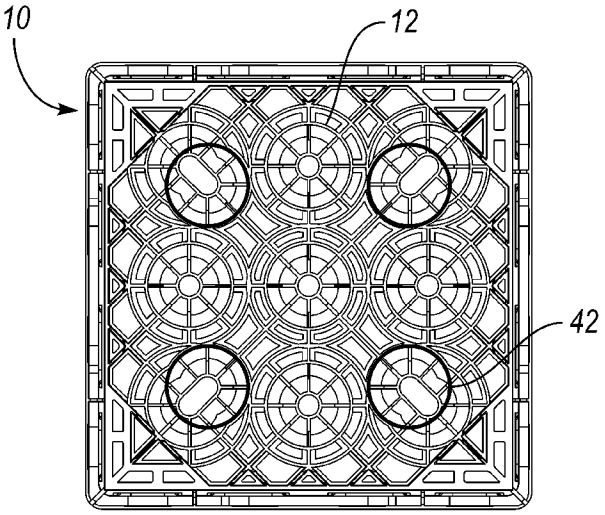
FIG. 5
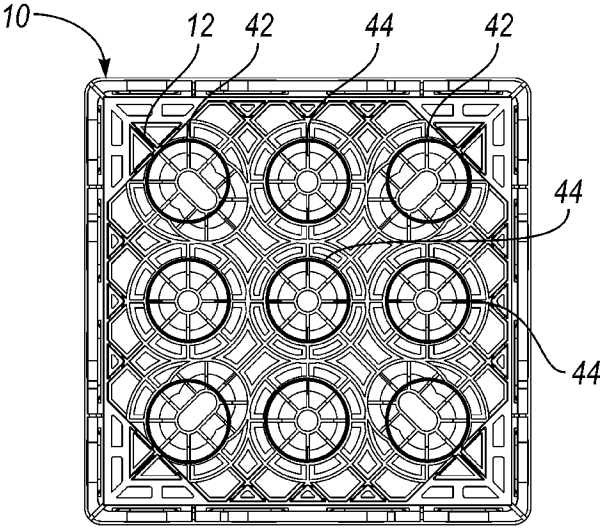
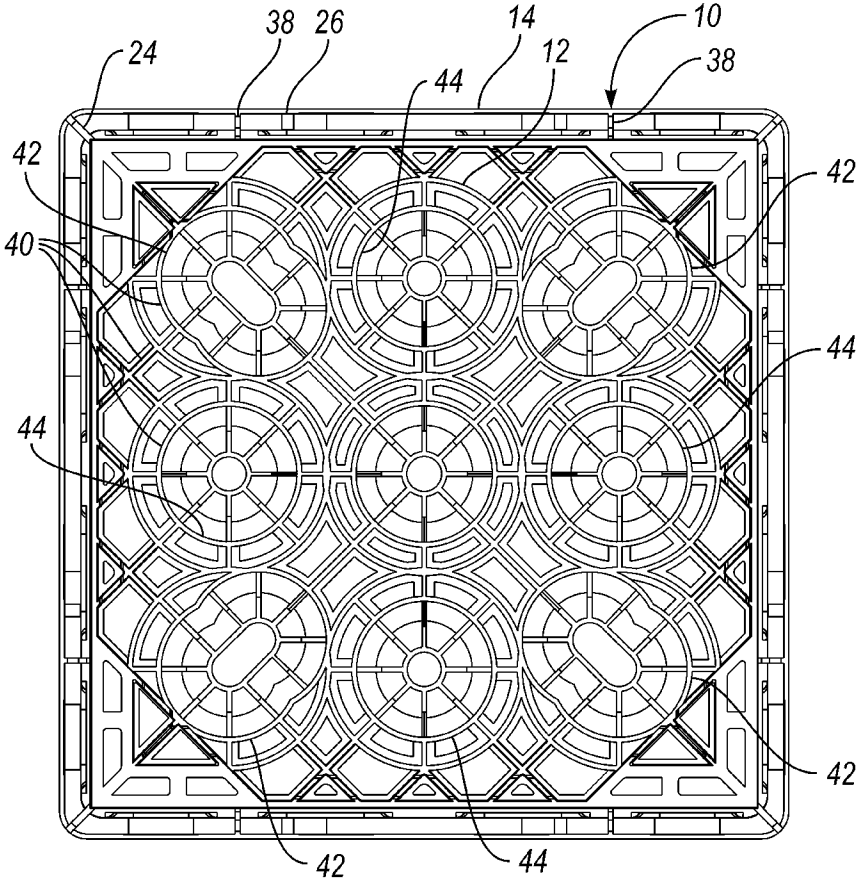
FIG. 3

LOW DEPTH DAIRY CRATE

CROSS-REFERENCE TO RELATED APPLICATIONS

The application is a continuation of U.S. application Ser. No. 14/723,946, which was filed on May 28, 2015, which claims priority to U.S. Provisional Application No. 62/004,854 which was filed on May 29, 2014 and U.S. Provisional Application No. 62/072,779 which was filed on Oct. 30, 2014.

BACKGROUND

Transporting beverage container, such as milk cartons, requires that the container be protected during transportation in a specialized crate, such as a milk crate. The crates generally include a central opening for accepting the beverage container and may include multiple handles to aid in grasping the crate. The specialized crates are helpful because they allow the containers to be protected while maximizing the number of containers stored in the crate.

Once the containers have been delivered, the empty crates are returned to the beverage company to be refilled with containers for the next shipment. However, many crates extend the entire height of the container stored inside. Although full height crates provide a maximum amount of protection, the empty crates require a significant volume when stacked empty. In order to reduce the volume, some crates may be nestable, however, the crates generally only nest a small amount if it all in the case of milk crates. Therefore, there is a need to improve shipment of containers and the crates that store the containers.

SUMMARY

A crate for storing containers includes a plurality of walls and a base connected to the plurality of walls. The base includes a plurality of recessed areas each having a first container contact surface spaced from a second container contact surface.

In another exemplary embodiment, a crate for support containers includes a plurality of walls and a base connected to the plurality of walls. The base includes a plurality of elongated recessed support areas and a plurality of recessed support areas located between adjacent pairs of the plurality of elongated recessed support areas.

In a further exemplary embodiment, a crate for supporting containers includes a base and a plurality of walls. The plurality of walls include an upper portion attached to the base with a lower portion. A rib extends outward from a corner of the lower portion and a slot extends through a corner of the upper portion.

BRIEF DESCRIPTION OF THE DRAWINGS

The drawings can be briefly described as follows:

FIG. 3 is a bottom view of the crate of FIG. 1.

FIG. 4 is a bottom view of the crate of FIG. 1 showing a first number of recesses.

FIG. 5 is a bottom view of the crate of FIG. 1 showing a second number of recesses.

DETAILED DESCRIPTION

Figure 1:
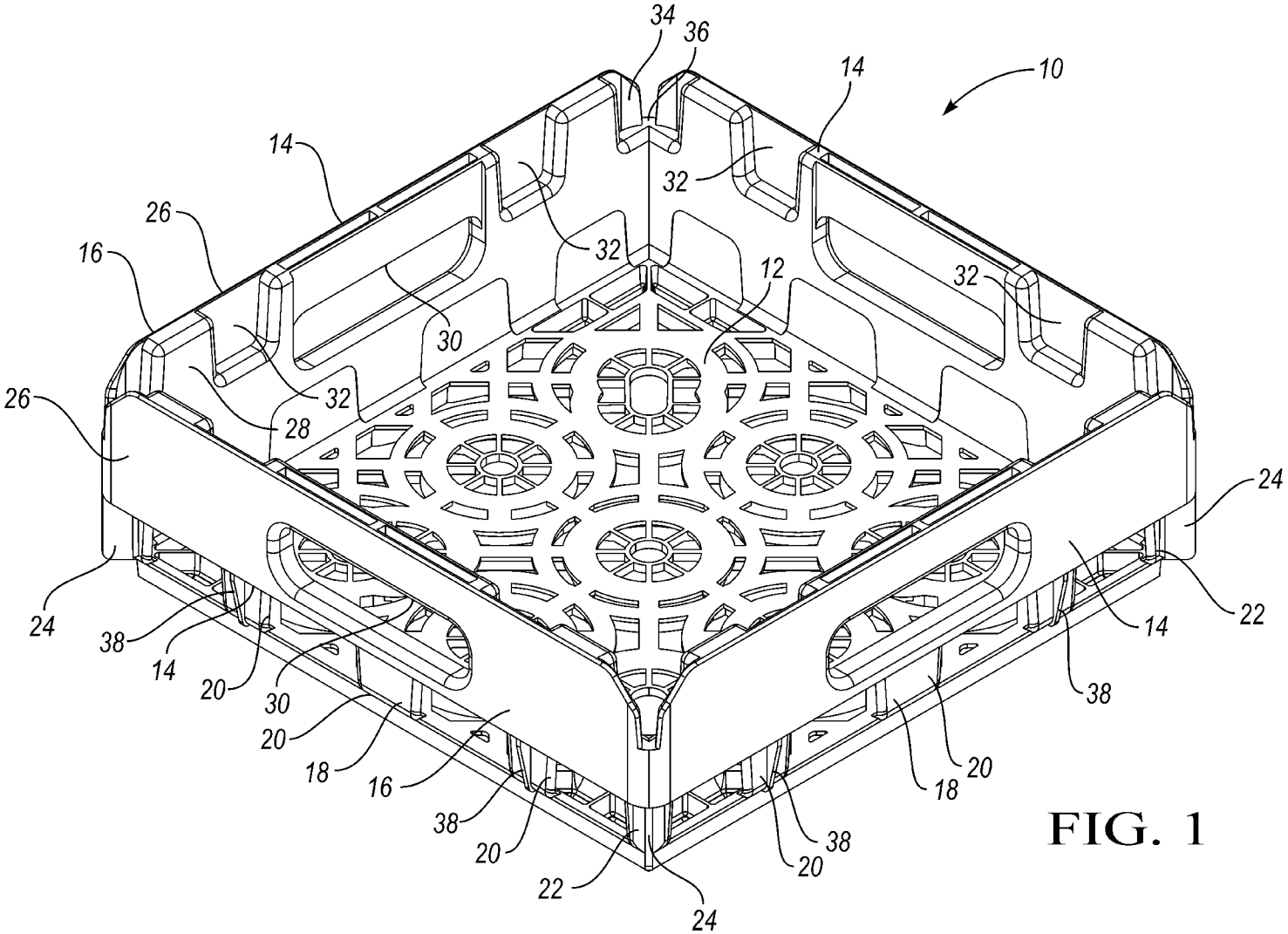
FIG. 1 is a perspective view of an example crate.

A crate 10 according to a first embodiment of the present invention includes a base 12 and side walls 14 extending upward from a periphery of the base 12. Each side wall 14 includes an upper wall portion 16 and a lower wall portion 18. The lower wall portion 18 includes a plurality of single-wall columns 20 and corner columns 22 extending from the base 12 to the upper wall portion 16. Each of the corner columns 22 includes a support rib 24 projecting outward of the crate 10 in a direction generally diagonally relative to the generally rectangular crate 10. In the illustrated example, the crate 10 is square.

The upper wall portion 16 (or upper band) includes an outer wall 26 spaced outward of an inner wall 28. The inner wall 28 is generally continuous with the columns 20 to create a generally flat, continuous inner surface of the crate 10. The outer wall 26 is spaced outward of the lower wall portion 18.

A handle opening 30 is formed through the upper wall portion 16 of each of the side walls 14. Upward opening recesses 32 are formed in the inner wall 28 above each of the columns 20 spaced from the handle openings 30. Further, the inner wall 28 is recessed slightly outward above the center columns 20 at the handles. Corner recesses 34 are formed in the inner walls 28 in each of the corners of the crate 10. A slot 36 extends through the inner wall 28 and the outer wall 26 in each of the corners of the crate 10 above the lower wall portion 18. The non-centered side columns 20 each include a rib 38 projecting outward of the crate 10.

Figure 2:
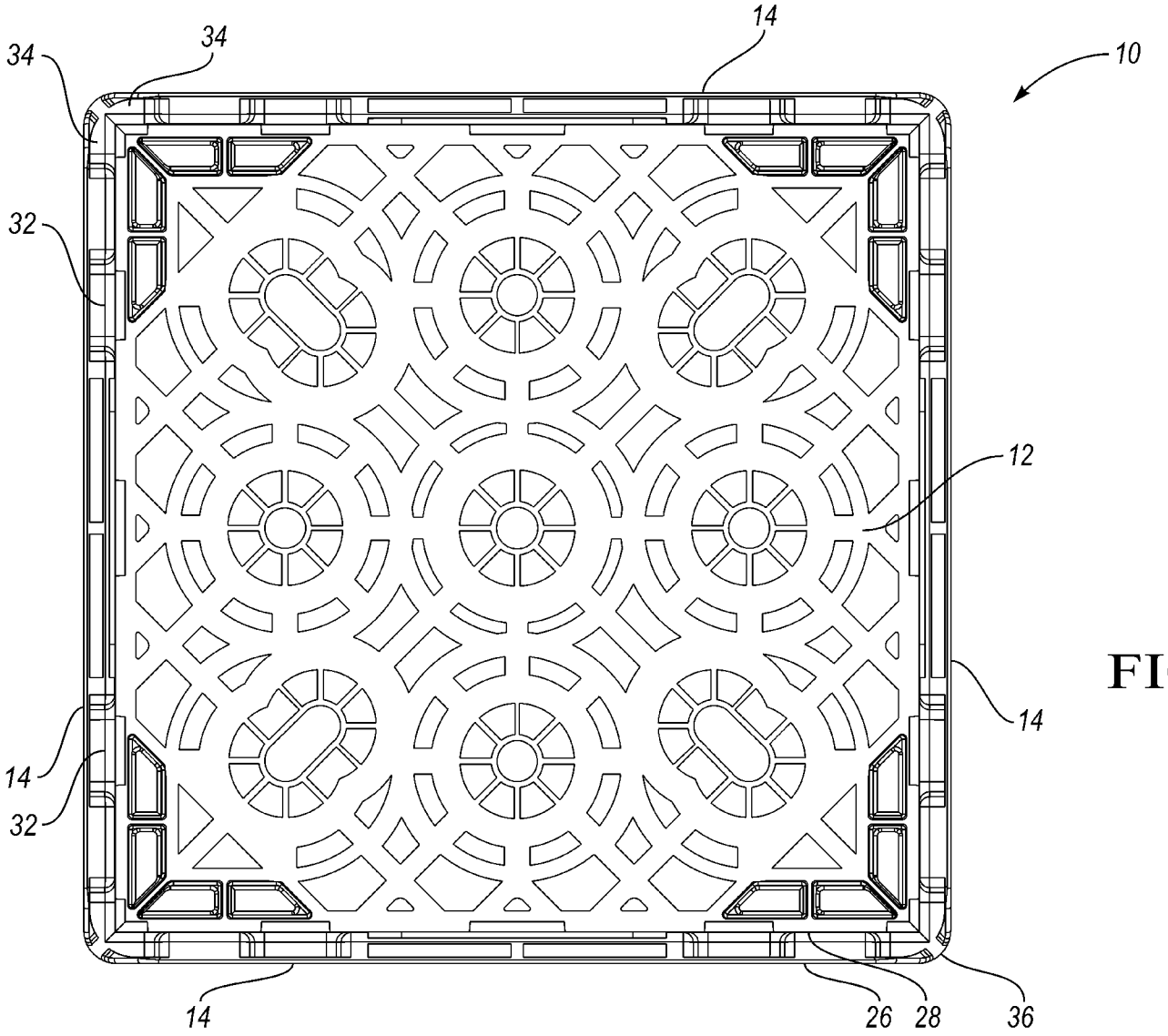
FIG. 2 is a top view of the crate of FIG. 1.

FIG. 2 is a top view of the crate 10.

FIG. 3 is a bottom view of the crate 10. A plurality of vertical ribs 40 form the base 12. A plurality (in this case, nine) of cap alignment recesses 42, 44 are defined by some of the ribs 40 in the base 12. The four corner recesses 42 are generally shaped each as a pair of overlapped circles such that the four corner recesses have an elongated shape. The four corner recesses 42 also extend along a diagonal of the base 12. The five non-corner recesses 44 are generally each shaped as a circle. As shown in FIG. 4, the four corner recesses 42 can capture four equally-spaced bottle caps (not yet illustrated). As shown in FIG. 5, all nine recesses 42, 44 can capture nine equally-spaced bottle caps (again, not yet illustrated).

Figure 6:
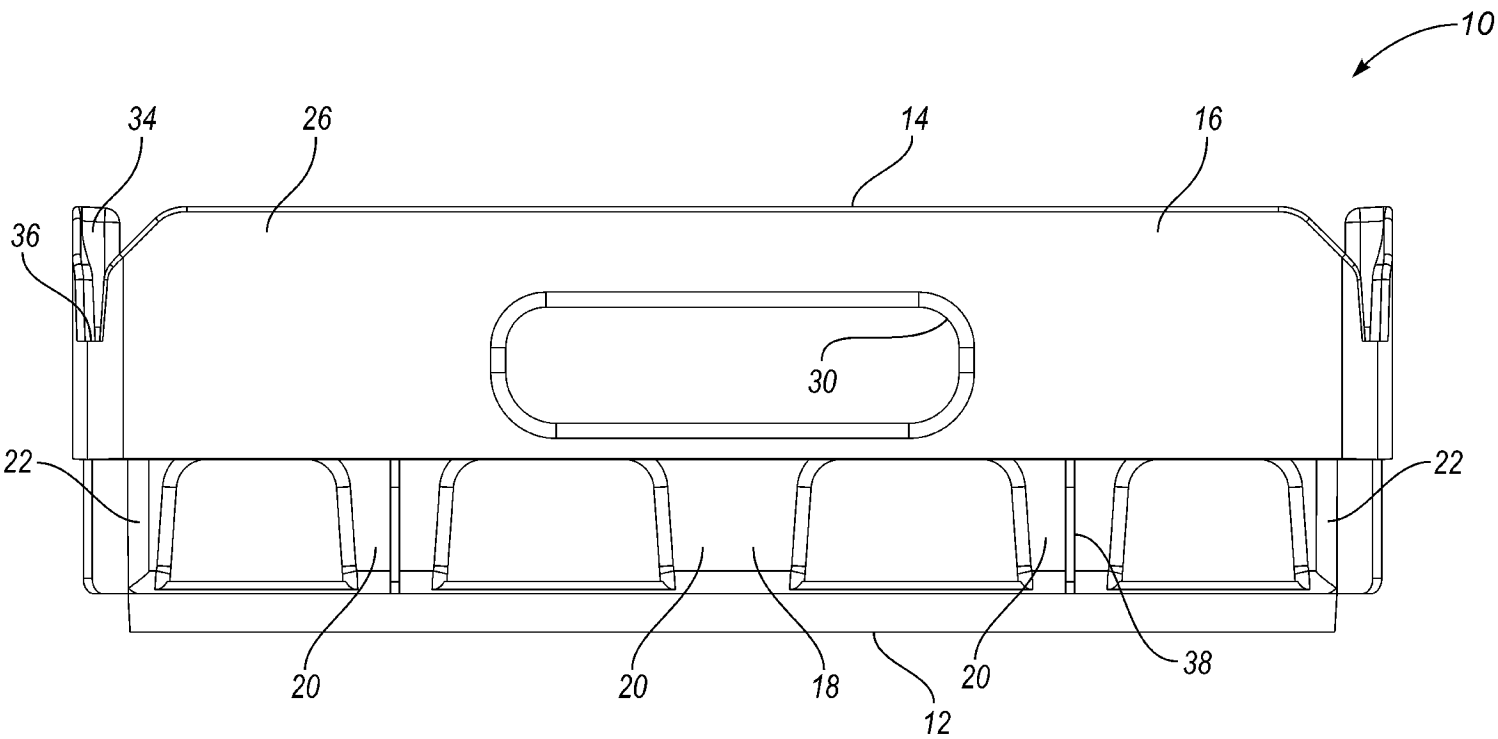
FIG. 6 is a side view of the crate of FIG. 1.

FIG. 6 is a side view of the crate 10.

Figure 7:
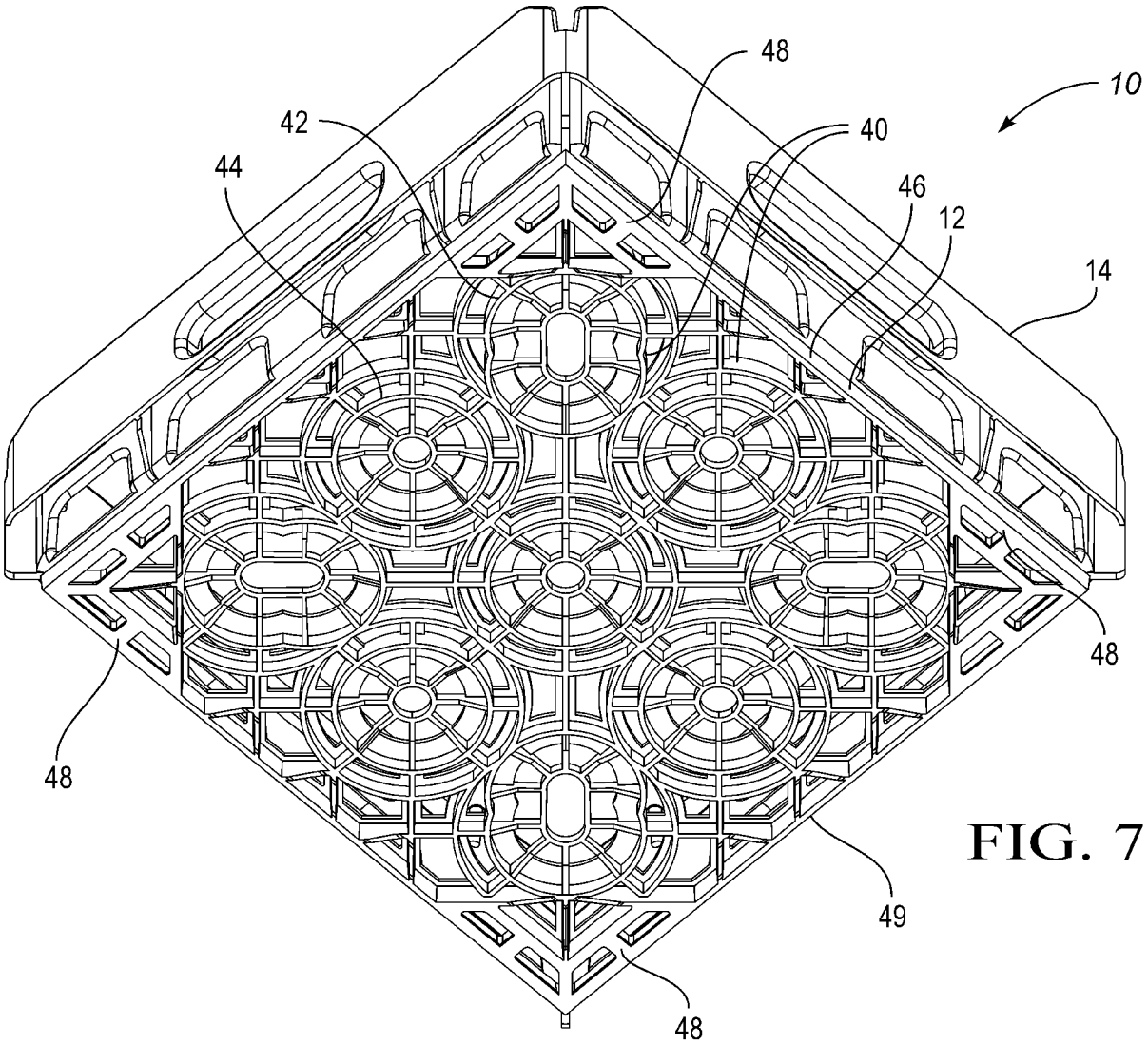
FIG. 7 is a bottom perspective view of the crate of FIG. 1.

FIG. 7 is a bottom perspective view of the crate 10, better illustrating the recesses 42, 44. As can also be seen in FIG. 7, the base 12 of the crate 10 includes a drag rail 49 extending around the periphery of the base 12 and defining a lowermost surface of the crate 10. Corner support areas 48 also extend downward to the lowermost plane of the crate 10 (coplanar with the drag rail 48). In the corner support areas 48, horizontal rib portions form the lowermost surface of the crate 10 and have vertical ribs extending upward therefrom (FIG. 1). In contrast, the other ribs in the base 12 include upper horizontal rib portions forming the support surface of the base 12 with vertical ribs extending downward therefrom.

Figure 8:
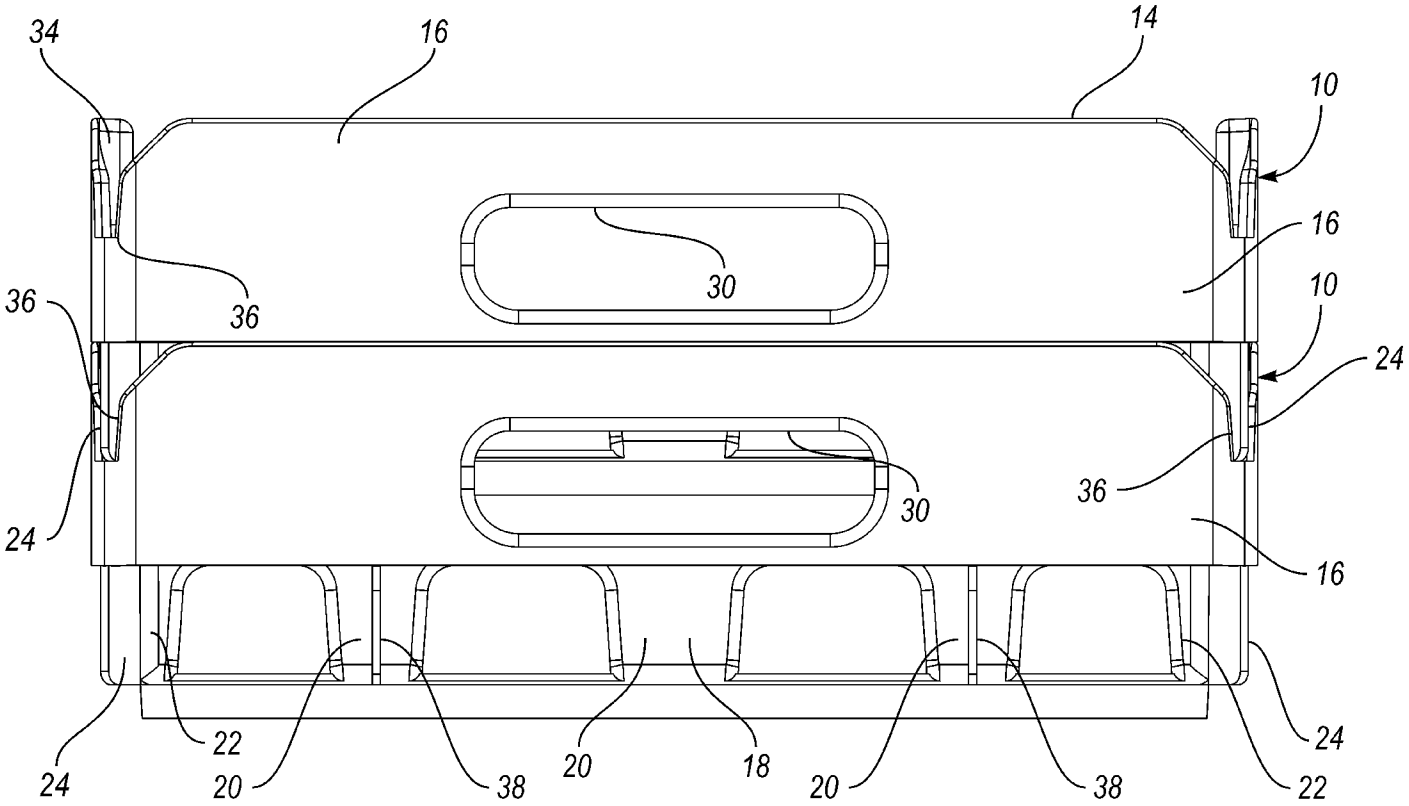
FIG. 8 shows the crate of FIG. 1 stacked on a similar crate.

FIG. 8 shows the crate 10 with an identical crate 10 nested thereon. As shown, the lower wall portion 18 of the upper crate 10 nests within the upper wall portion 16 of the lower crate 10. The support ribs 24 of the upper crate 10 are received in the slots 36 of the lower crate 10. The upper wall portion 16 of the upper crate 10 abuts the upper wall portion 16 of the lower crate 10. In this way, the crates 10 can occupy less volume for shipping and storage when empty.

Figure 9:
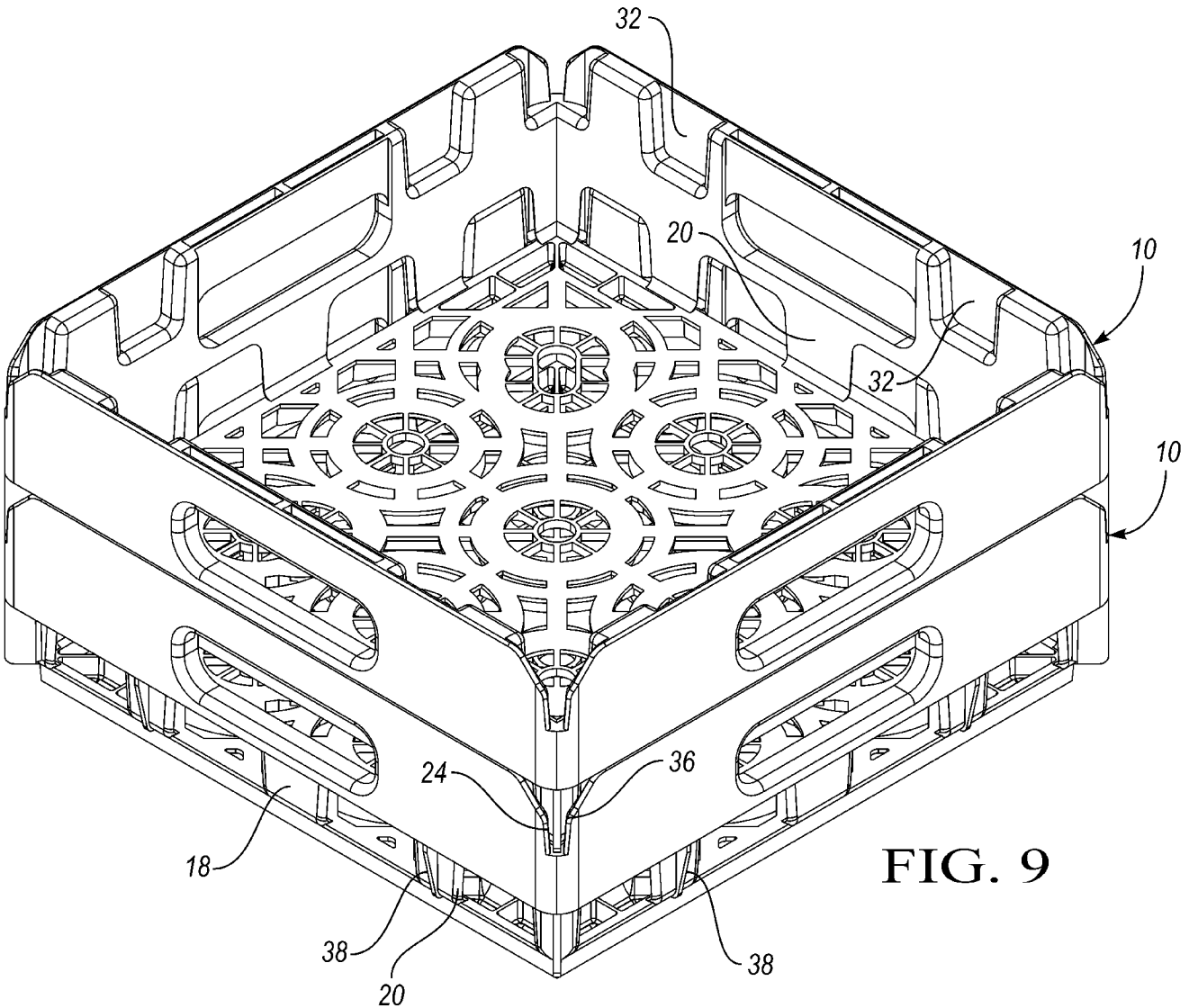
FIG. 9 is a top perspective view of the crate of FIG. 1 stacked on a similar crate.
Figure 10:
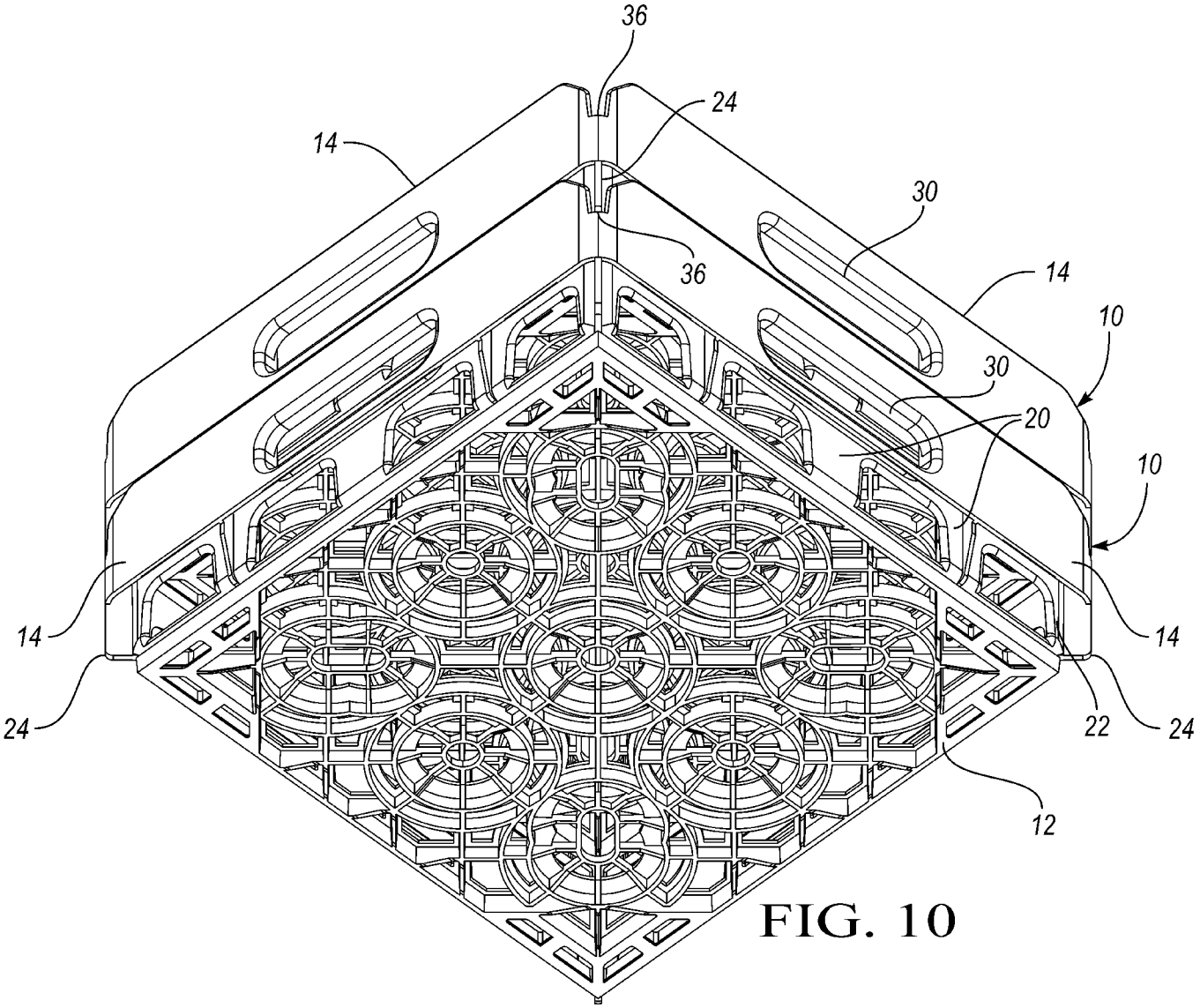
FIG. 10 is a bottom perspective view of the crate of FIG. 1 stacked on a similar crate.

FIG. 9 is a perspective view of the crates 10 of FIG. 8. The columns 20 and ribs 38 of the upper crate 10 are received in the recesses 32 of the lower crate 10. The center side columns 20 of the upper crate 10 are received adjacent the recessed handles of the lower crate 10. FIG. 10 is a bottom perspective view of the crates of FIG. 8.

Figure 11:
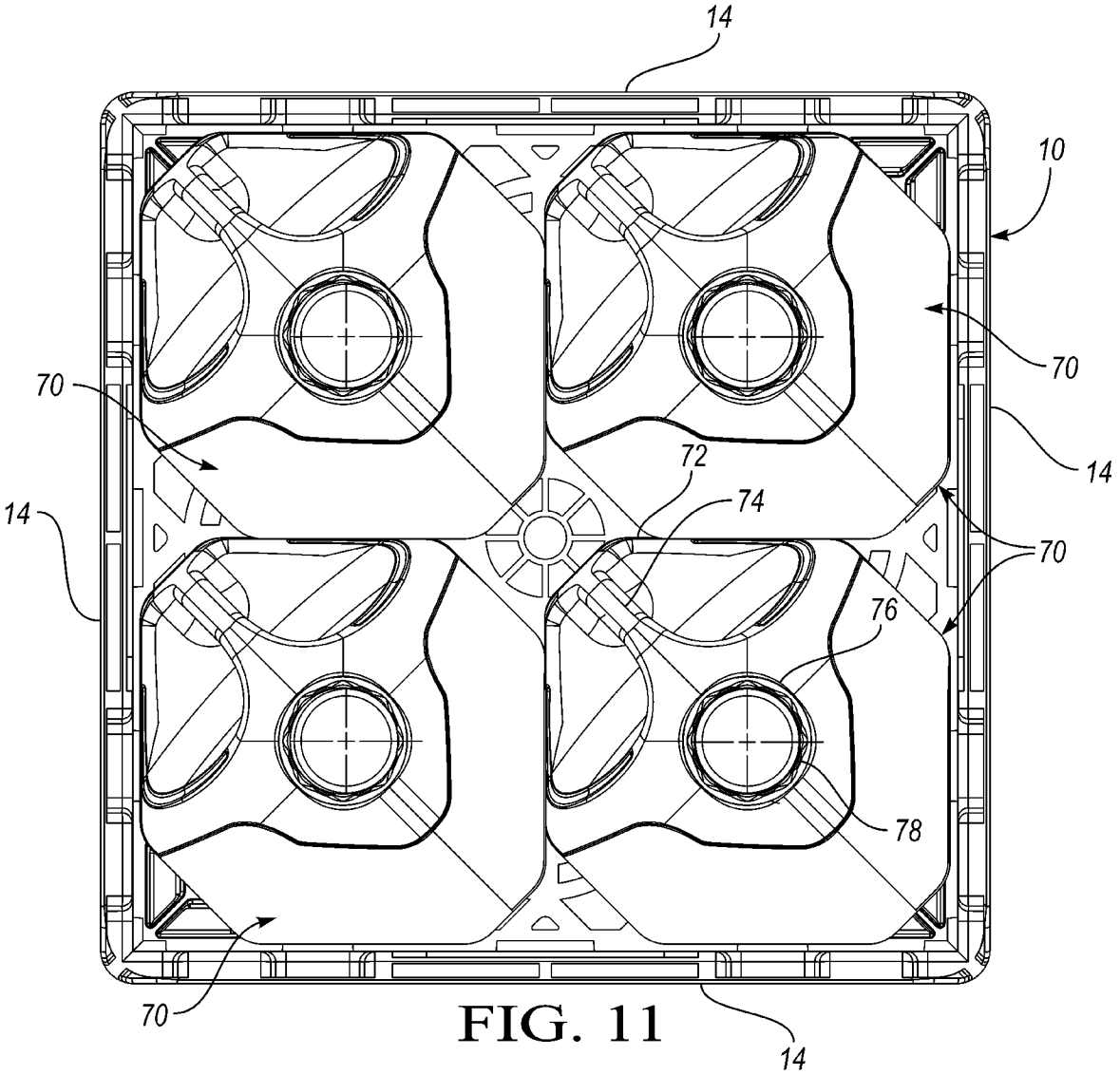
FIG. 11 is a top view of the crate of FIG. 1 with a plurality of first jugs stacked thereon.
Figure 12:
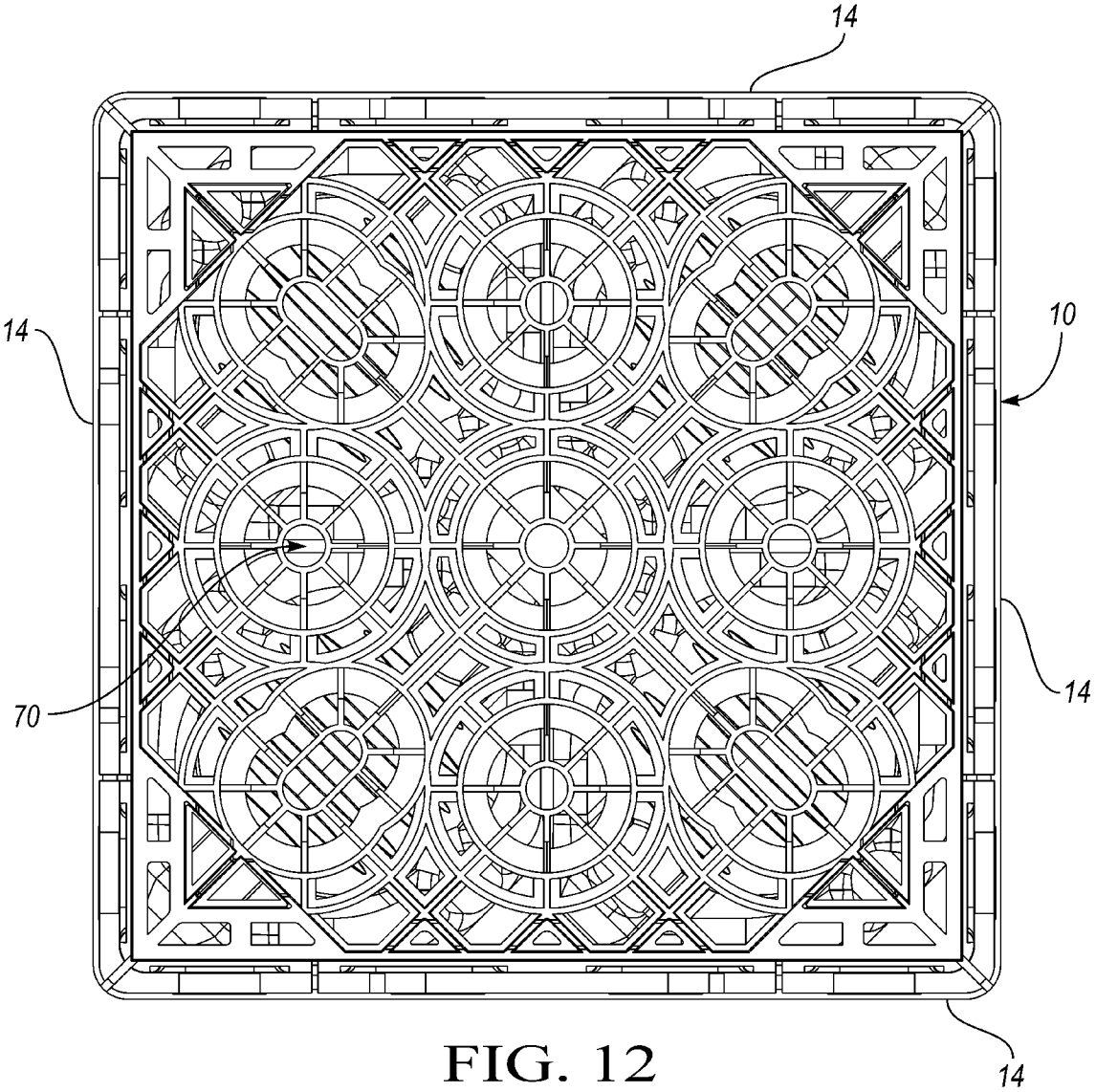
FIG. 12 is a bottom view of the crate of FIG. 1 with the plurality of first jugs stacked thereon.

FIG. 11 is a top view of the crate 10 with a plurality (in this case, four) of larger (in this case, gallon) plastic jugs 70 (e.g. for milk) received therein. Each jug 70 includes a body portion 72, a handle portion 74, a neck portion 76 and a cap 78 secured to the neck portion 76. The body portions 72 of the jugs 70 fit fairly snugly between the side walls 14 of the crate 10 on the base 12. FIG. 12 is a bottom view of the crate 10 and jugs 70 of FIG. 11.

Figure 13:
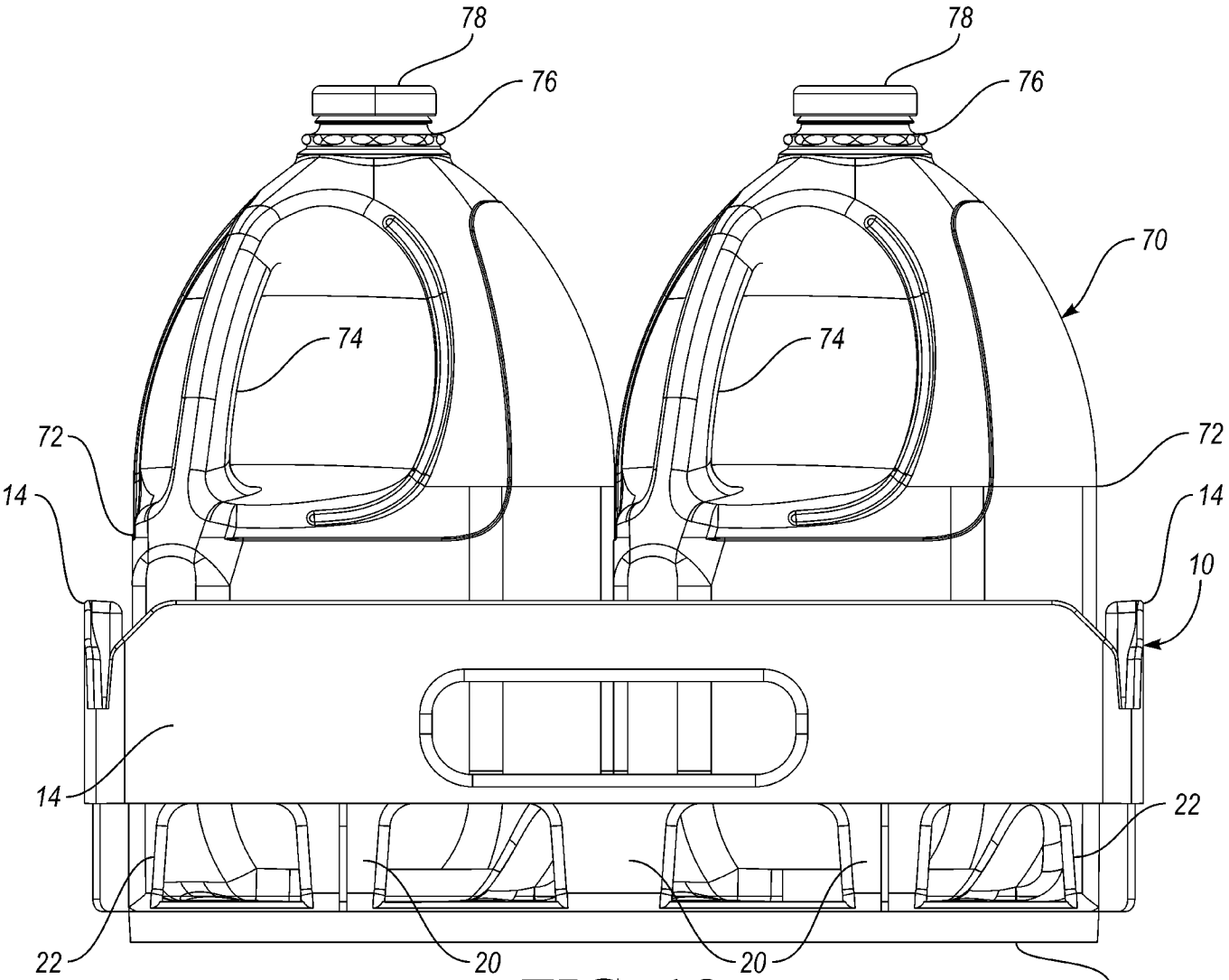
FIG. 13 is a side view of the crate of FIG. 1 with the plurality of first jugs stacked thereon.
Figure 14:
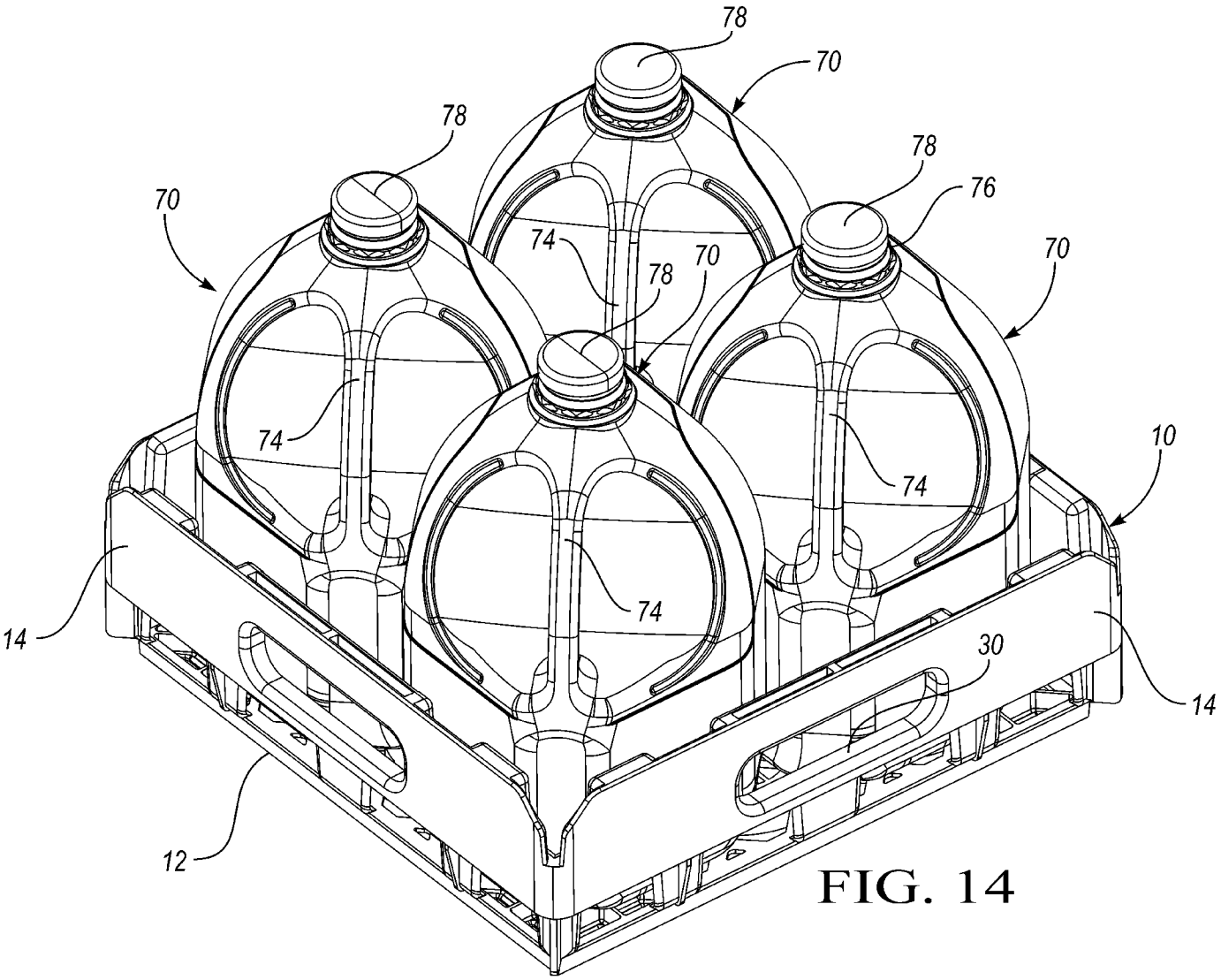
FIG. 14 is a top perspective view of the crate of FIG. 1 with the plurality of first jugs stacked thereon.
Figure 15:
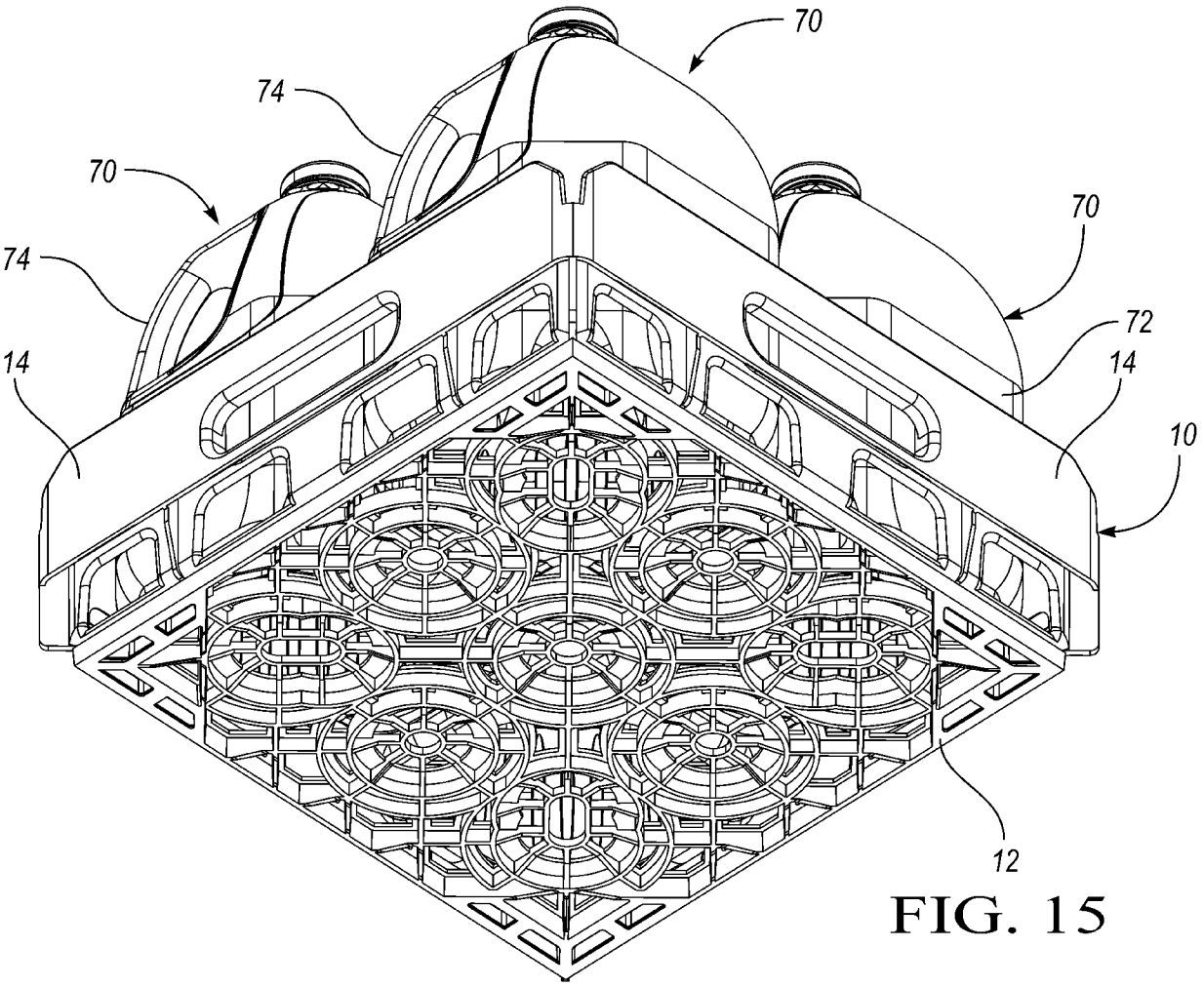
FIG. 15 is a bottom perspective view of the crate of FIG. 1 with the plurality of first jugs stacked thereon.

FIG. 13 is a side view and FIG. 14 is an upper perspective view of the crate 10 and jugs 70 of FIG. 11. As shown, the lower side walls 14 of the crate 10 make the handle portions 74 easily accessible because the handle portions 74 are above the side walls 14 (in this case, completely above the side walls 14). FIG. 15 is a bottom perspective view of the crate 10 and jugs 70.

Figure 16:
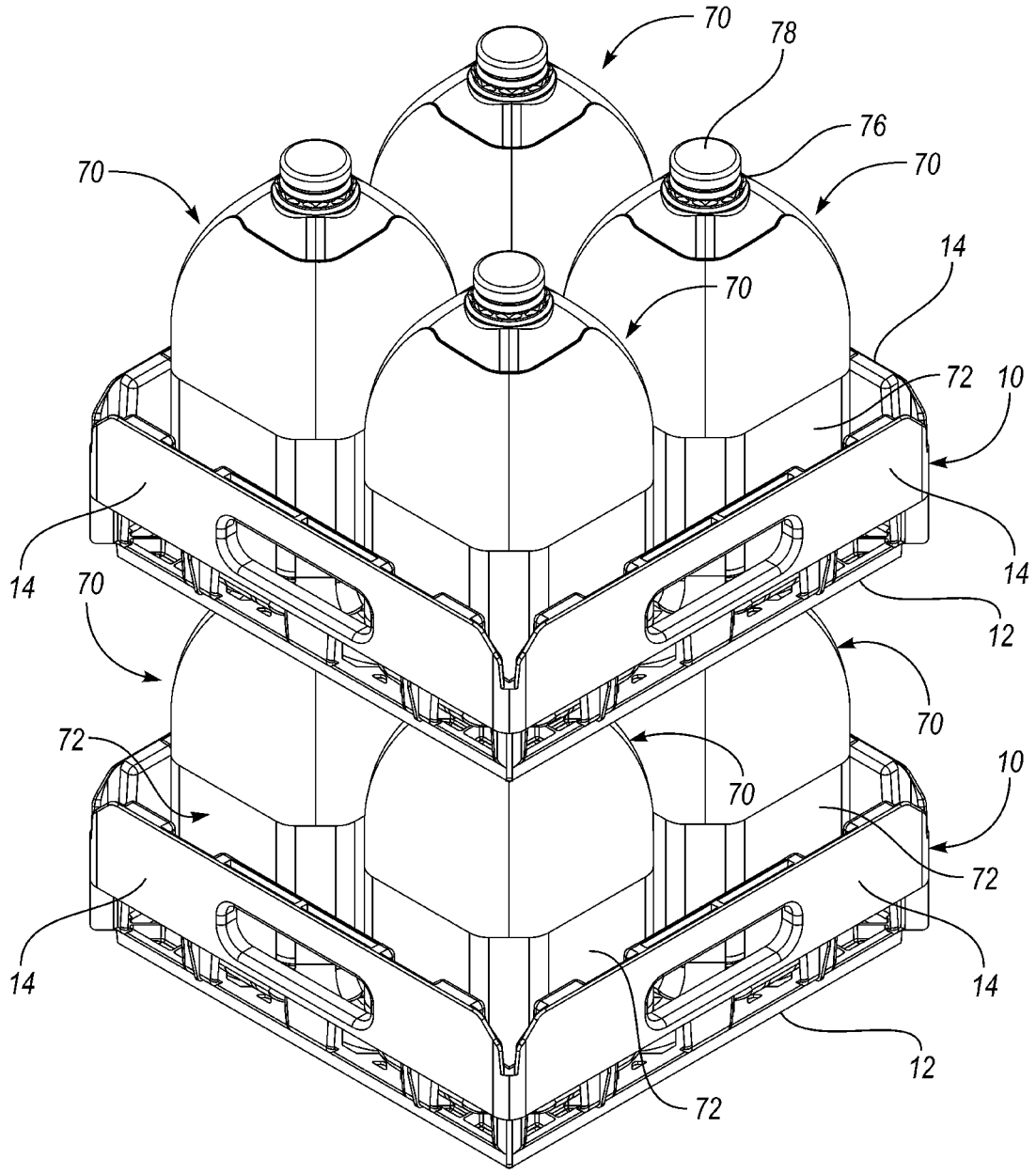
FIG. 16 is a top perspective view of the crate of FIG. 1 with the plurality of first jugs stacked thereon stacked on a similar crate with another plurality of first jugs stacked thereon.
Figure 17:
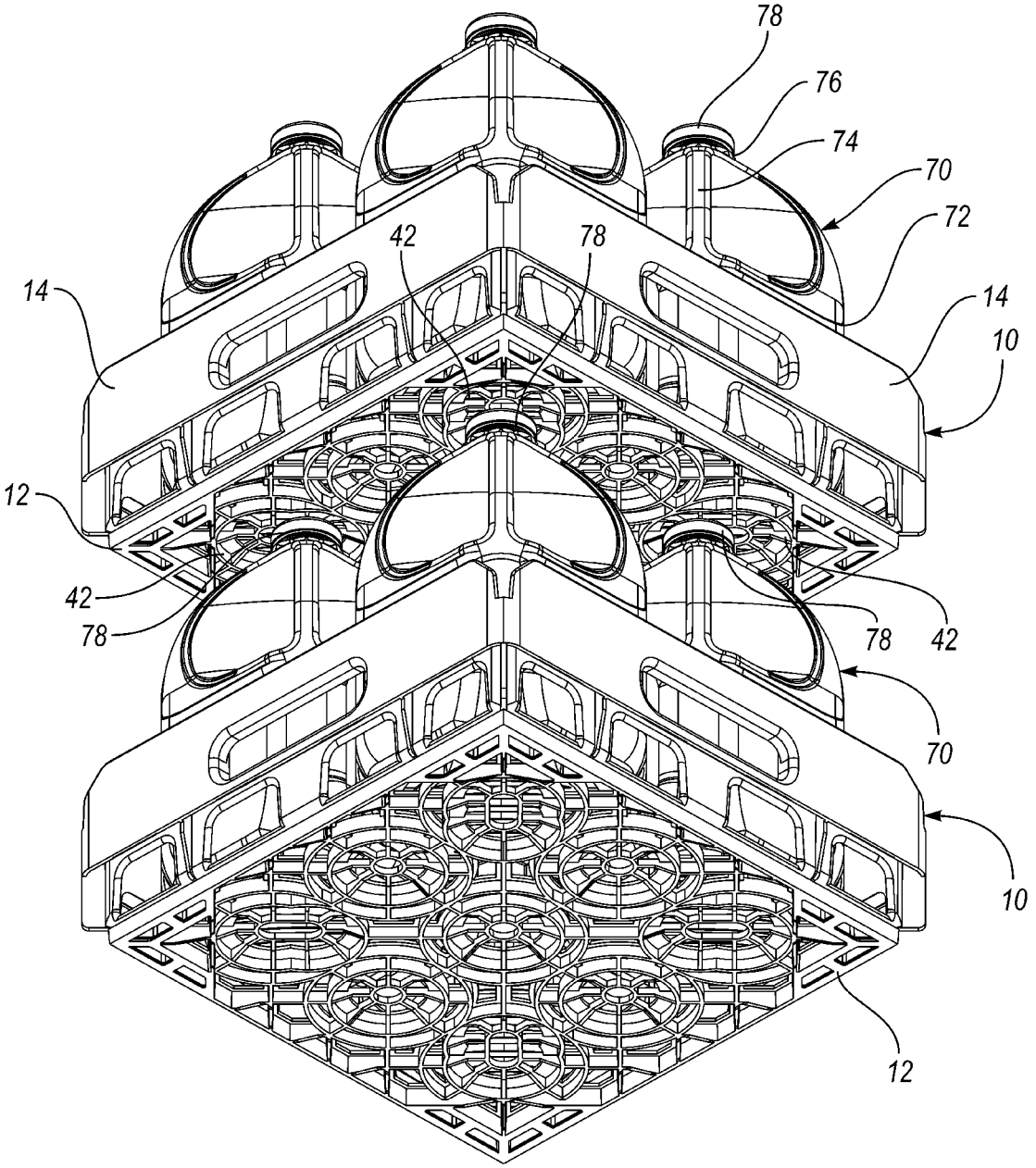
FIG. 17 is a bottom perspective view of the crate of FIG. 1 with the plurality of first jugs stacked thereon stacked on a similar crate with another plurality of first jugs stacked thereon.

FIGS. 16 and 17 show the crate 10 and jugs 70 with identical crate 10 with jugs 70 stacked thereon. The upper crate 10 is stacked directly on the jugs 70 of the lower crate 10. Referring to FIG. 17, the caps 78 of the jugs 70 in the lower crate 10 are received in the corner recesses 42 of the base 12 of the upper crate 10. This improves the stability of a stack of crates 10 and jugs 70.

Figure 19:
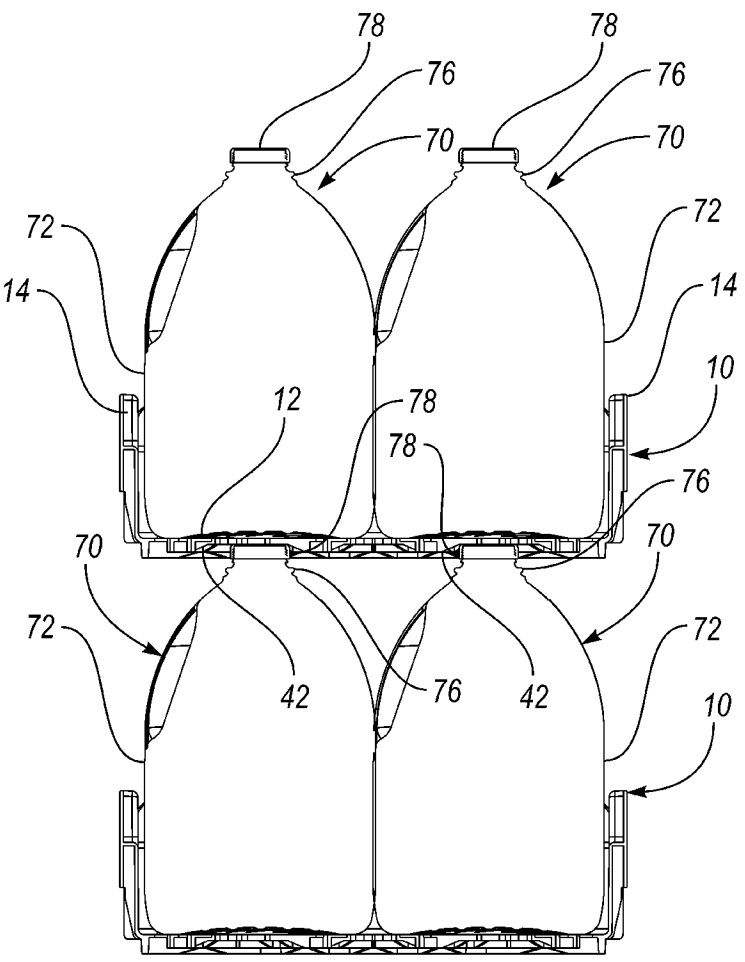
FIG. 19 is a cross-sectional view of the crate of FIG. 1 with the plurality of first jugs stacked thereon stacked on a similar crate with another plurality of first jugs stacked thereon.
Figure 18:
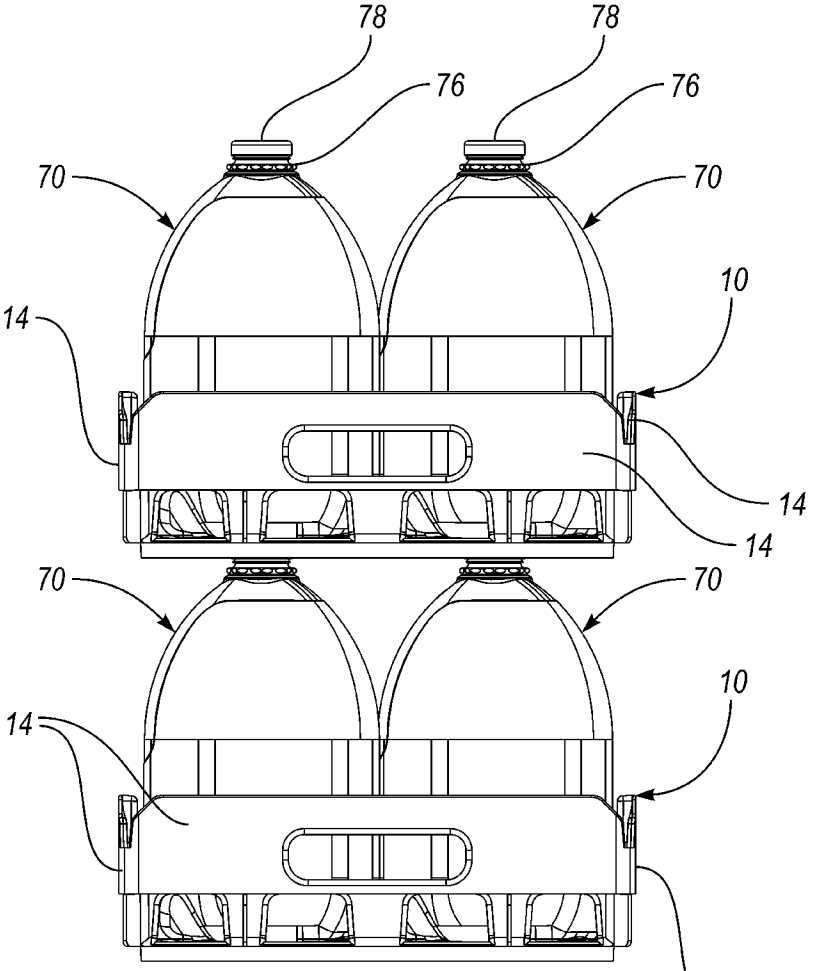
FIG. 18 is an end view of the crate of FIG. 1 with the plurality of first jugs stacked thereon stacked on a similar crate with another plurality of first jugs stacked thereon.

FIGS. 18 and 19 are a side view and a section view through the crates 10 and jugs 70 of FIG. 17. Referring to FIG. 19, the caps 78 are received in the corner recesses 42 of the base 12 of the upper crate 10.

Figure 20:
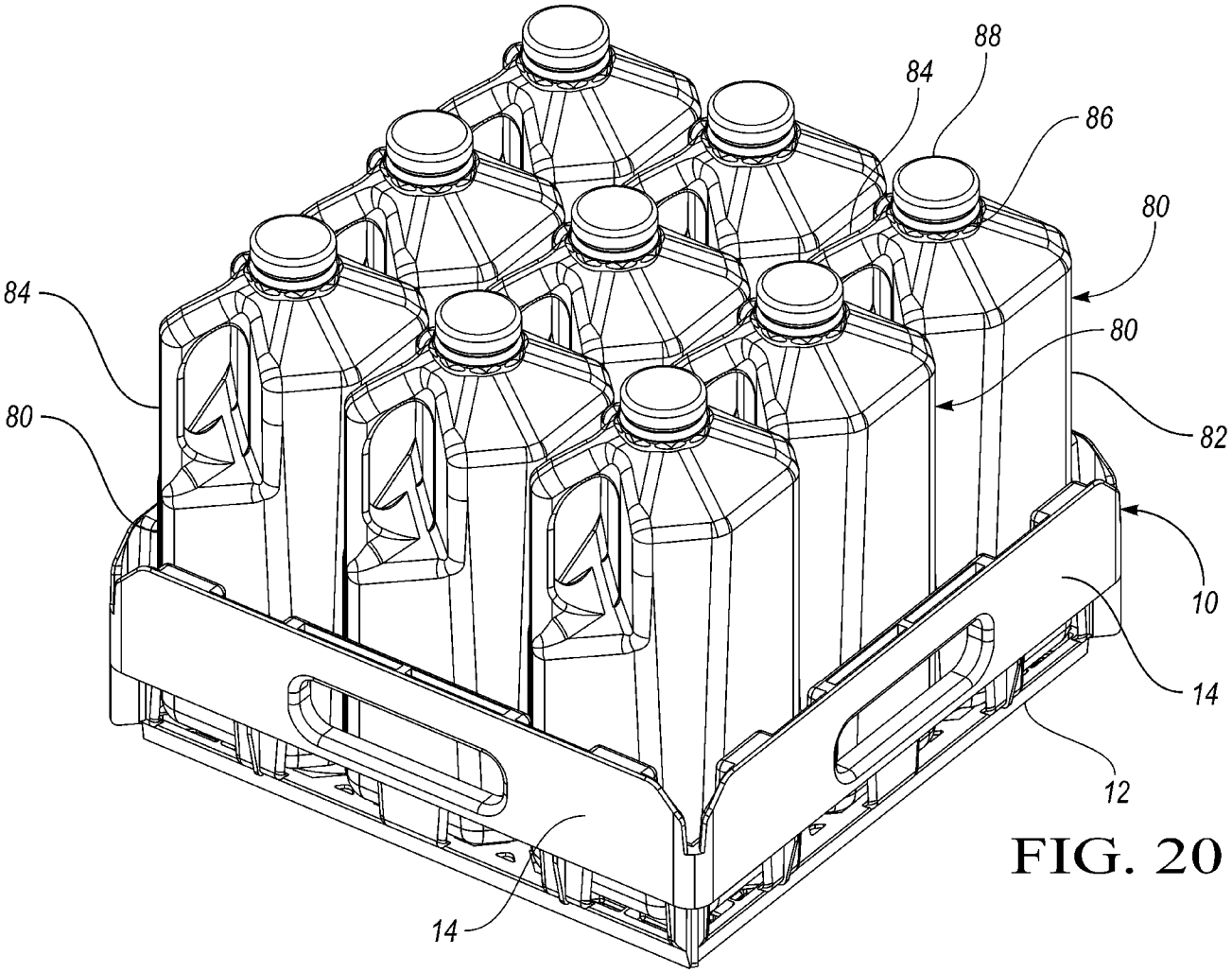
FIG. 20 is perspective view of the crate of FIG. 1 with a plurality of second jugs stacked thereon.

FIG. 20 shows the crate 10 loaded with a plurality (in this case, nine) smaller (in this case, half-gallon) jugs 80. The jugs 80 each have a body portion 82, handle 84, neck portion 86 and a cap 88. The jugs 80 fit snugly between the side walls 14 on the base 12.

Figure 22:
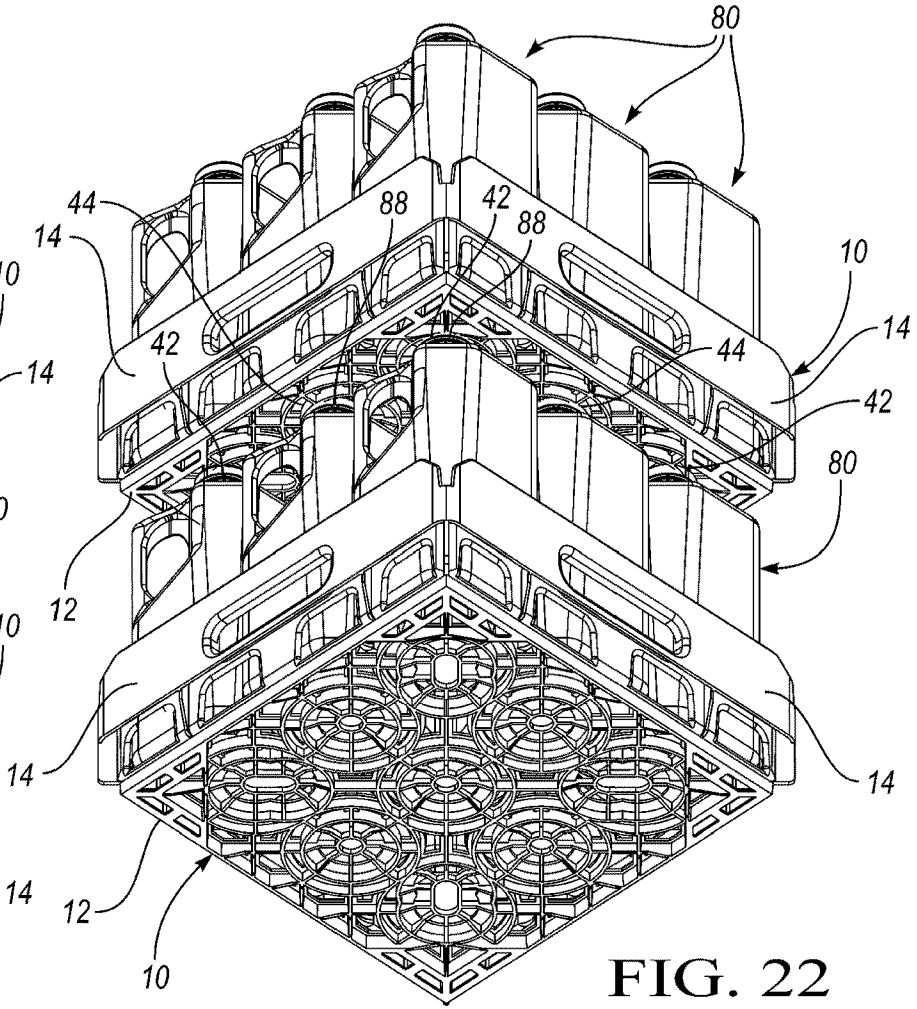
FIG. 22 is a bottom perspective view of the crate of FIG. 1 with the plurality of second jugs stacked thereon stacked on a similar crate with another plurality of second jugs stacked thereon.
Figure 21:
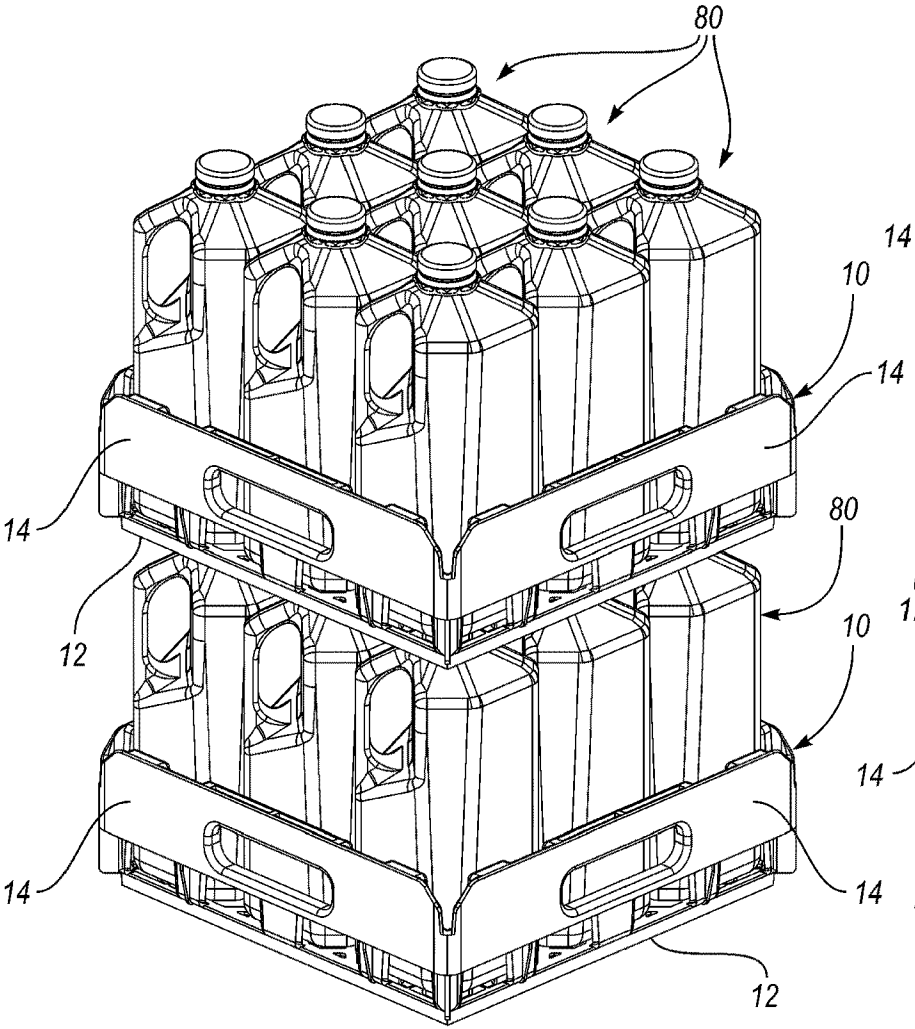
FIG. 21 is a top perspective view of the crate of FIG. 1 with the plurality of second jugs stacked thereon stacked on a similar crate with another plurality of second jugs stacked thereon.

FIGS. 21 and 22 show an identical crate 10 loaded with jugs 80 stacked on the crate 10 and jugs 80. Again, the upper crate 10 is supported directly on the jugs 80 in the lower crate 10. The caps 88 are received in the nine cap receiving recesses 42, 44 of the base 12 of the upper crate 10 to make the stack more stable.

Figure 24:
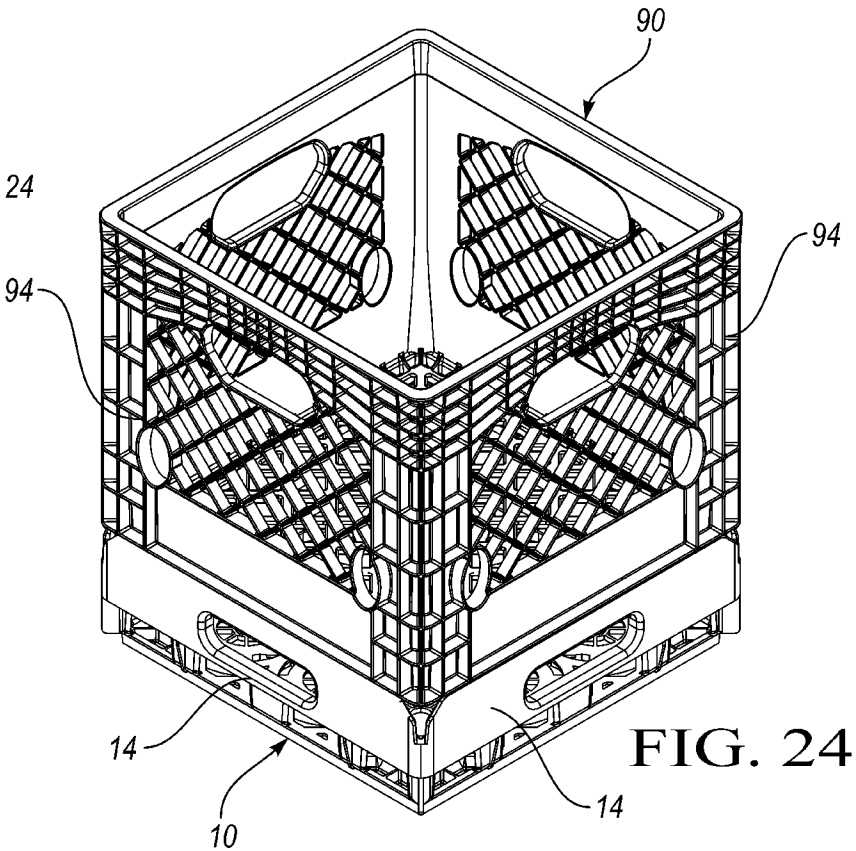
FIG. 24 is a perspective view of the full height milk crate stacked on the crate of FIG. 1.
Figure 23:
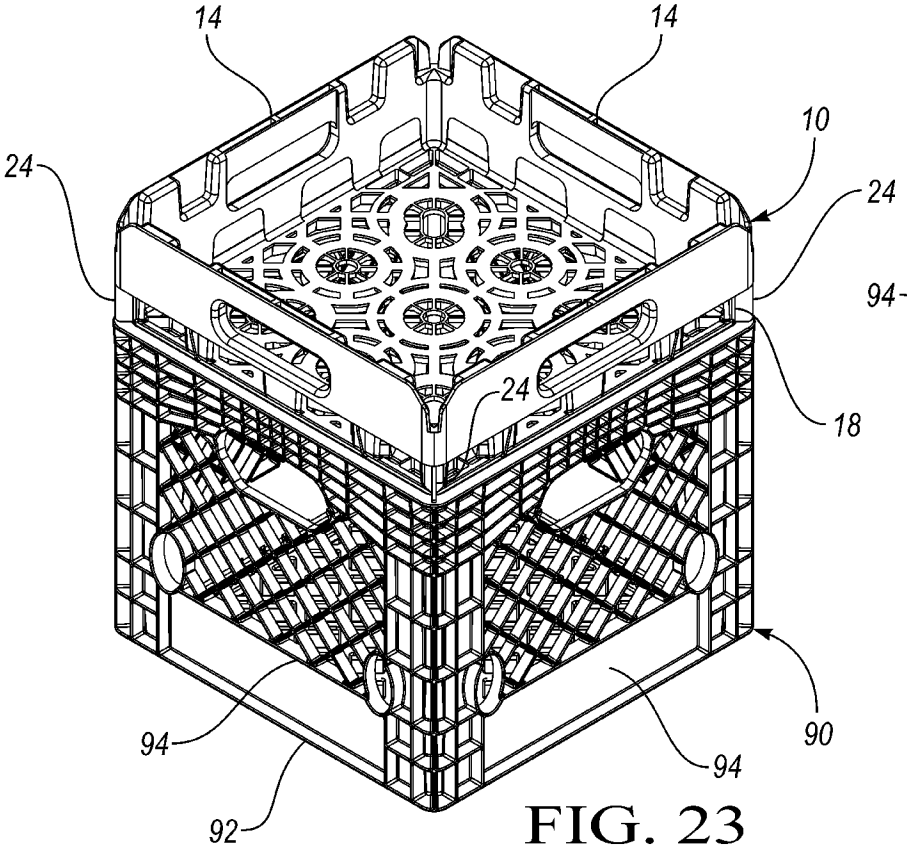
FIG. 23 is a perspective view of the crate of FIG. 1 stacked on a full height milk crate.

As shown in FIGS. 23 and 24, the crate 10 has some compatibility with a prior art full-depth crate 90. The full-depth crate 90 includes a base 92 having side walls 94 extending upward therefrom. The side walls 94 are taller than the jugs 70, 80. In FIG. 23, the crate 10 can be stacked on the full-depth crate 90. The support ribs 24 are supported on the side walls 94 of the full-depth crate 90 to prevent the lower wall portion 18 of the crate 10 from nesting into the full-depth crate 90 and contacting any jugs therein (FIG. 25).

In FIG. 24, the full-depth crate 90 is stacked on the empty crate 10, with a drag rail 93 (FIG. 25) of the full-depth crate 90 received between the side walls 14 of the lower crate 10.

Figure 25:
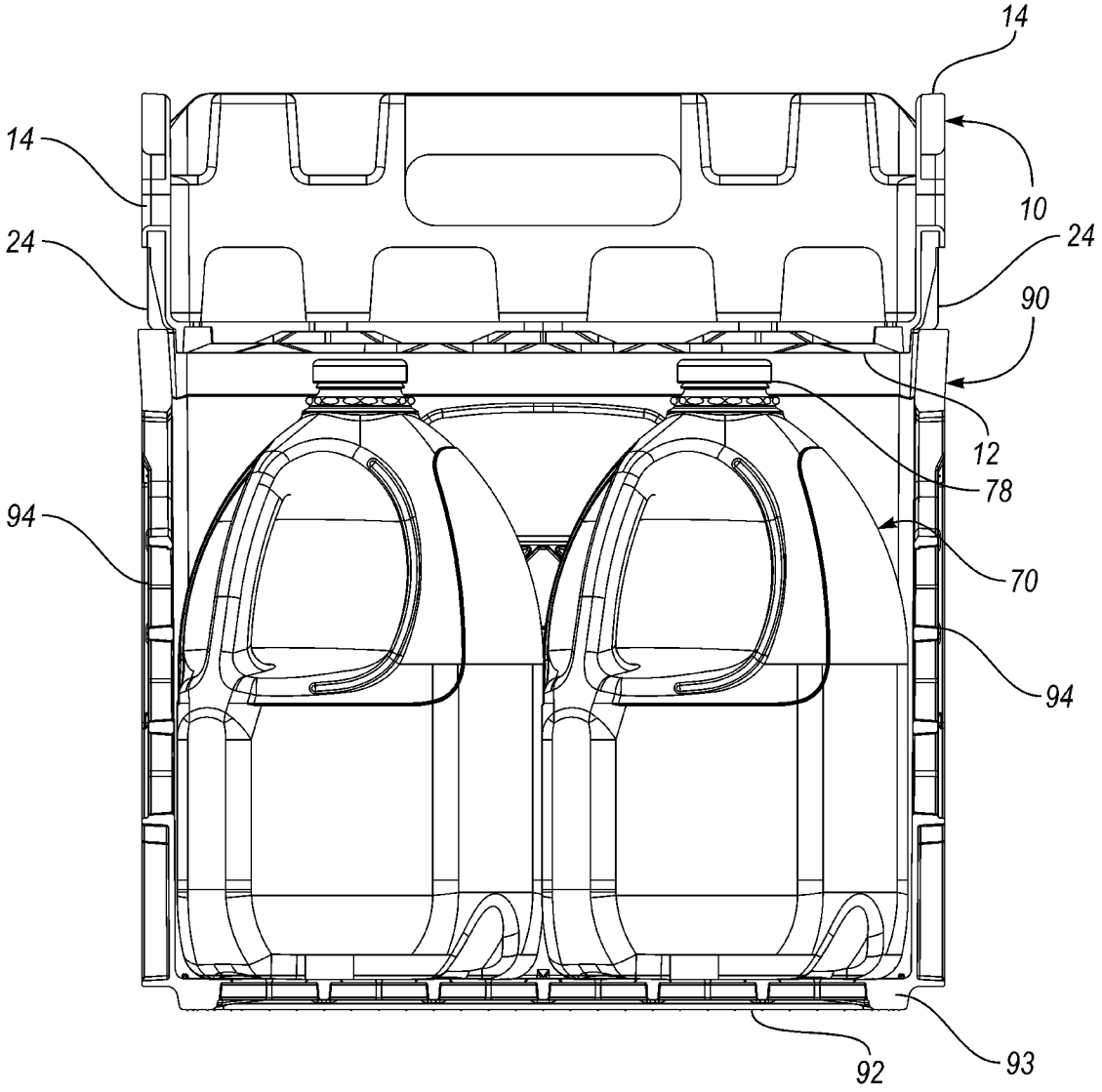
FIG. 25 is cross-sectional view of the crate of FIG. 1 stacked on the full height milk crate.

As shown in FIG. 25, when the crate 10 is stacked on top of the full-depth crate 90, the caps 78 on the jugs 70 are spaced from the base 12 of the crate 10 such that the caps 78 of the jugs 70 do not support a load from the crate 10 above.

Figure 26:
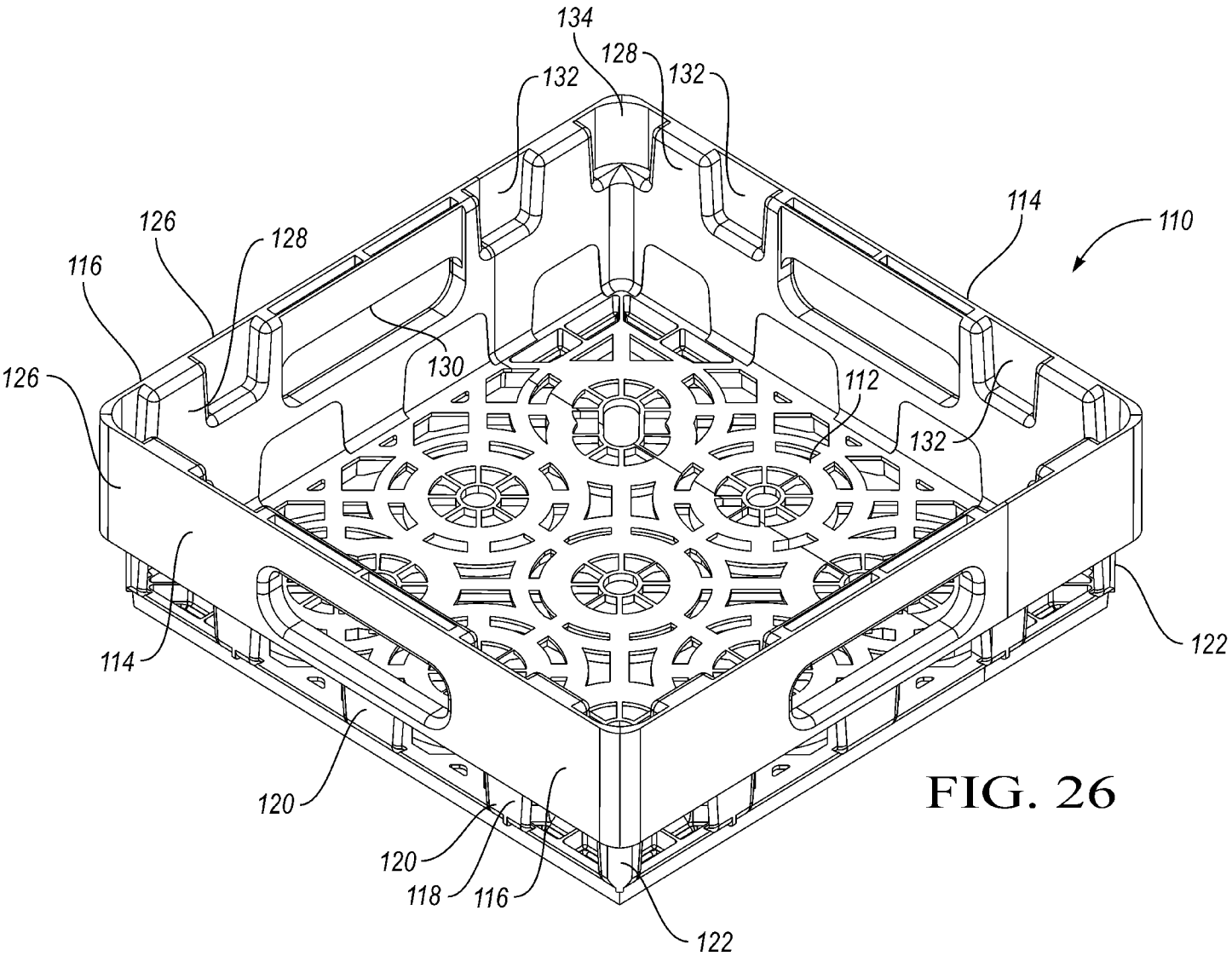
FIG. 26 is a perspective view of another example crate.

FIG. 26 shows an alternative crate 110 that is not compatible with the prior art full-depth crate 90. The crate 110 according to a second embodiment of the present invention includes a base 112 and side walls 114 extending upward from a periphery of the base 112. Each side wall 114 includes an upper wall portion 116 and a lower wall portion 118. The lower wall portion 118 includes a plurality of single-wall columns 120 and corner columns 122 extending from the base 112 to the upper wall portion 116.

The upper wall portion 116 (or upper band) includes an outer wall 126 spaced outward of an inner wall 128. The inner wall 128 is generally continuous with the columns 120 to create a generally flat, continuous inner surface of the crate 110. The outer wall 126 is spaced outward of the lower wall portion 118.

A handle opening 130 is formed through the upper wall portion 116 of each of the side walls 114. Upward opening recesses 132 are formed in the inner wall 128 above each of the columns 120. Further, the inner wall 128 is recessed slightly outward above the center columns 120 at the handle openings 130. Corner recesses 134 are formed in the inner walls 128 in each of the corners of the crate 110. The underside of the base 112 is identical to the base 12 of the first embodiment of the crate 10 and can stack on four or nine caps 78, 88 on the jugs 70, 80, respectively.

Figure 27:
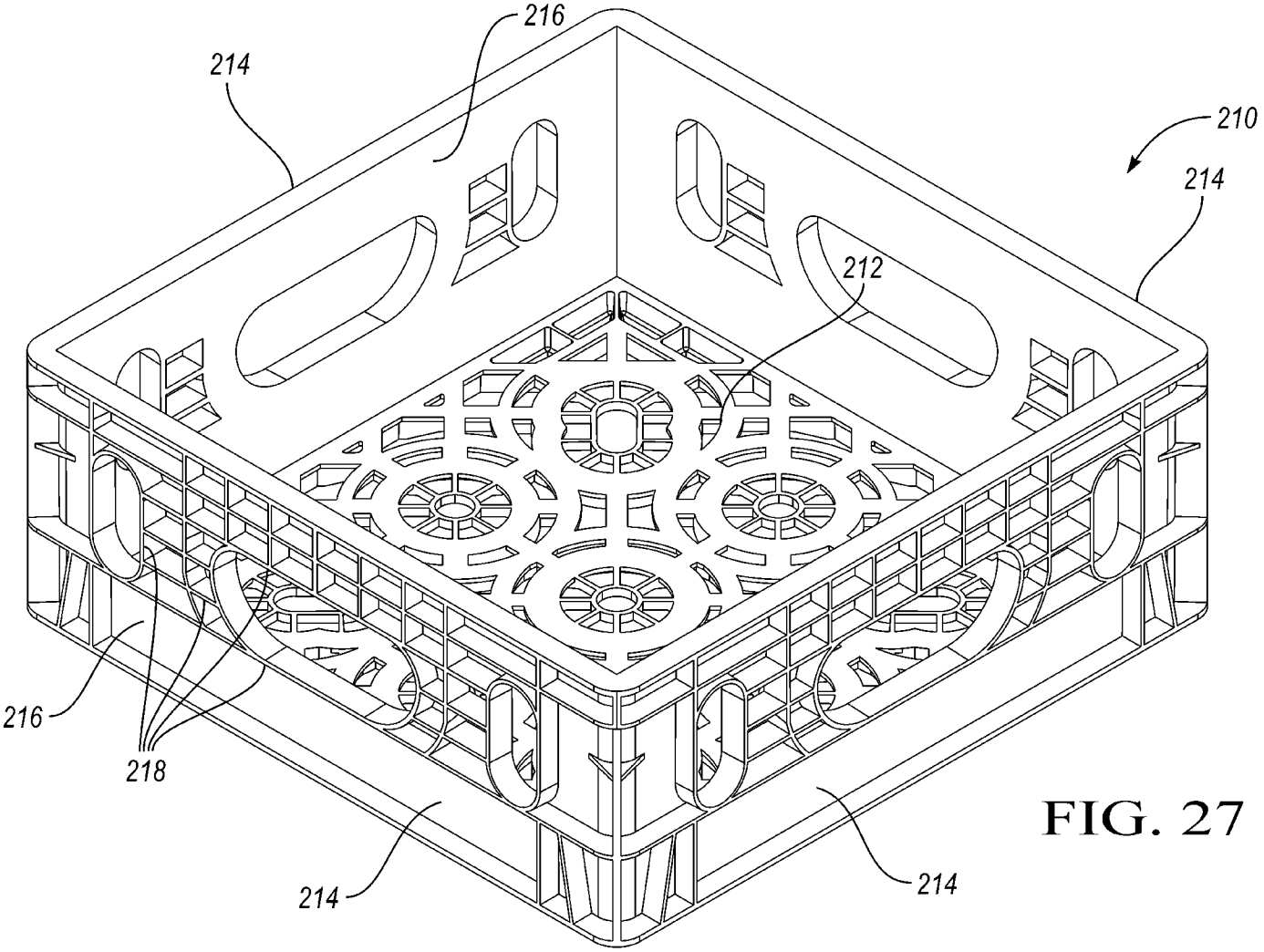
FIG. 27 is a perspective view of yet another example crate.

FIG. 27 shows a crate 210 according to a third embodiment. The crate 210 includes a base 212. Side walls 214 extend upward from the base 12. Each side wall 214 includes an inner panel portion 216 and a plurality of ribs 218 extending outward therefrom.

Figure 29:
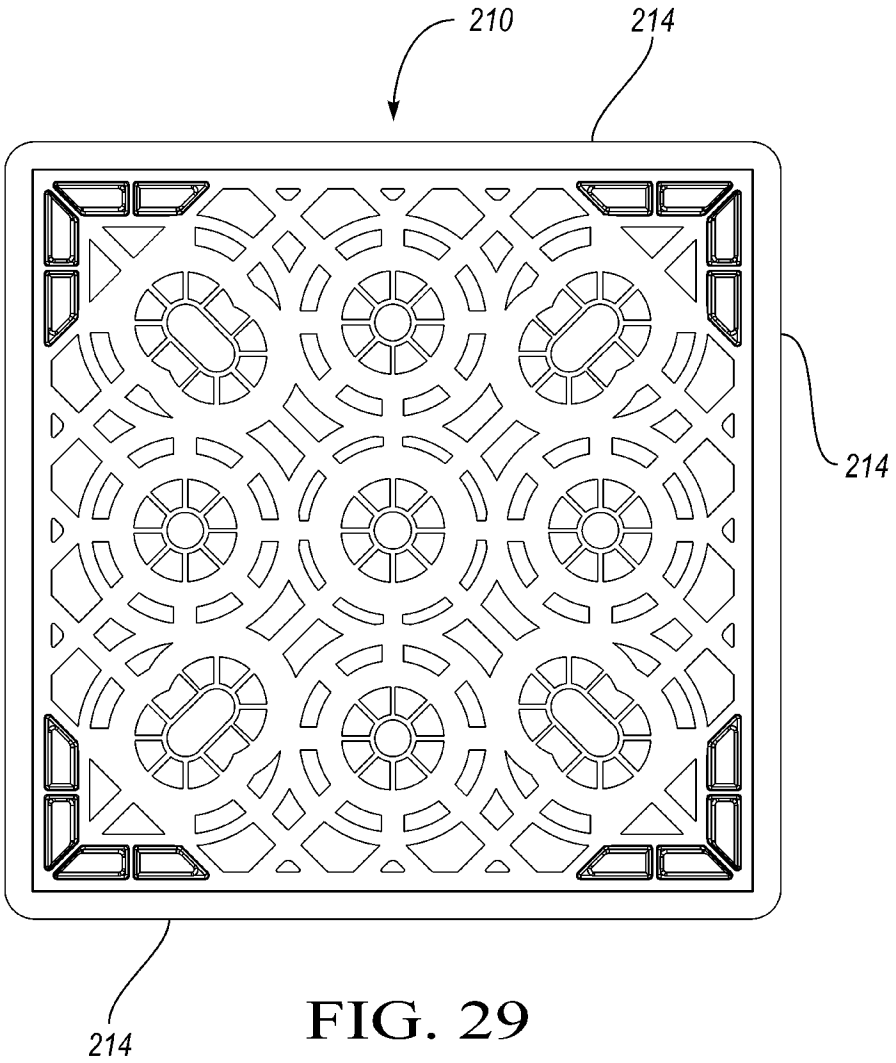
FIG. 29 is a top view of the crate of FIG. 27.
Figure 28:
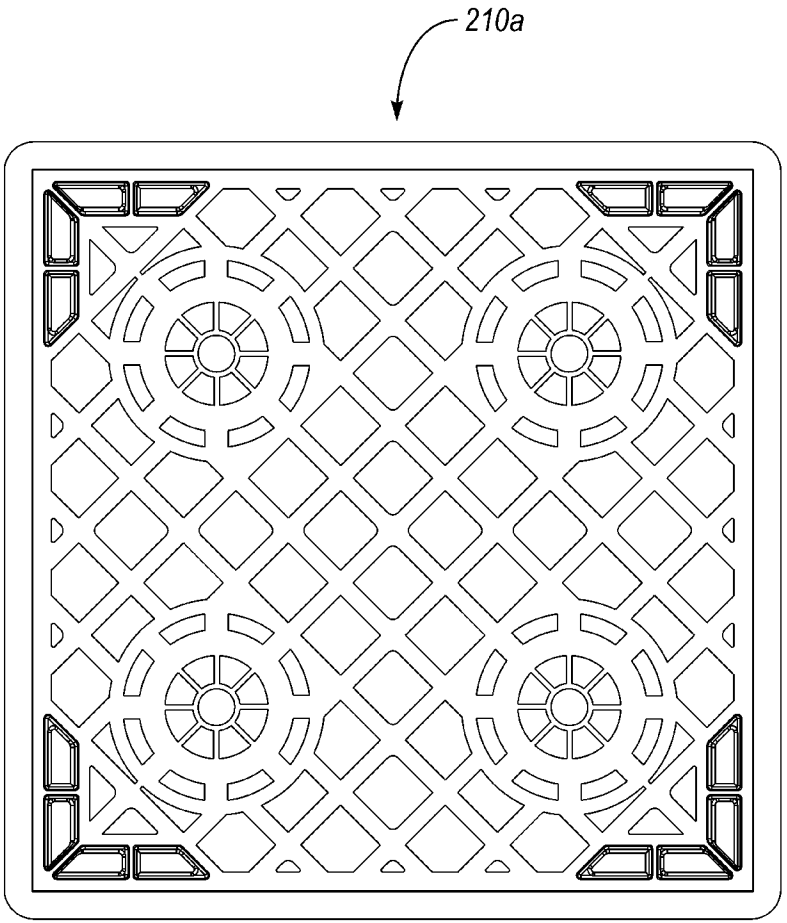
FIG. 28 is a top view of a crate similar to the crate of FIG. 27.

FIG. 28 is a top view of an alternate version of the crate **210*a* that is only for larger (e.g. gallon) jugs 70. FIG. 29 is a top view of the crate 210, which can be for larger jugs 70 and smaller jugs 80**.

Figure 30:
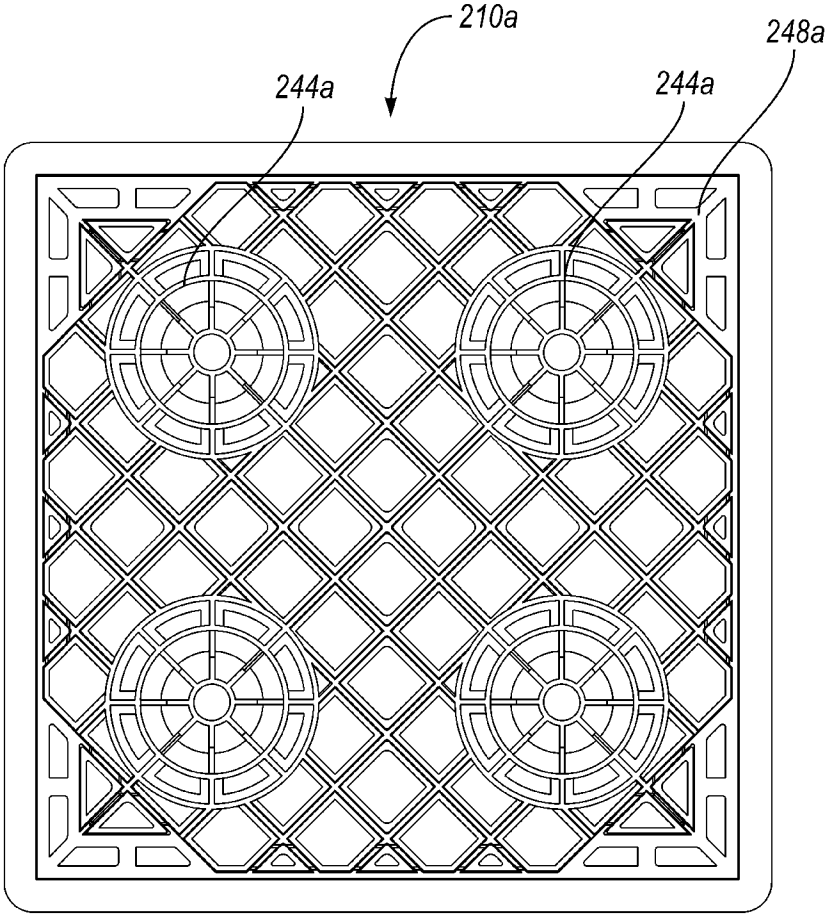
FIG. 30 is a bottom view of the crate of FIG. 28.
Figure 32:
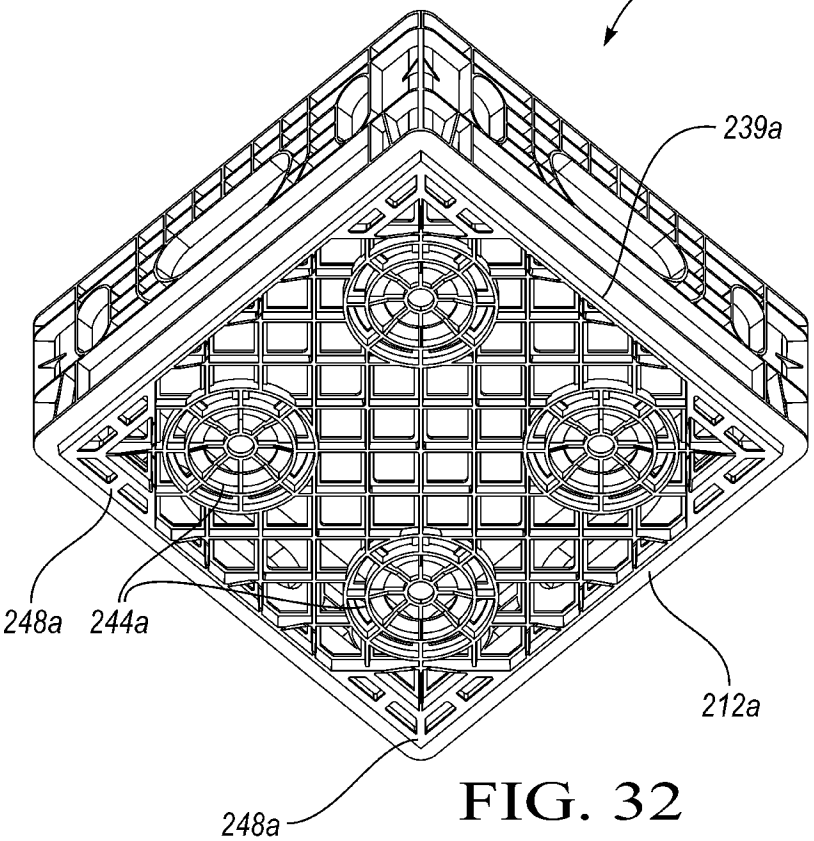
FIG. 32 is a bottom perspective view of the crate of FIG. 28.

FIGS. 30 and 32 are bottom views of the alternate crate **210*a* having four cap capture recesses 244*a* and four corner support areas 248*a*** (as above).

Figure 31:
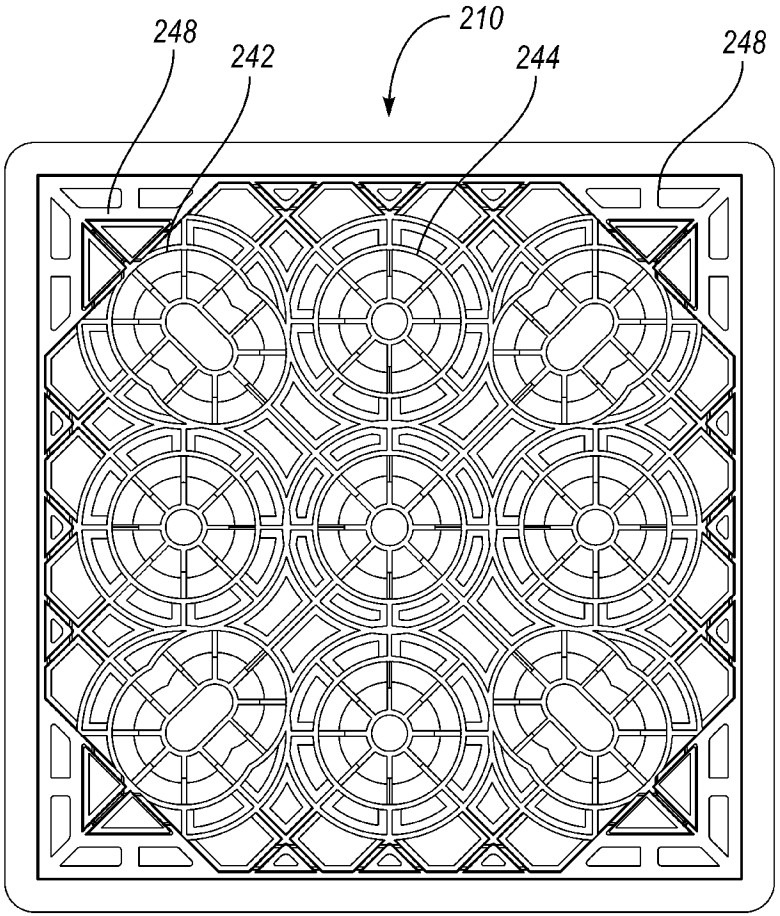
FIG. 31 is a bottom view of the crate of FIG. 27.
Figure 33:
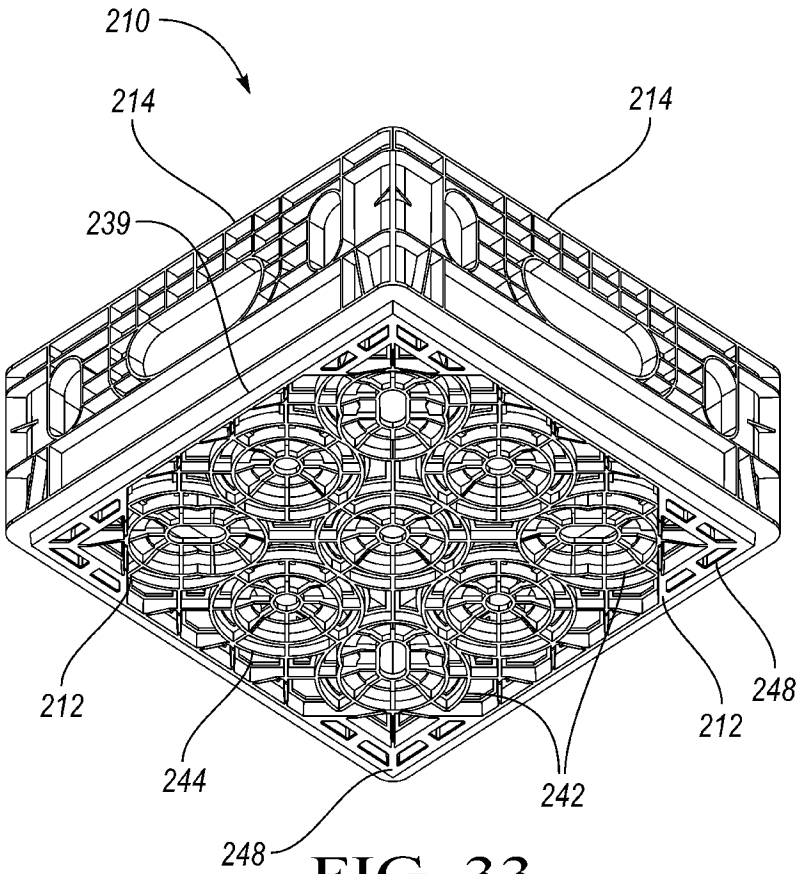
FIG. 33 is a bottom perspective view of the crate of FIG. 27.

FIGS. 31 and 33 are bottom view of the crate 210 having four cap capture recesses 242, five non-center cap capture recesses 244 and four corner support areas 248 (as above).

Figure 34:
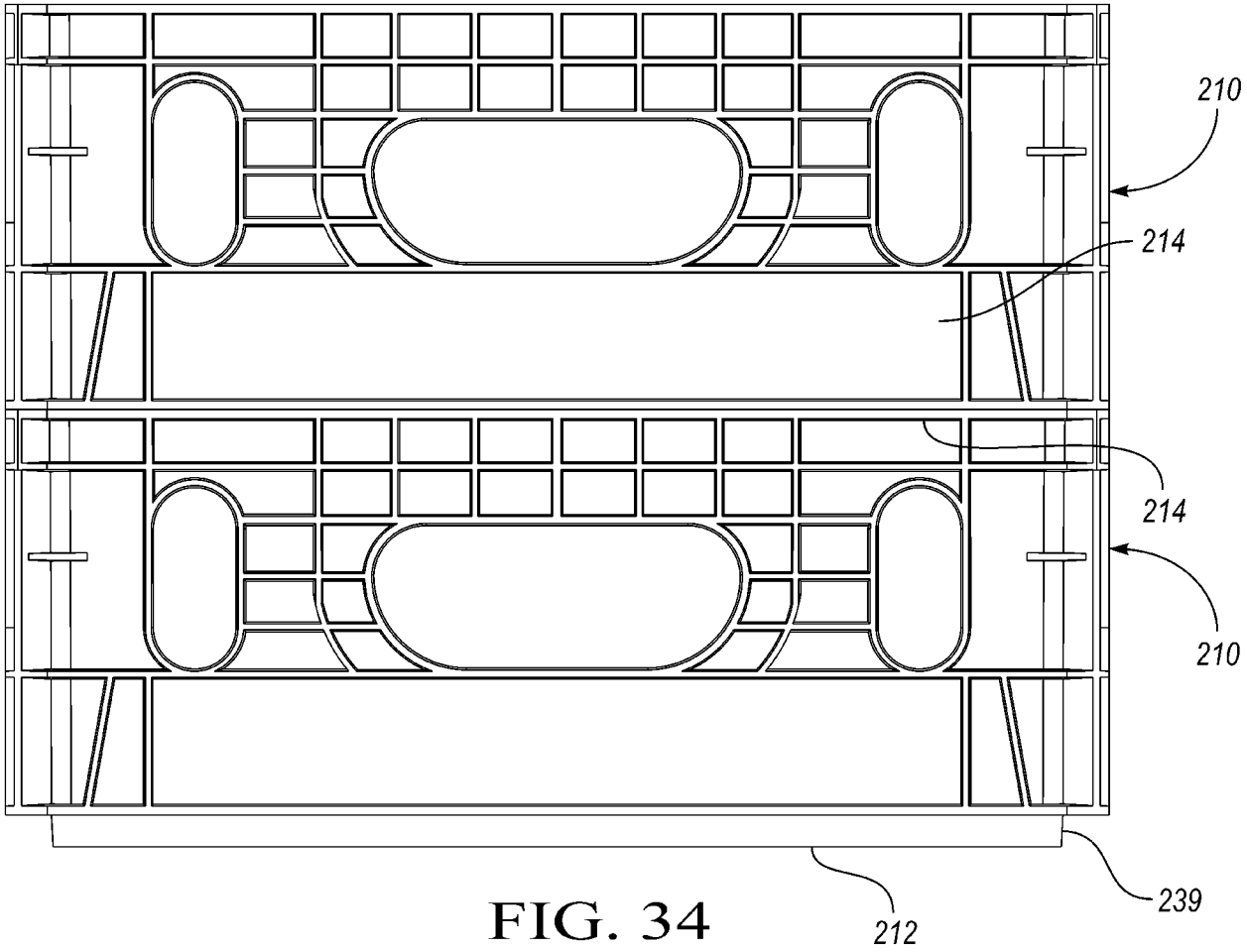
FIG. 34 is a side view of the crate of FIG. 27 stacked on a similar crate.

As shown in FIG. 34, the crate 210 is not nestable (although a drag rail 239 and corner support areas of the upper crate 210 fit into the side walls 214 of the lower crate 210). However, the crates 210 are significantly shorter than the full-depth prior art crates 90.

Figure 35:
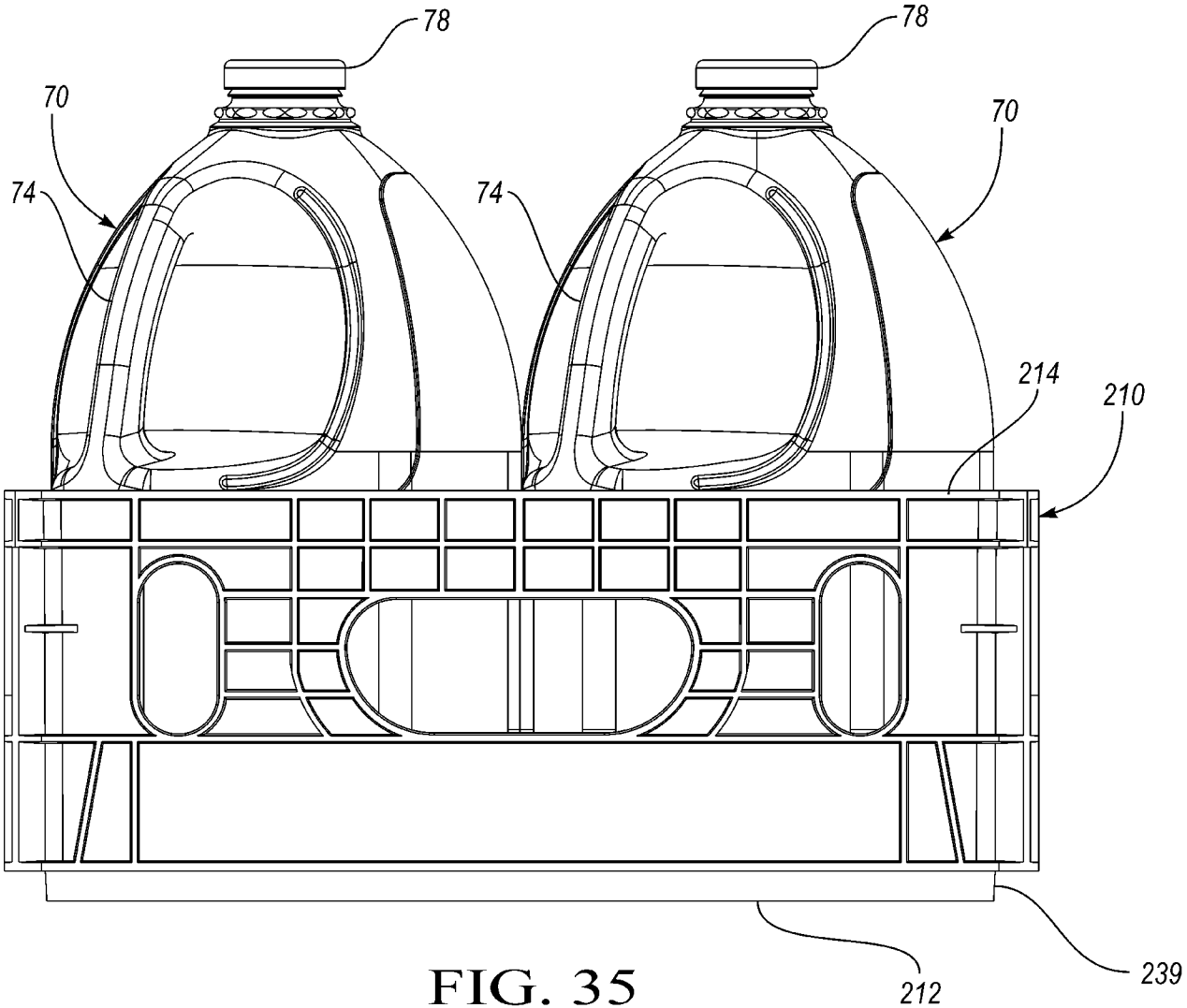
FIG. 35 is a side view of the crate of FIG. 27 with a plurality of first jugs stacked thereon.
Figure 36:
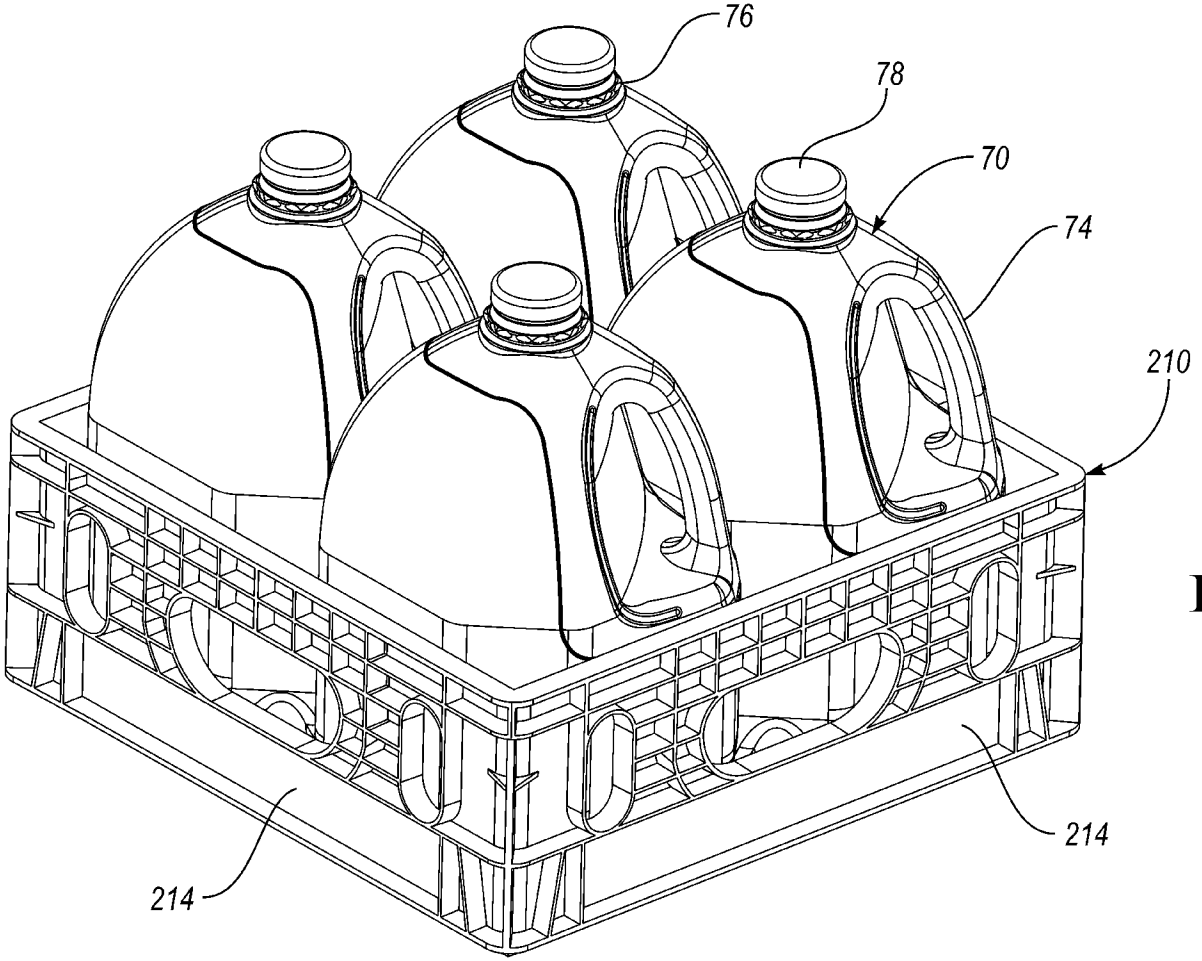
FIG. 36 is a perspective view of the crate of FIG. 27 with the plurality of first jugs stacked thereon.
Figure 38:
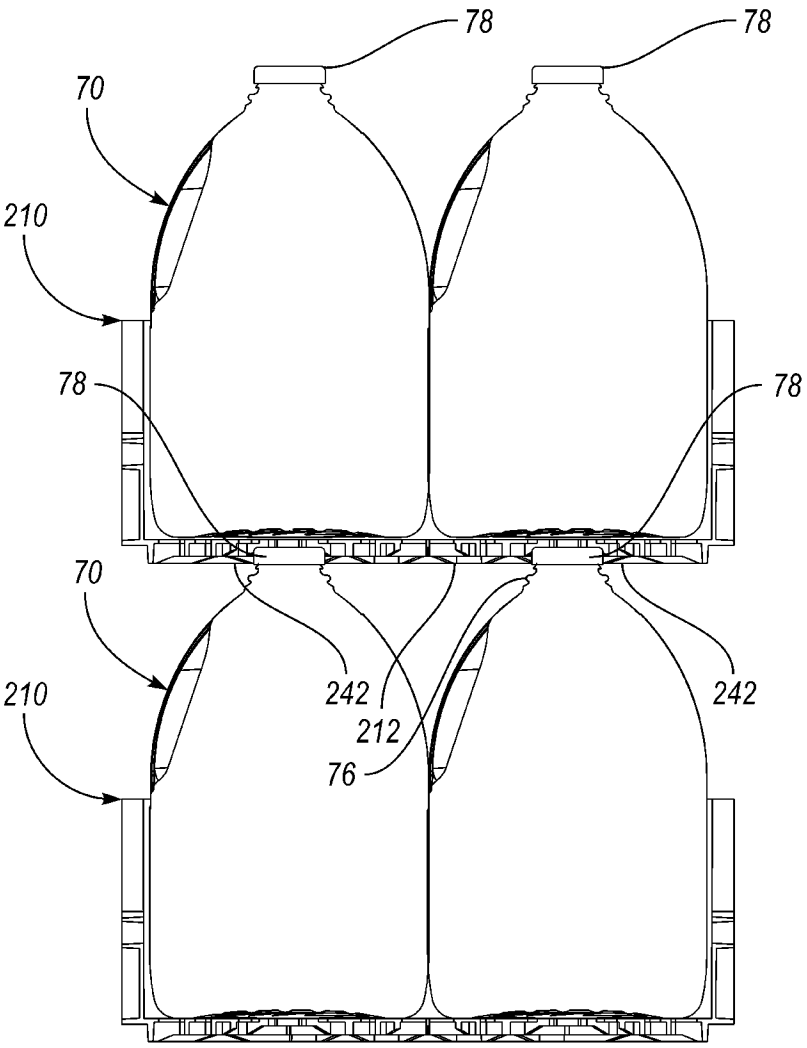
FIG. 38 is a sectional view of the crate of FIG. 27 with the plurality of first jugs stacked thereon stacked on a similar crate with another plurality of first jugs stacked thereon.
Figure 37:
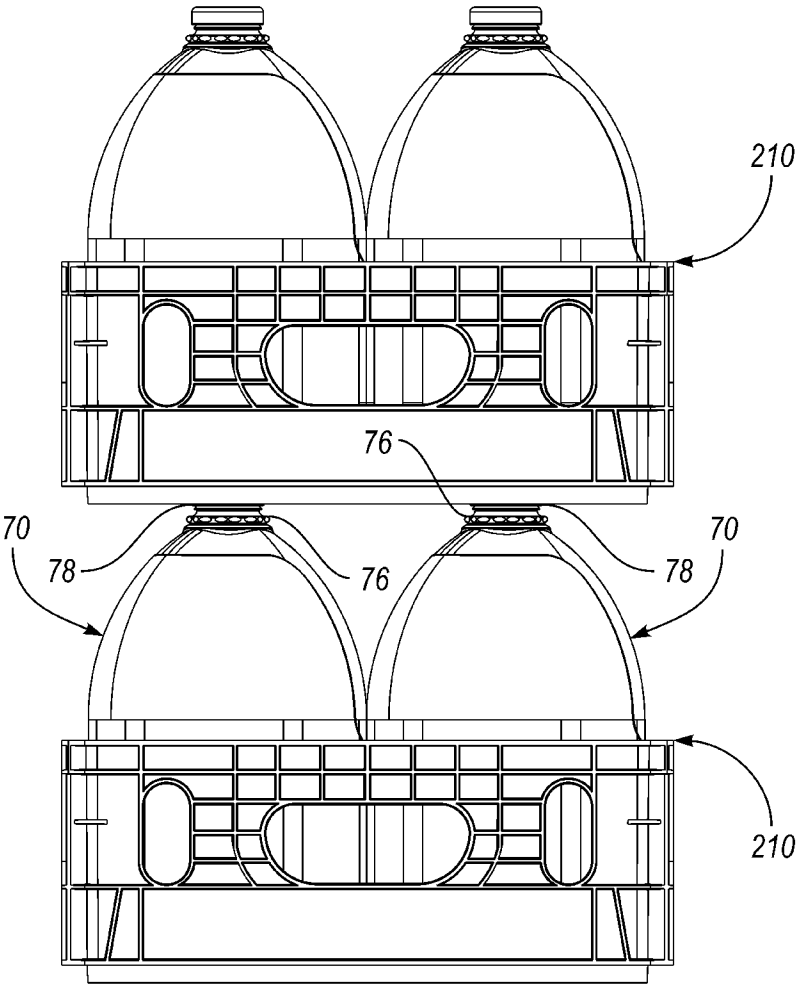
FIG. 37 is an end view of the crate of FIG. 27 with the plurality of first jugs stacked thereon stacked on a similar crate with another plurality of first jugs stacked thereon.
Figure 39:
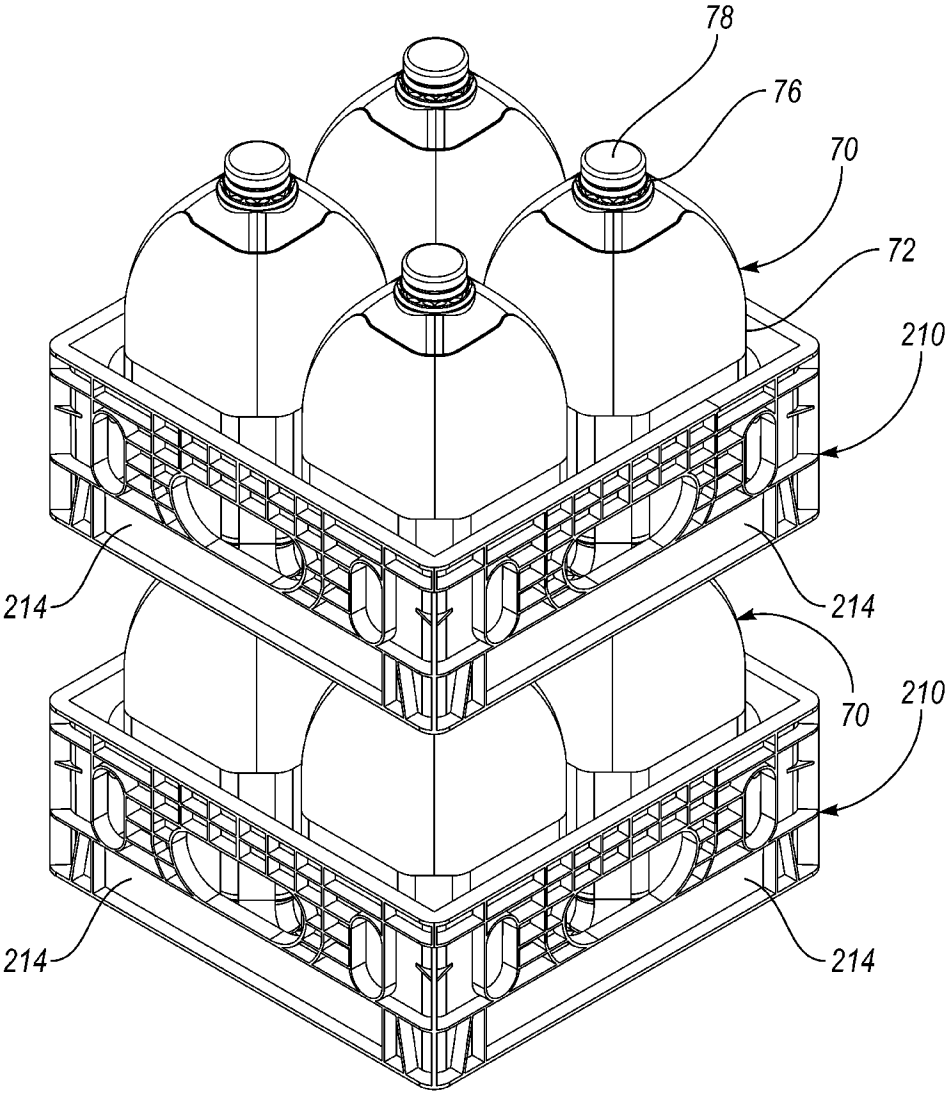
FIG. 39 is a top perspective view of the crate of FIG. 27 with the plurality of first jugs stacked thereon stacked on a similar crate with another plurality of first jugs stacked thereon.
Figure 40:
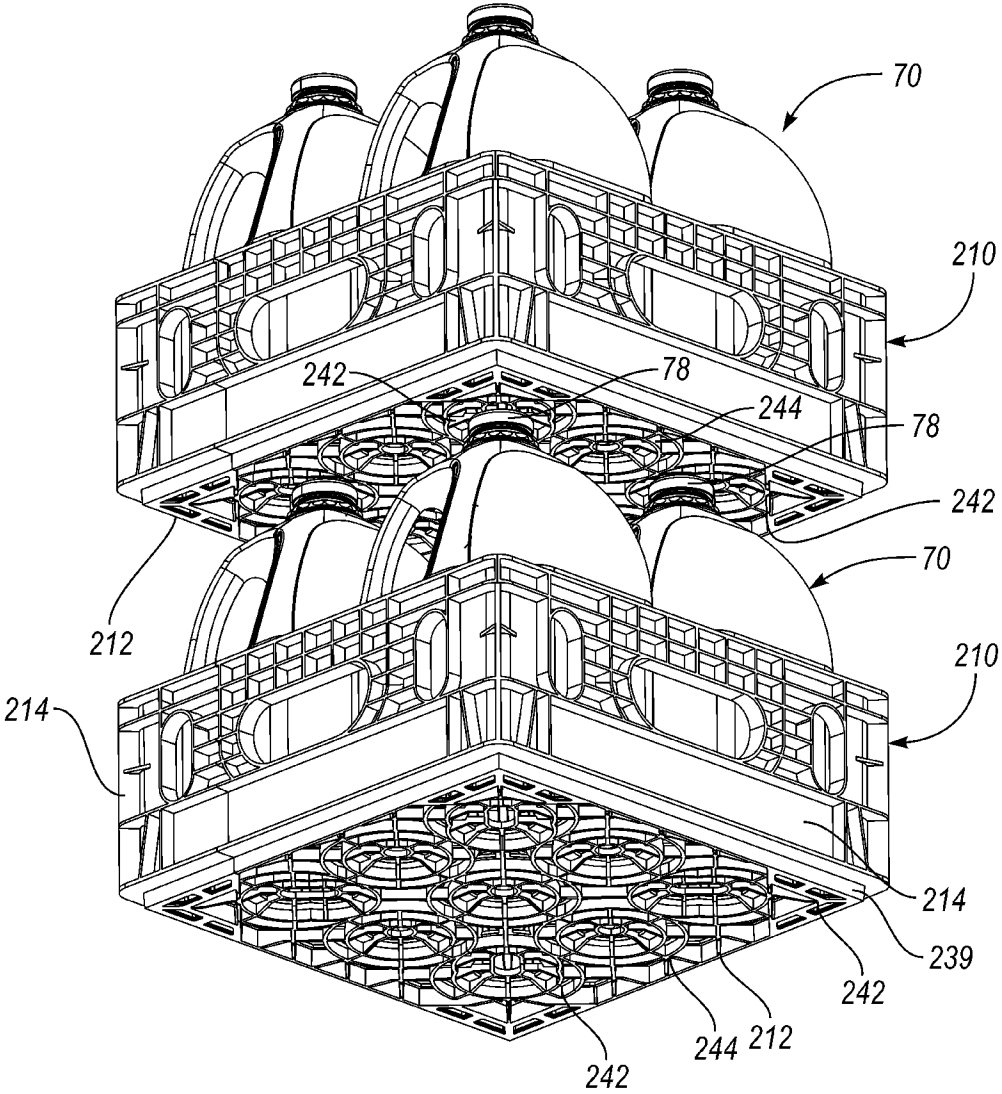
FIG. 40 is a bottom perspective view of the crate of FIG. 27 with the plurality of first jugs stacked thereon stacked on a similar crate with another plurality of first jugs stacked thereon.

FIGS. 35 and 36 show the crate 210 loaded with larger (e.g. gallon) jugs 70. Again, the handle portions 74 are completely accessible over the side walls 214 of the crate 210 for easy removal by a purchaser.

As shown in FIGS. 37-40, the caps 78 of jugs 70 in a lower crate 210 are received in corner recesses 242 of the base 212 of the upper crate 210 to stabilize the stack.

Figure 41:
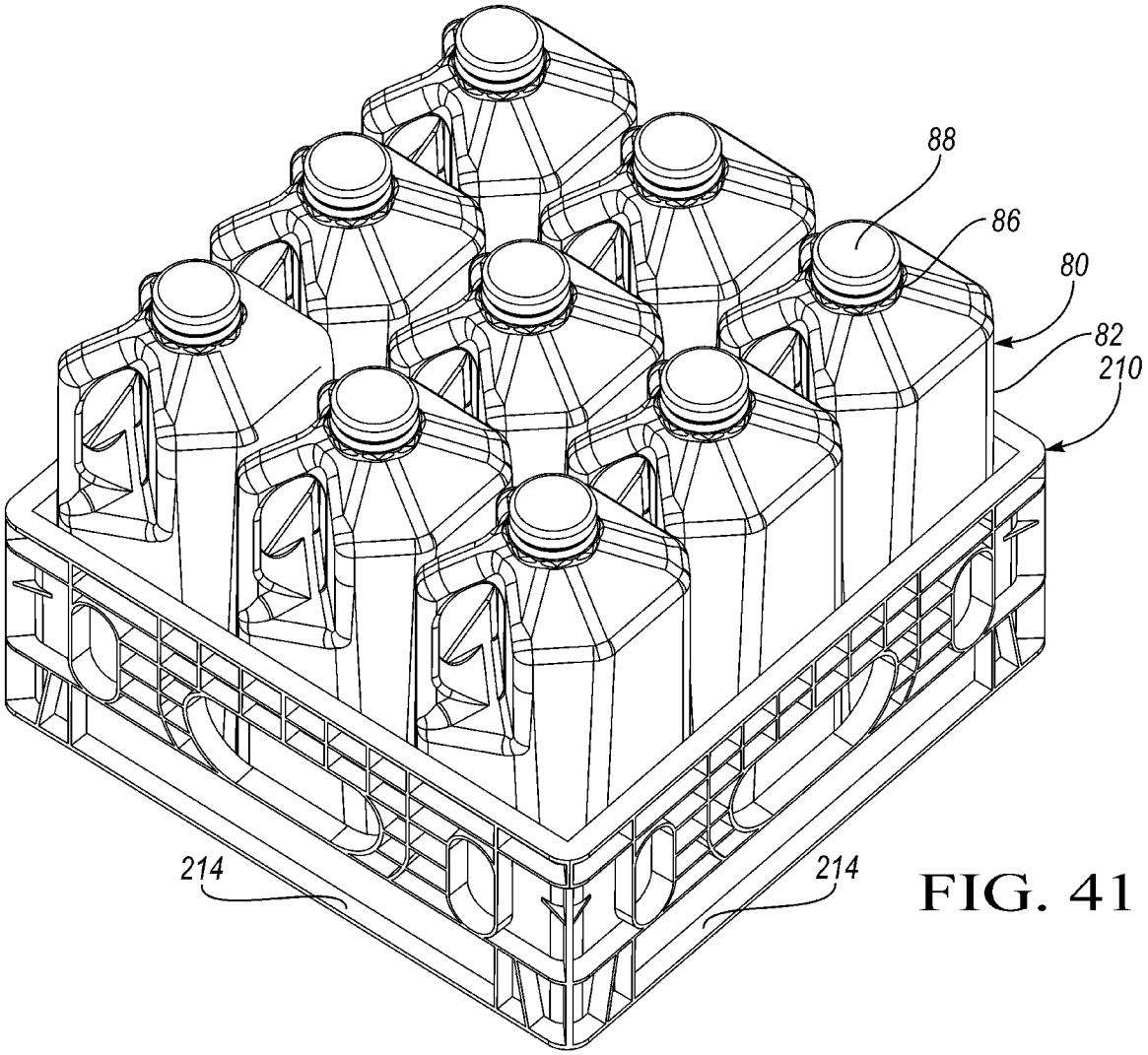
FIG. 41 is a perspective view of the crate of FIG. 27 with a plurality of second jugs stacked thereon.
Figure 43:
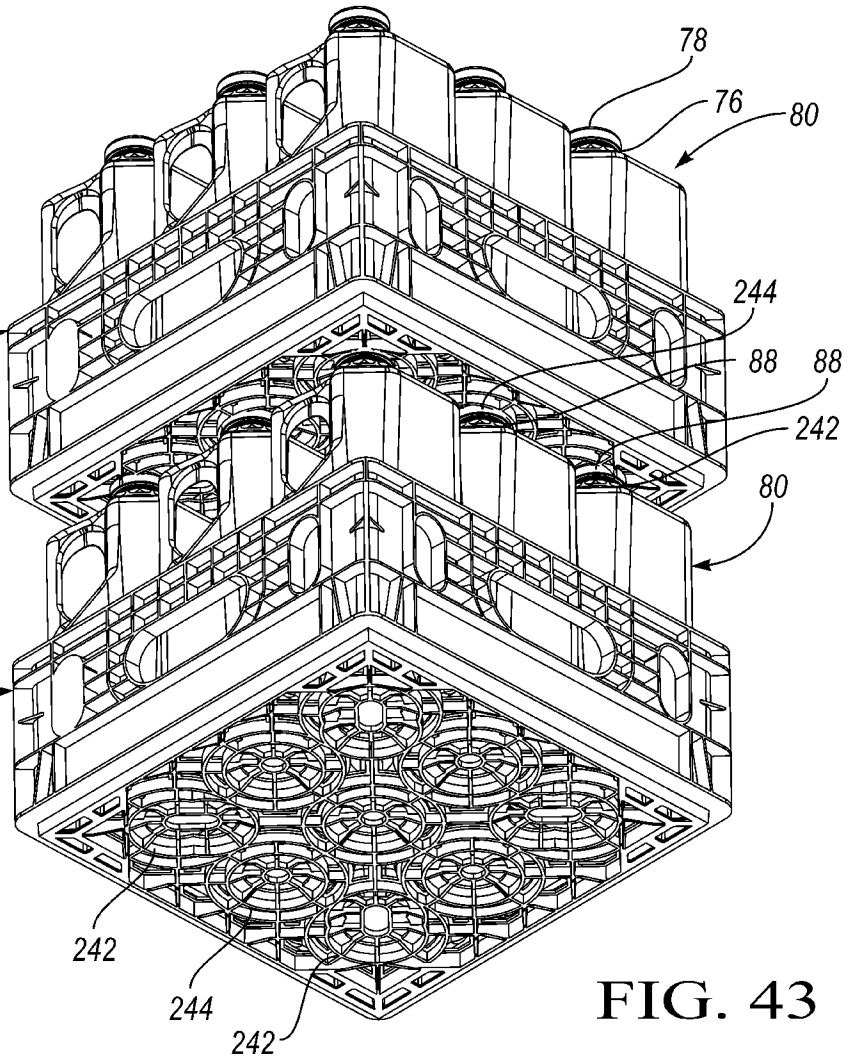
FIG. 43 is a bottom perspective view of the crate of FIG. 27 with the plurality of second jugs stacked thereon stacked on a similar crate with another plurality of second jugs stacked thereon.
Figure 42:
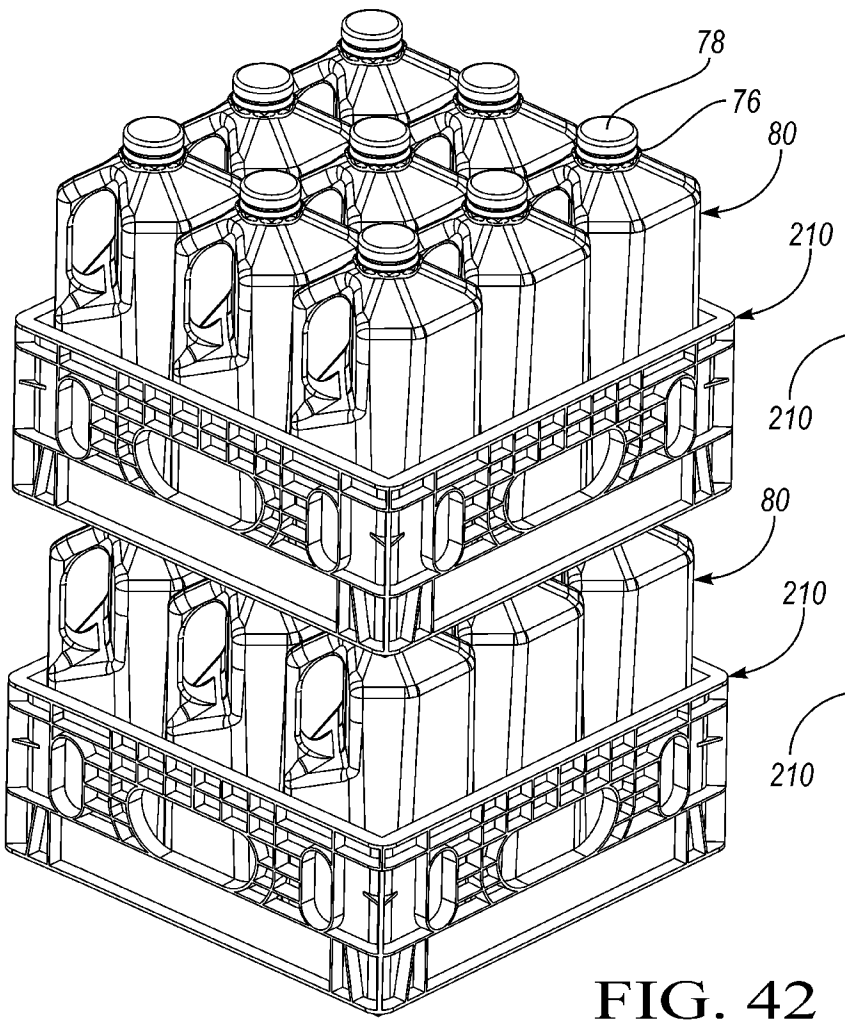
FIG. 42 is a top perspective view of the crate of FIG. 27 with the plurality of second jugs stacked thereon stacked on a similar crate with another plurality of second jugs stacked thereon.

In FIG. 41, a plurality of the smaller jugs 80 are received in the crate 210. As shown in FIGS. 42 and 43, when loaded and stacked, the caps 88 of the jugs 80 in the lower crate 210 are received in the cap receiving recesses 242, 244 of the base 212 of the upper crate 210.

Figure 45:
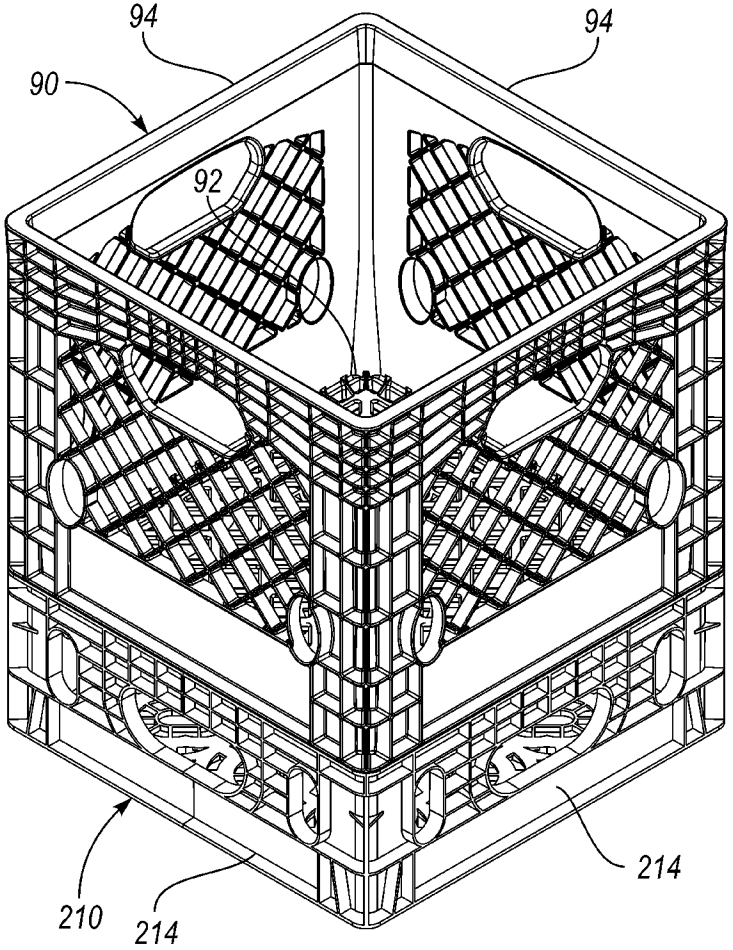
FIG. 45 is a perspective view of the full height milk crate stacked on the crate of FIG. 27.
Figure 44:
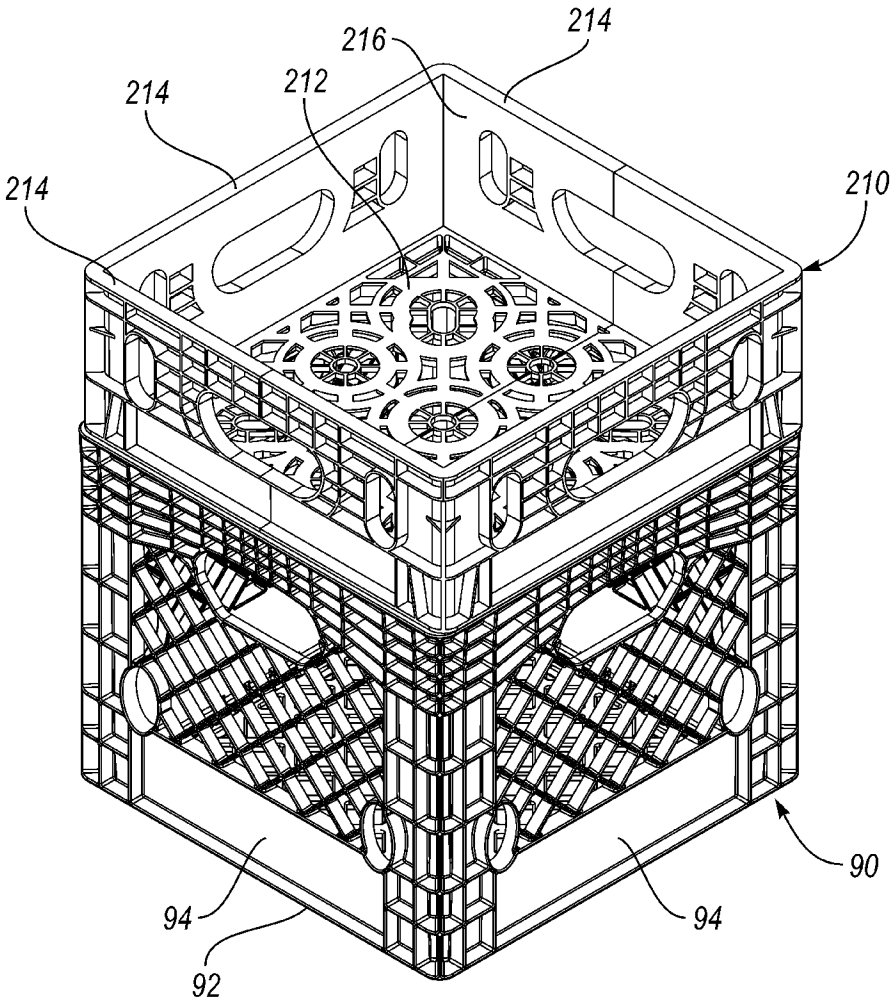
FIG. 44 is a perspective view of the crate of FIG. 27 stacked on a full height milk crate.
Figure 46:
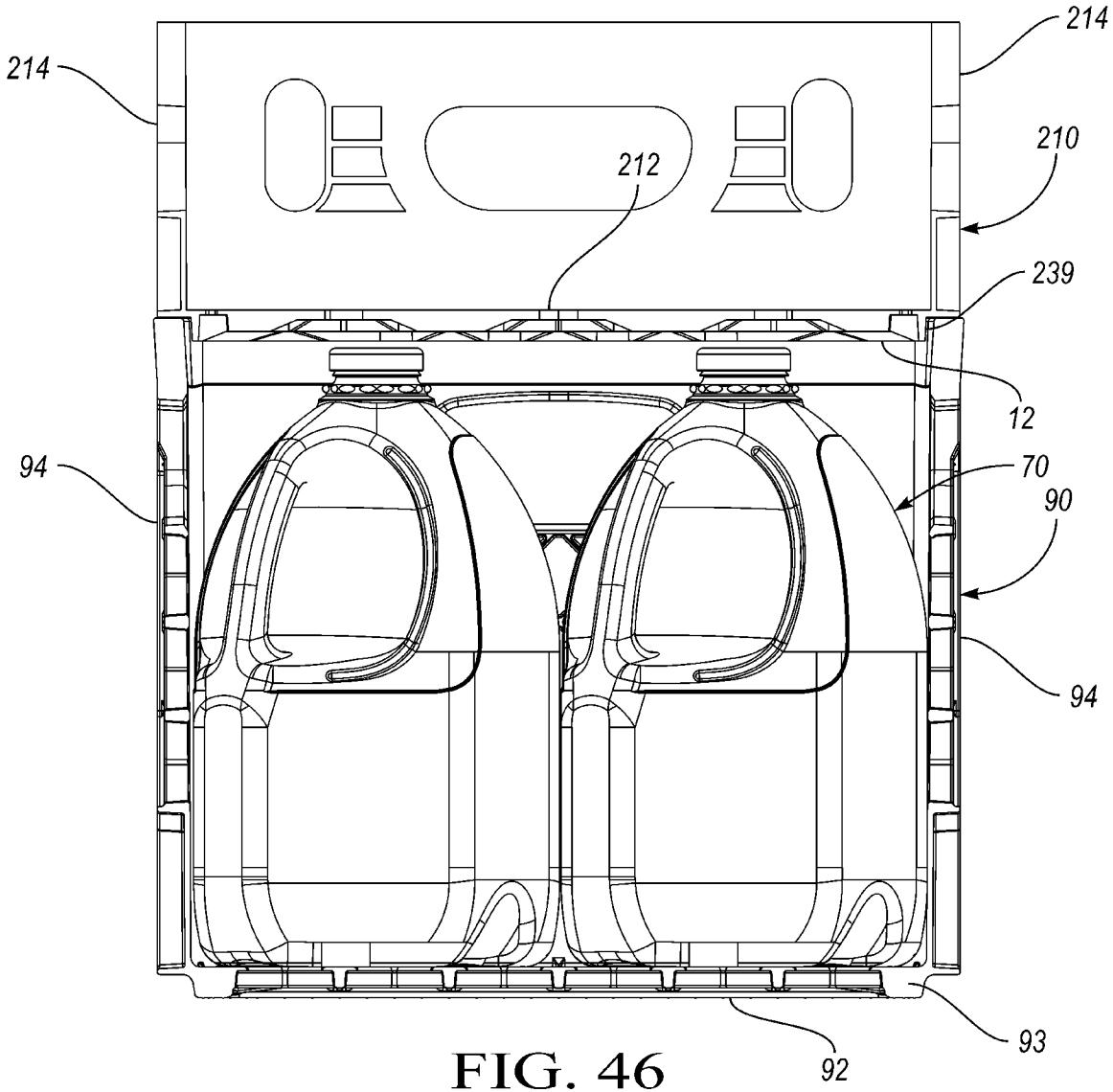
FIG. 46 is cross-sectional view of the crate of FIG. 27 stacked on the full height milk crate.

FIGS. 44-46 show some compatibility of the crate 210 with the prior art crate 90. The crate 210 can be stacked on the prior art full-depth crate 90 with the drag rail 239 received within the side walls 94 of the full-depth crate 90 without contacting the jugs 80 therein (FIG. 46). As shown in FIG. 45, the full-depth crate 90 can be stacked on the crate 210 with the drag rail 93 received between the side walls 214 of the lower crate 210.

Figure 47:
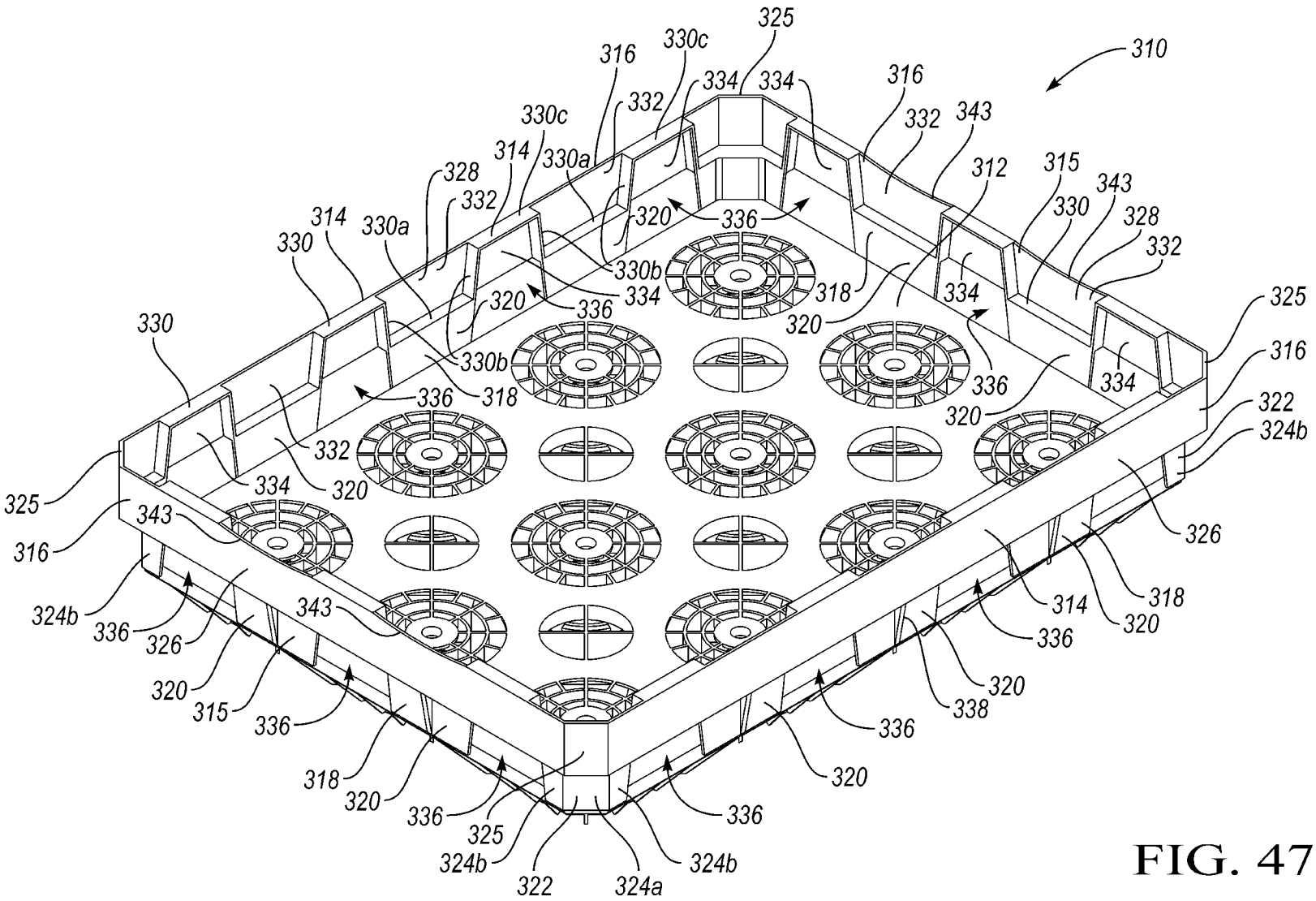
FIG. 47 is a perspective view of a further example crate.

FIG. 47 shows another example crate 310. The crate 310 includes a base 312 with side walls 314 and end walls 315 extending upward from a periphery of the base 312. Each of the side walls 314 and the end walls 315 include an upper wall portion 316 and a lower wall portion 318.

The lower wall portion 318 includes a plurality of single wall columns 320, a plurality of corner columns 322, and a plurality of windows 336. The single wall columns 320 and the corner columns 322 extend from the base 312 to the upper wall portion 316. Each of the single wall columns 320 extend in a single plane and each of the corner columns 322 include a pair of perpendicular portions 324*b* connected by an angled corner portion 324*a*.

Each of the single wall columns 320 include a rib 338 located on an outer surface in a mid-portion of the single wall column 320. The rib 338 extends vertically and includes a taper from the upper wall portion 316 decreasing towards a base of the single wall column 320 adjacent the base 312 of the crate 310.

The upper wall portion 316 (or upper band) is a single thickness wall and includes a generally continuous outer surface 326 and a generally continuous inner surface 328 with angled corner portions 325 that match the angle of the angled corner portions 324*a* of the lower wall portion 318. The inner surface 328 is spaced outward from the single wall columns 320 and the corner columns 322 by a ledge 330.

The ledge 330 includes horizontal lower portions 330*a*, angled intermediate portions 330*b*, and horizontal upper portions 330*c* that each extend generally perpendicular to the upper wall portion 316. The lower portions 330*a* extend along a lower edge of the upper wall portion 316 and the upper portions 330*c* extend along an upper edge of the upper wall portion 316. The angled intermediate portions 330*b* connect adjacent lower portions 330*a* and upper portions 330*c*. The angled intermediate portions 330*b* extend upward from the lower portions 330*a* at an obtuse angle relative to the lower portions 330*a* and generally follow a profile of an edge of the single wall columns 320. The ledge 330 defines a plurality of upwardly opening recesses 332 and a plurality of downwardly opening recesses 334 with the upper wall portion 316.

The end walls 315 also include a scallop 343 along an upper edge of the upper wall portion 316. The scallops 343 form a recess along the upper edge of the upper wall portion 316 to create an opening below an upper wall portion 316 on an identical crate 310 stacked on top of the crate 310. The opening between the upper wall portions 316 formed by the scallop 343 allows a user to separate the nested crates 310 more easily.

Figure 48:
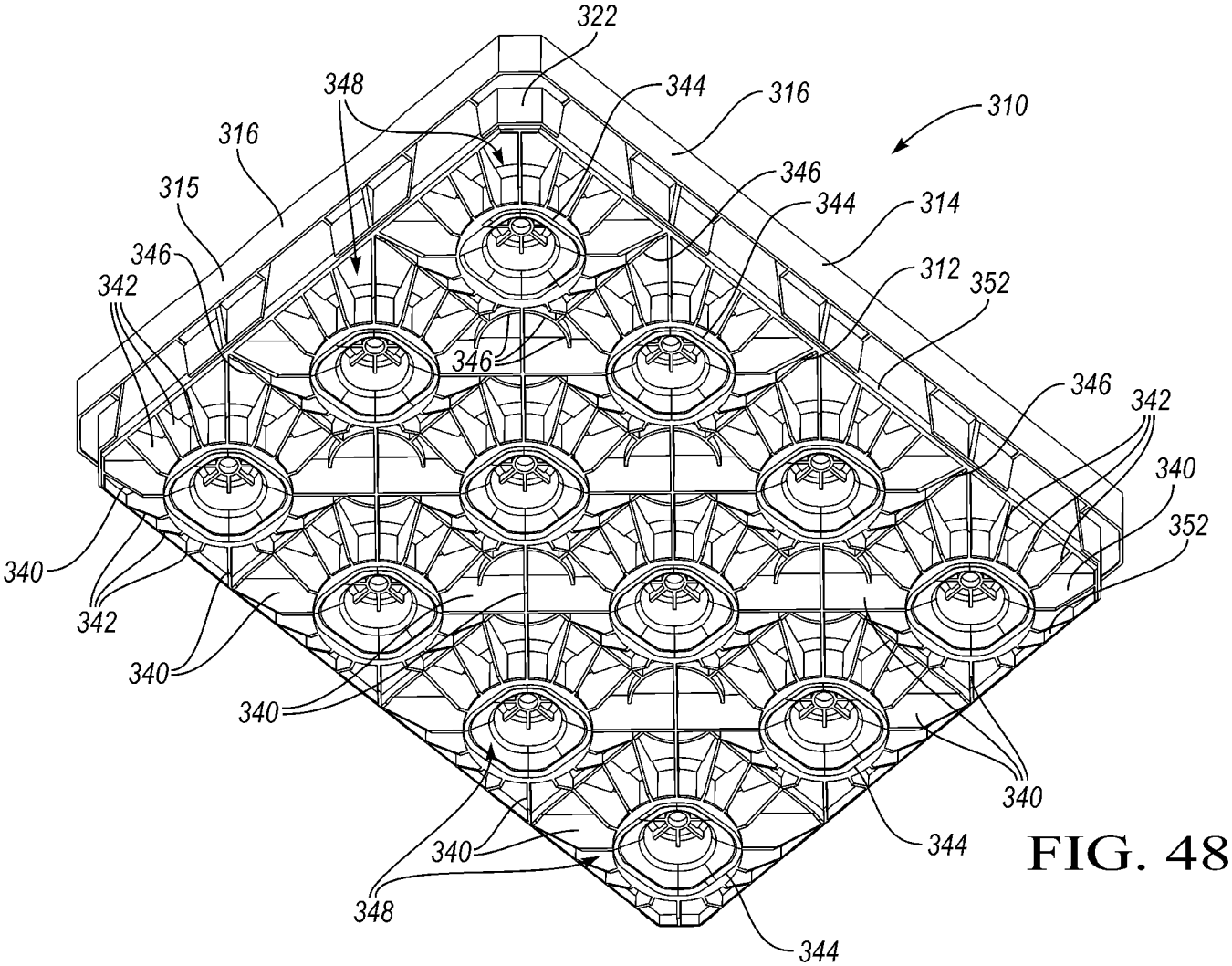
FIG. 48 is a bottom perspective view of the crate of FIG. 47.

FIG. 48 is a bottom perspective view of the crate 310. A plurality of vertical ribs 340 and a plurality of circumferentially spaced ribs 342 extending across an under side of the base 312. The vertical ribs 340 extend transverse to the side walls 314 and the end walls 315. In the illustrated example, the circumferentially spaced ribs 342 are arranged in sets of three. The sets of circumferentially spaced ribs 342 are separated from an adjacent set by one of the vertical ribs 340. The vertical ribs 340 and the circumferentially spaced ribs 342 each intersect one of a plurality of bottle support recesses 344.

A bisecting rib 346 separates the base 312 into rectangular sectors 348 with each rectangular sector 348 including one of the plurality of bottle support recess 344. Each of the rectangular sections 348 include at least one rounded corner. The bisecting ribs 346 extend downward from an upper surface 350 (FIG. 49) of the base 312 at approximately the same distance as an upper perimeter band 352 (FIG. 49) of the base 312. The circumferentially spaced ribs 342 taper from a lower surface 354 of the base 312 to the upper perimeter band 352 and the bisecting ribs 346. The vertical ribs 340 extend along the lower surface 354 of the base 312 along an interior portion and taper towards the upper perimeter band 352 along an outer perimeter of the base 312.

In the illustrated example, there are twelve bottle support recesses 344 in the base 312 of the crate 310. However, other quantities of bottle support recesses 344 could be located in the base, such as four, six, eight, or nine bottle support recesses 344. As shown in FIG. 48, the twelve bottle support recesses 344 can capture 12 equally spaced caps 78 and shoulder portions 75 (FIG. 63) on the jugs 70.

Figure 49:
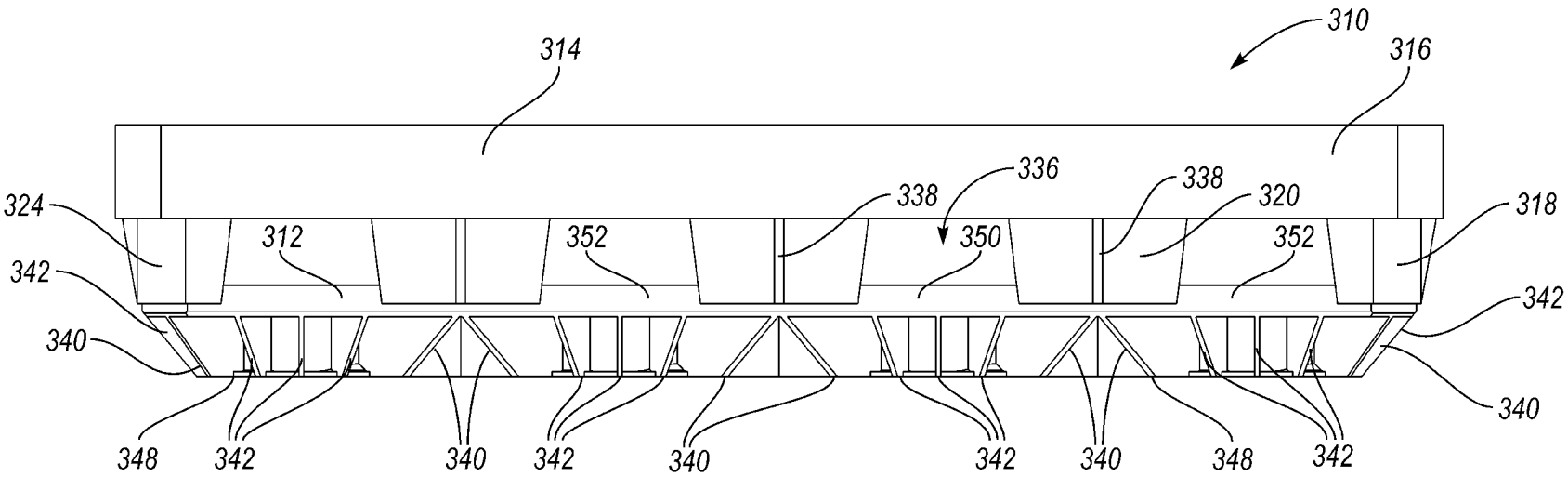
FIG. 49 is a side view of the crate of FIG. 47.
Figure 50:
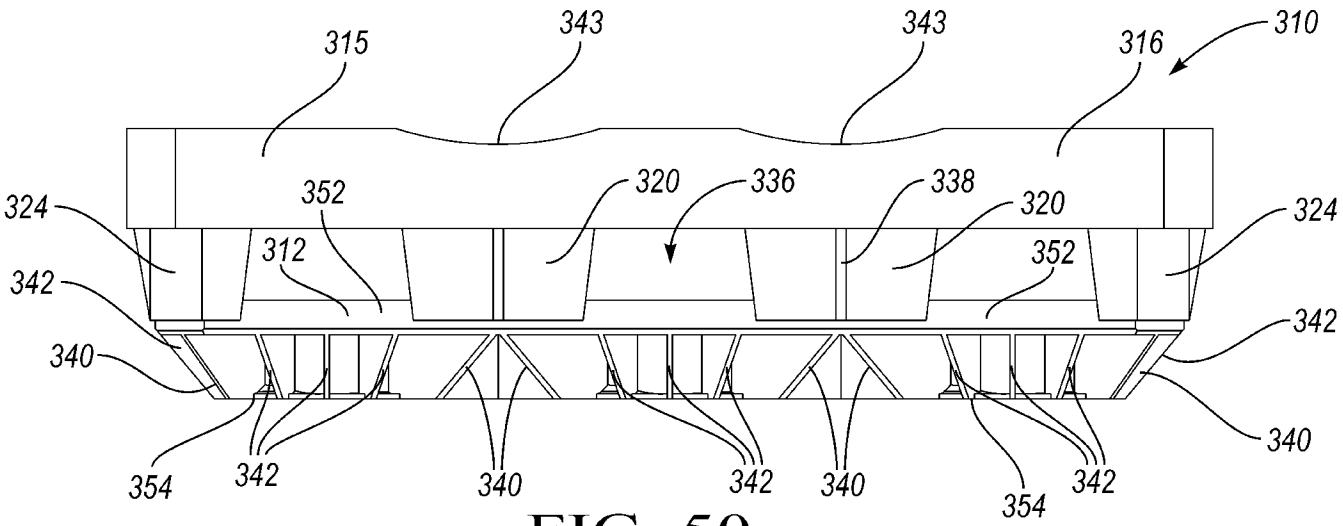
FIG. 50 is an end view of the crate of FIG. 47.

FIG. 49 shows a side view of the crate 310 and FIG. 50 shows an end view of the crate 310.

Figure 52:
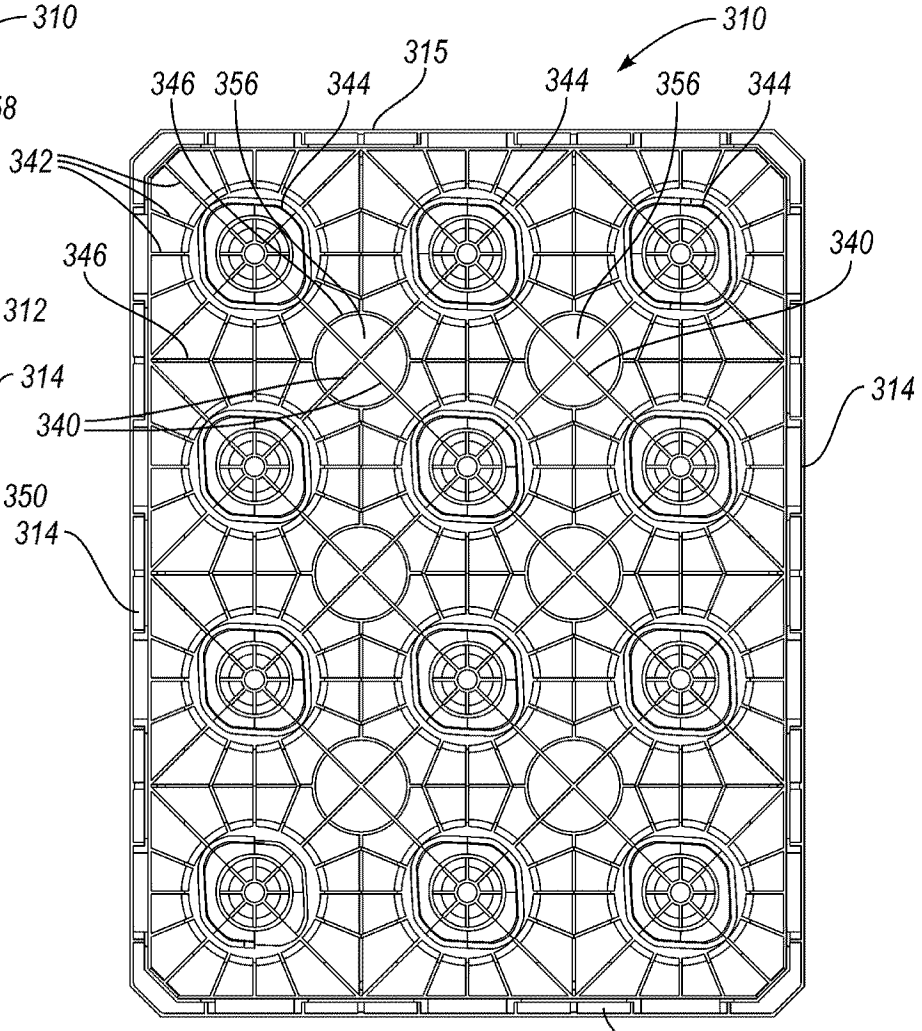
FIG. 52 is a bottom view of the crate of FIG. 47.
Figure 51:
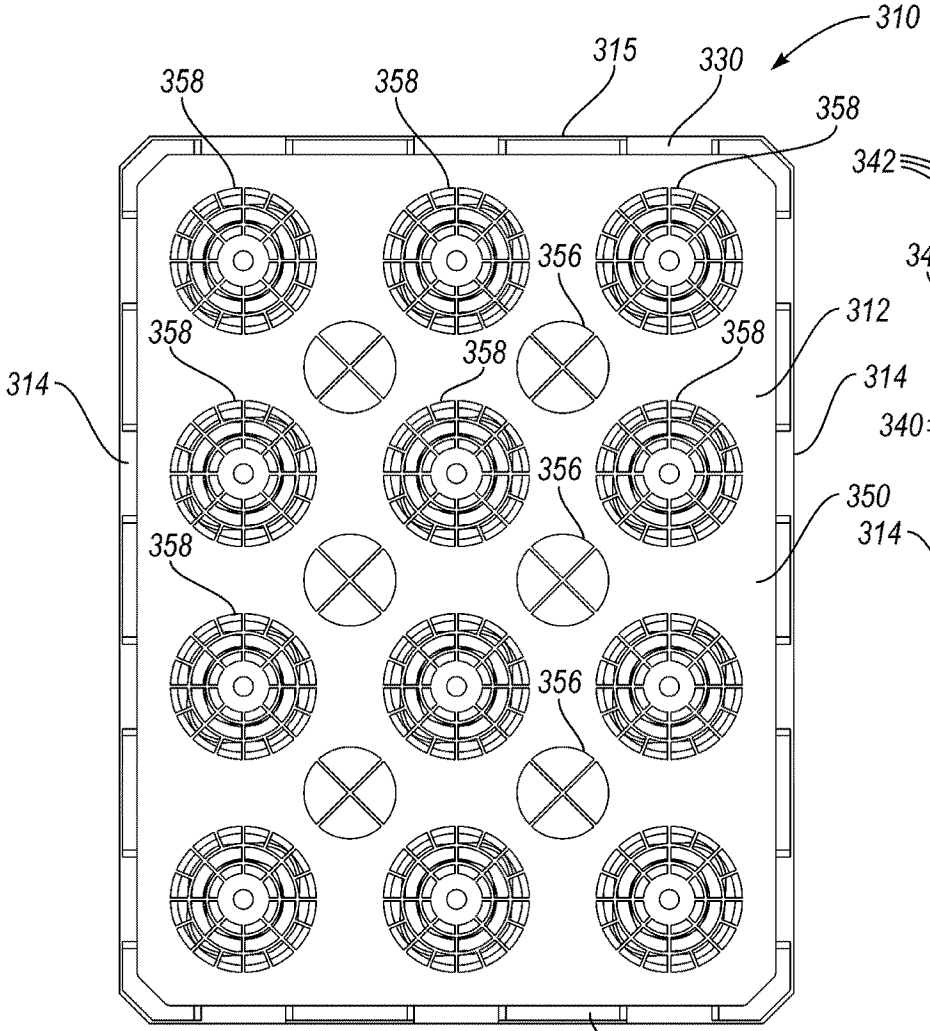
FIG. 51 is a top view of the crate of FIG. 47.

As shown in FIGS. 51 and 52, the crate 310 includes a plurality of circular openings 356 that extend through the upper surface 350 of the base 312. The plurality of circular openings 356 are equally spaced between a plurality of bottle support openings 358 in the upper surface 350 of the base 312. The bottle support openings 358 correspond to the bottle support recesses 344.

Figure 53:
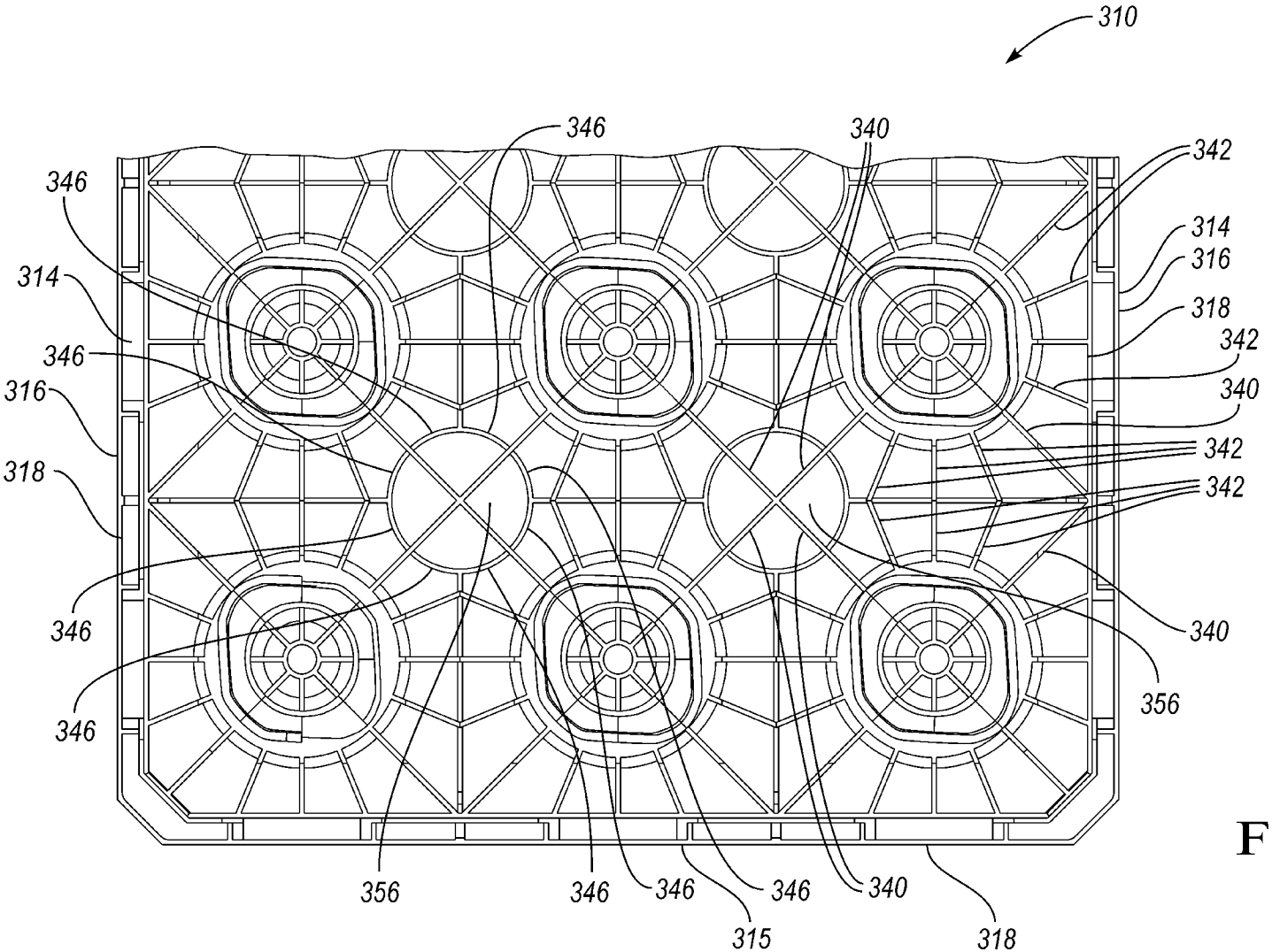
FIG. 53 is an enlarged bottom view of the crate of FIG. 47.

FIG. 53 shows an enlarged bottom view of the crate 310 with the bisecting ribs 346 circumscribing each of the plurality of circular openings 356 and the vertical ribs 340 divide each of the plurality of circular openings 356 in equally sized quadrants.

Figure 54:
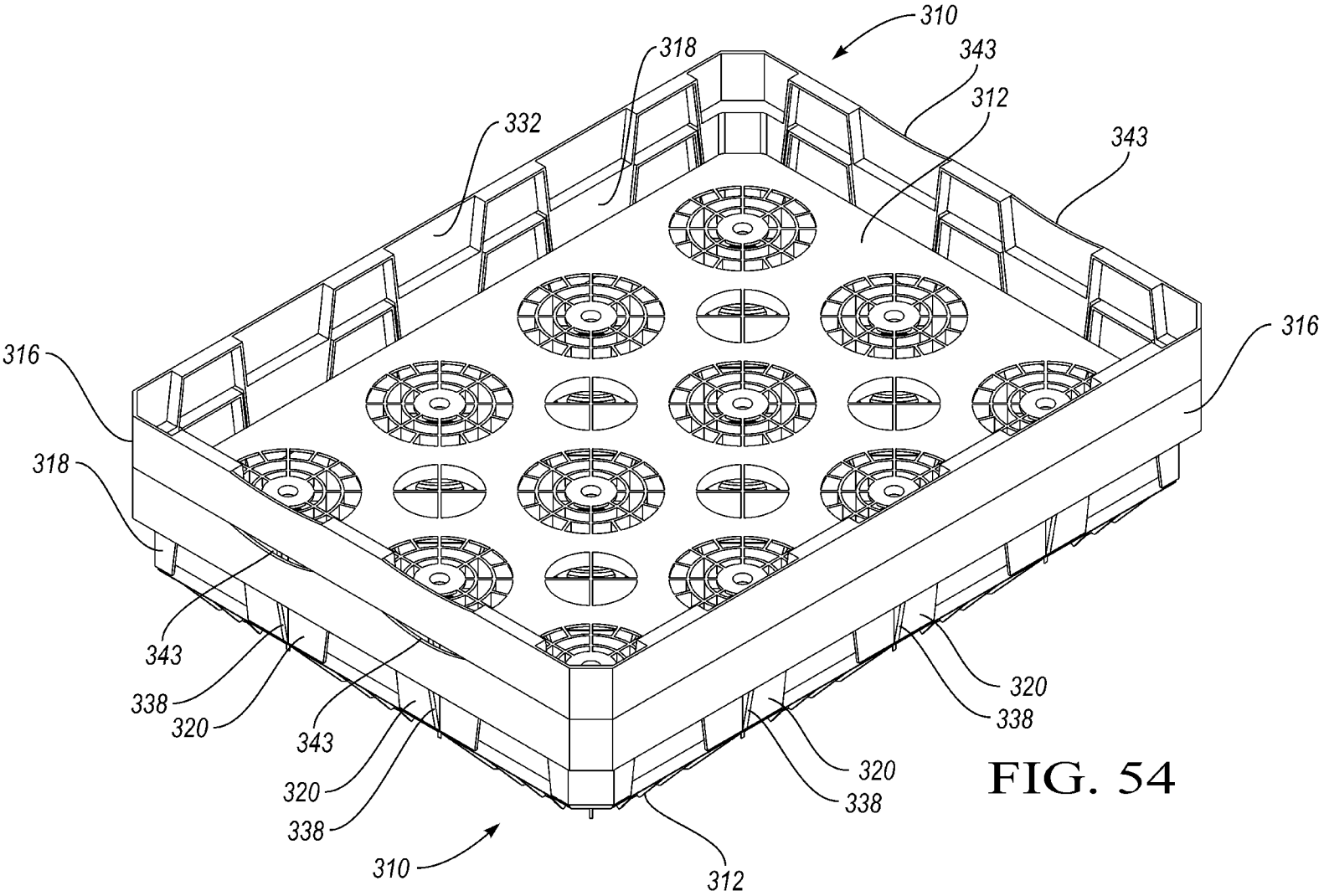
FIG. 54 is a top perspective view of the crate of FIG. 47 stacked on a similar crate.

FIG. 54 shows the crate 310 with an identical crate 310 nested thereon. As shown, the lower wall portion 318 of the upper crate 310 nests within the upper wall portion 316 of the lower crate 310. The upper wall portion 316 of the upper crate 310 abuts the upper wall portion 316 of the lower crate 310. In this way, the crates 310 can occupy less volume for shipping and storage when empty. The single wall columns 320 and the ribs 338 of the upper crate 310 are received in the upwardly opening recesses 332 of the lower crate 310.

Figure 55:
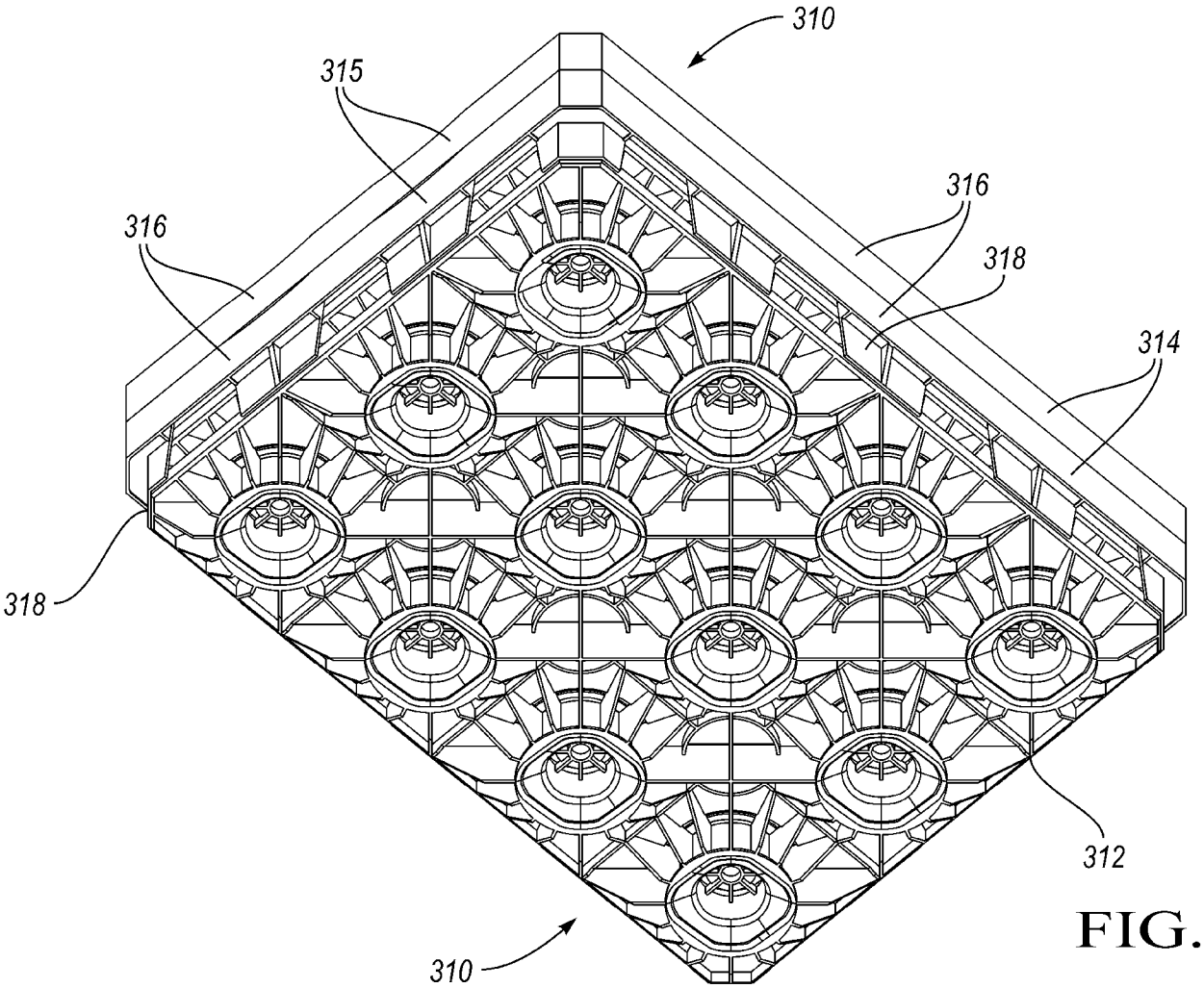
FIG. 55 is a bottom perspective view of the crate of FIG. 47 stacked on a similar crate.

FIG. 55 is a bottom perspective view of the crate 310 stacked on an identical crate 310.

Figure 56:
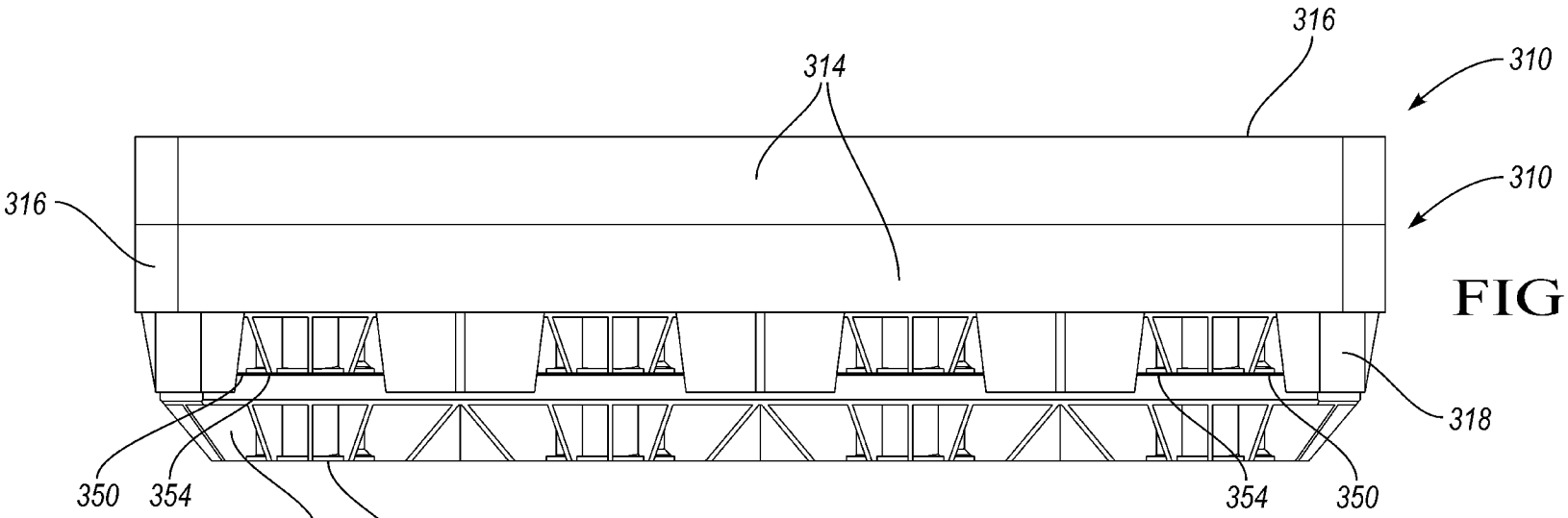
FIG. 56 is a side view of the crate of FIG. 47 stacked on a similar crate.
Figure 57:
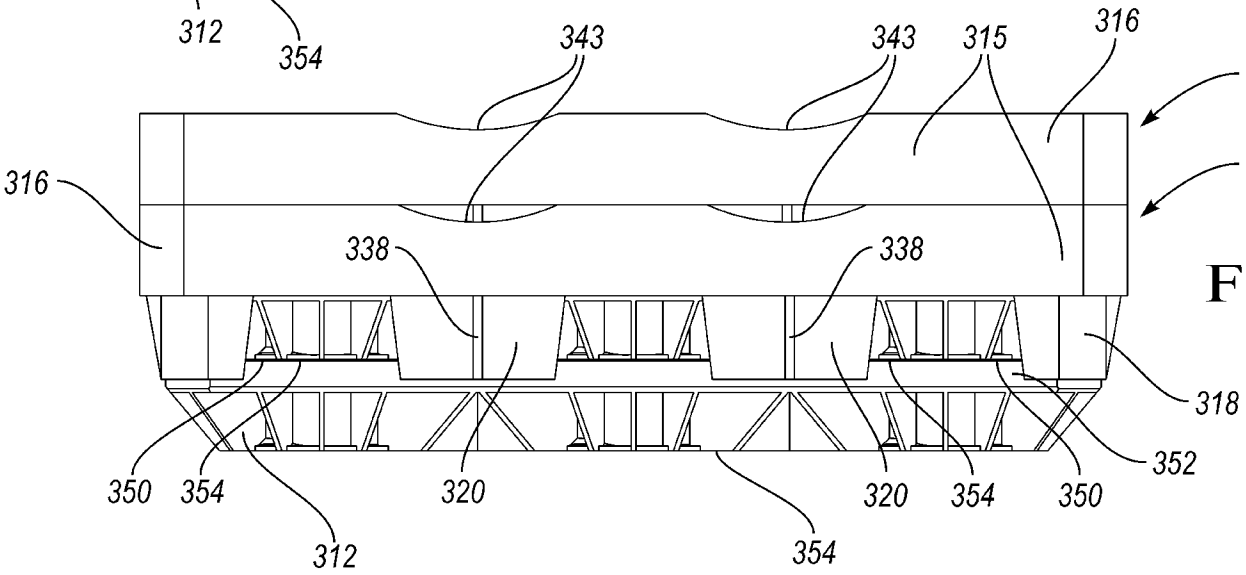
FIG. 57 is an end view of the crate of FIG. 47 stacked on a similar crate.

FIG. 56 is a side view of the crate 310 stacked on an identical crate 310 and FIG. 57 is an end view of the crate 310 stacked on an identical crate 310. As shown in FIGS. 56 and 57, the lower surface 354 of the base 312 of the upper crate 310 is in abutting contact with the upper surface 350 of the base 312 of the lower crate 310.

Figure 58:
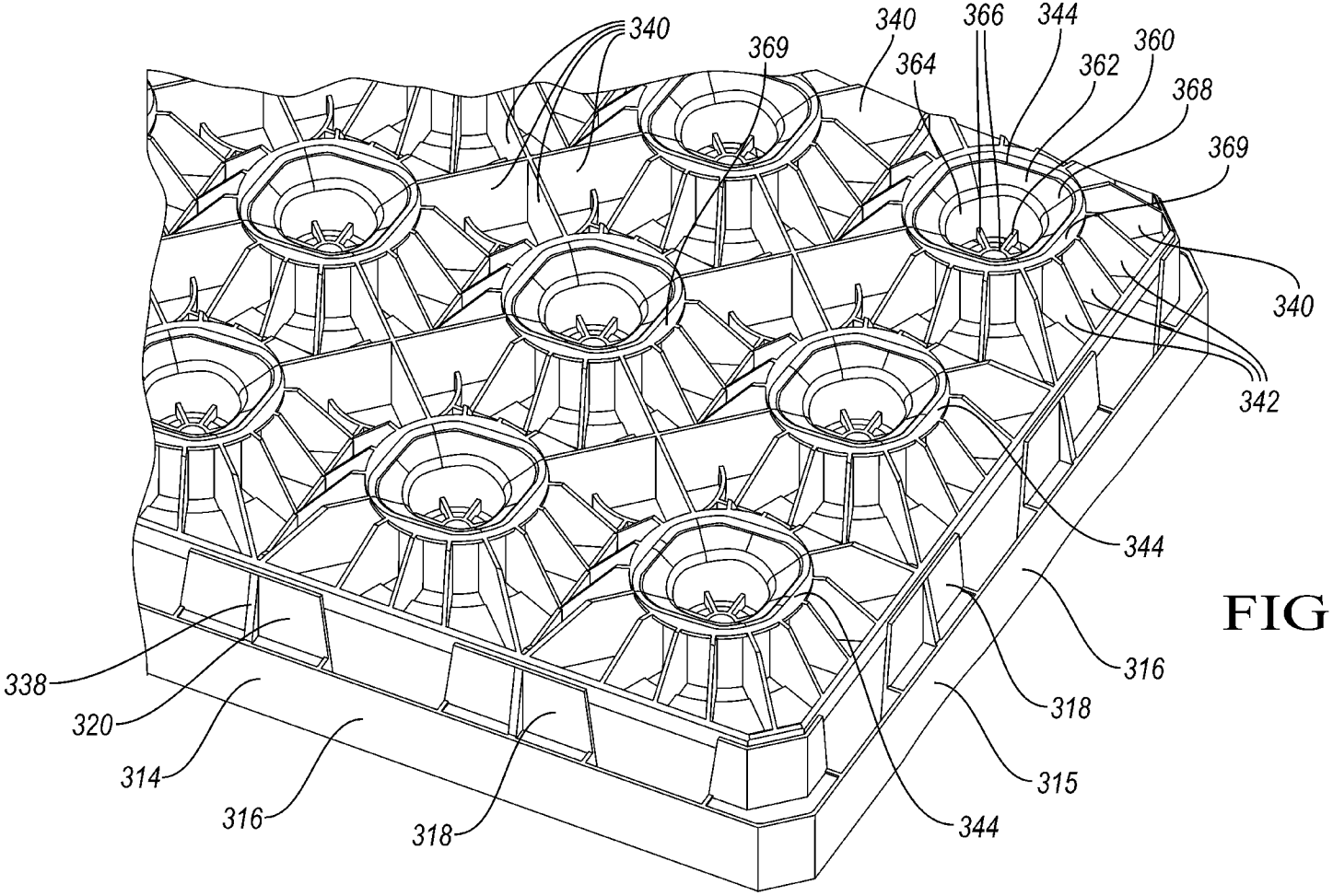
FIG. 58 is an enlarged bottom perspective view of the crate of FIG. 47.
Figure 59:
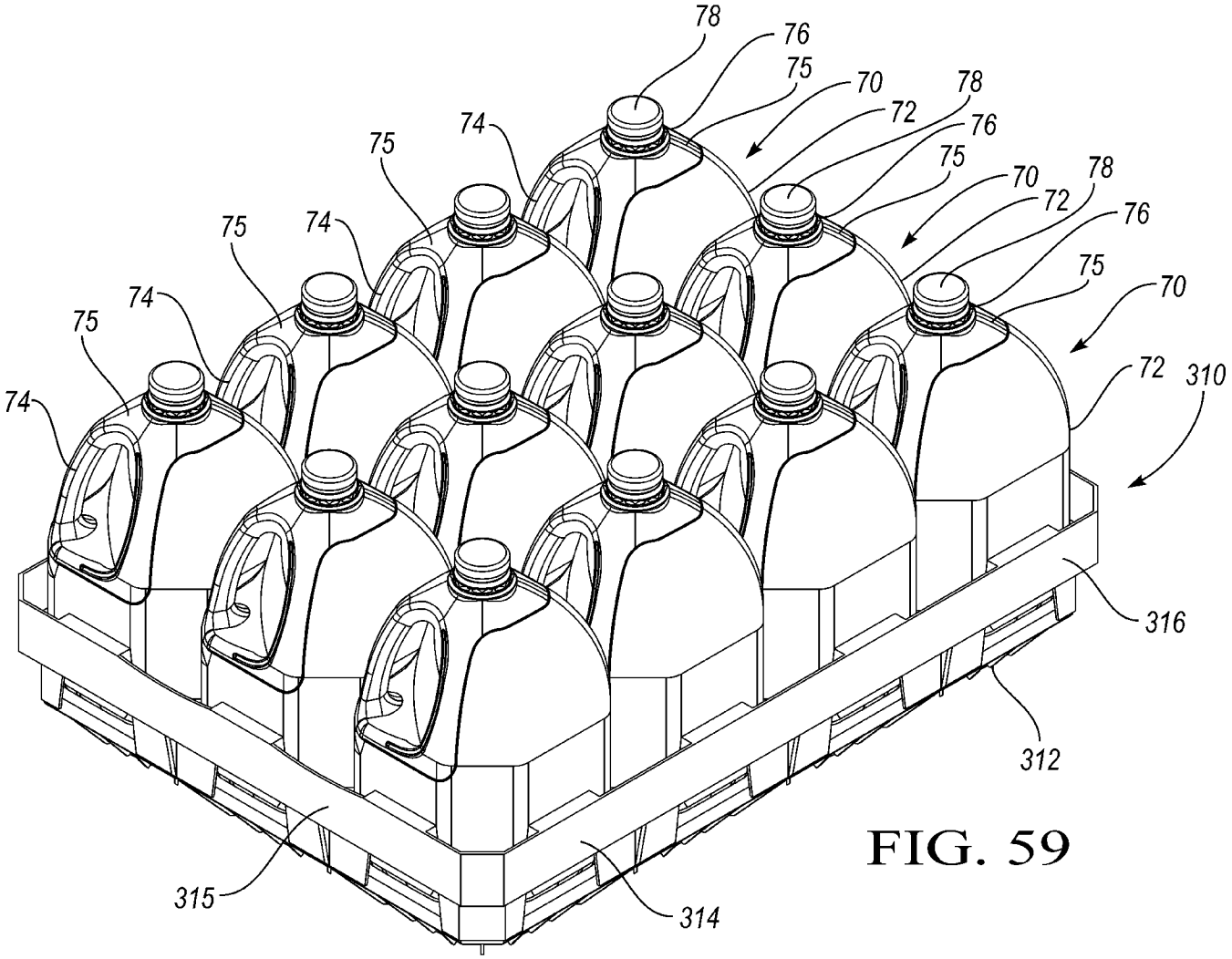
FIG. 59 is a perspective view of the crate of FIG. 47 with a plurality of first jugs.

FIG. 58 shows an enlarged perspective view of the bottom of the crate 310. Each of the plurality of bottle support recesses 344 include a bottle cap support region 360 for supporting the cap 78 of the jug 70 and a bottle shoulder support region 362 for supporting the shoulder portions 75 of the jug 70 (FIG. 59). The bottle cap support region 360 is spaced from the bottle shoulder support region 362 by a generally cylindrical collar portion 364.

The bottle cap support region 360 includes a plurality of bottle cap support ribs 366 that form a starburst shape having a cylindrical inner rib with a plurality of ribs extending off of the cylindrical portion outward to the collar portion 364. Additionally, the plurality of bottle cap support ribs 366 extend downward from the upper surface 350 of the base 312.

The bottle shoulder support region 362 includes a generally conical support surface 368. In the illustrated example, the support surface 368 includes rounded corners that correspond to a shape of the jugs 70. The support surface 368 is separated from the vertical ribs 340 and the circumferentially spaced ribs 342 on a radially outer side by a platform portion 369 and abuts the collar portion 364 on a radially inner side. The platform portion 369 is generally flush with the lower surface 354 of the crate 310 and the radially inner side of the support surface 368 is spaced from the lower surface 354 toward the upper surface 350 of the base 312.

FIG. 59 shows a perspective view of the crate 310 with a plurality (in this case, twelve) of larger (in this case, gallon) plastic jugs 70 (e.g. for milk) received therein. The body portion 72 of the jug 70 is connected to the neck portion 76 by the shoulder portion 75. The body portions 72 of the jugs 70 fit fairly snugly between the side walls 314 and end walls 315 of the crate 310 on the base 312.

Figure 60:
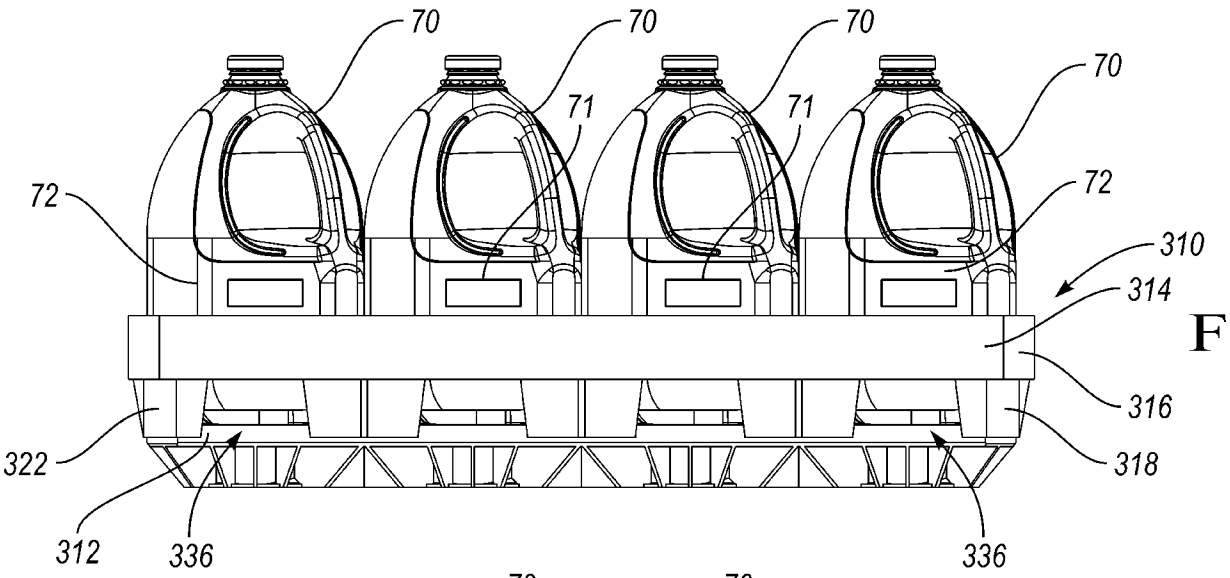
FIG. 60 is a side view of the crate of FIG. 47 with the plurality of first jugs.
Figure 61:
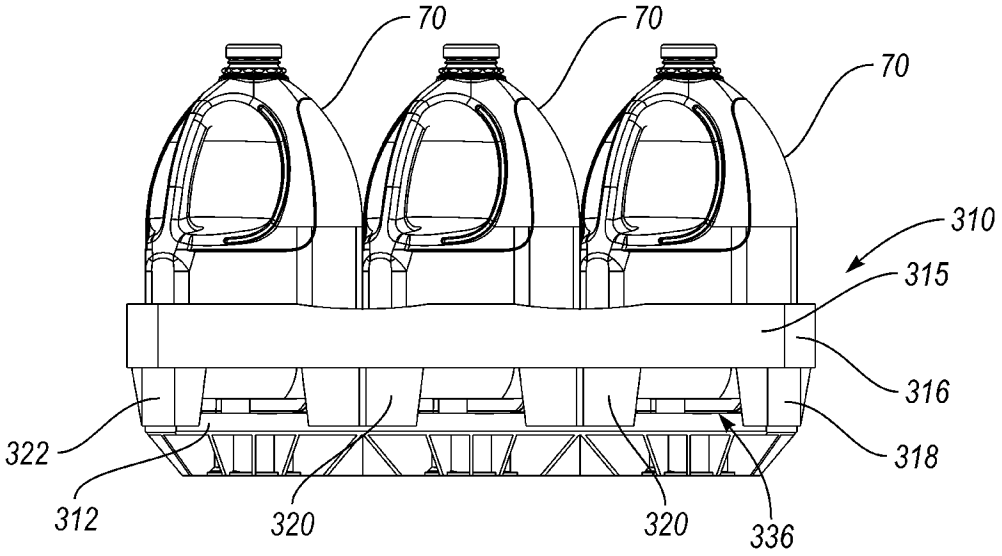
FIG. 61 is an end view of the crate of FIG. 47 with the plurality of first jugs.

FIG. 60 shows a side view of the crate 310 with the plurality of jugs 70. The upper wall portion 316 is positioned so that a label 71 on the body portion 72 of the jugs 70 is visible. FIG. 61 shows an end view of the crate 310 with the plurality of jugs 70. As shown in FIGS. 60 and 61, at least one of the plurality of jugs 70 is visible through one of the windows 336 in the lower wall portion 318.

Figure 62:
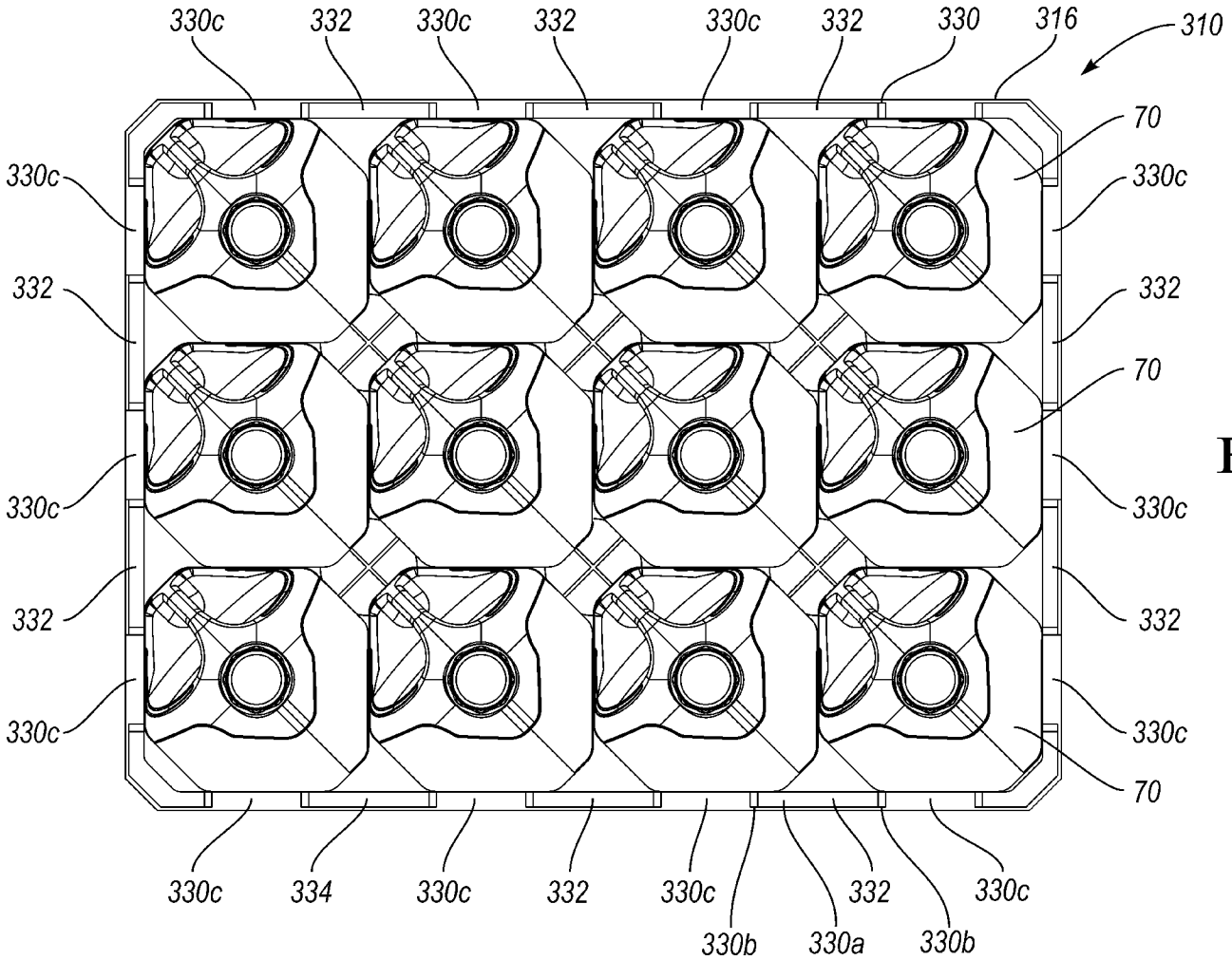
FIG. 62 is a top view of the crate of FIG. 47 with the plurality of first jugs.

FIG. 62 is a top view of the crate 310 with the plurality of jugs 70. The ledge 330 extending along the interior of the upper wall portion 316 on the side walls 314 and end walls 315 contacts the body portion 72 of the plurality of jugs 70 to secure the jugs 70 and prevent relative lateral movement between the individual jugs 70. The upper portions 330*c* of the ledge 330 are generally aligned with a portion of each of the plurality of jugs 70 along the perimeter of the crate 310 and one of the plurality of upwardly openings recesses 332 is located between adjacent jugs 70 along the perimeter of the crate 310.

Figure 63:
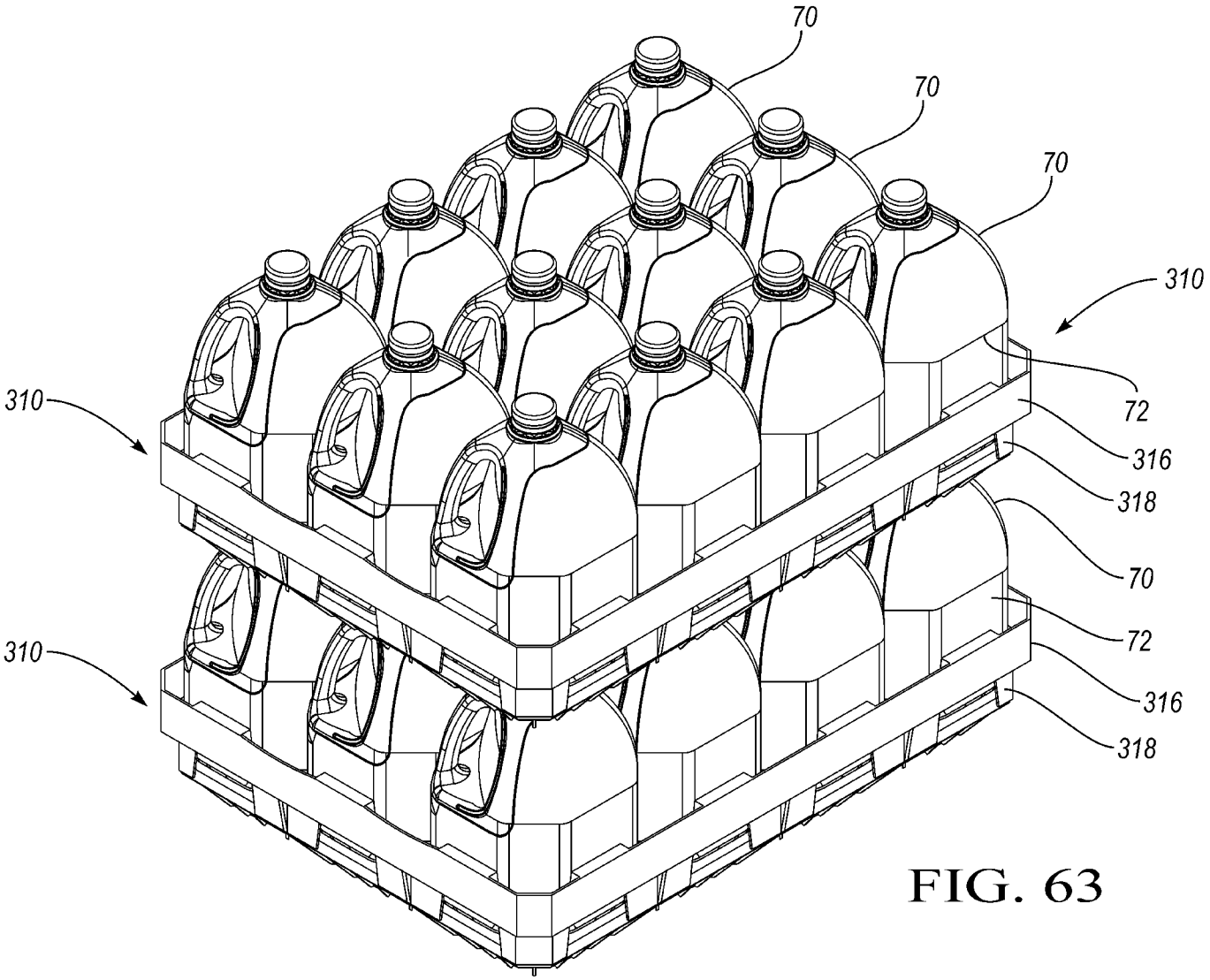
FIG. 63 is a top perspective view of the crate of FIG. 47 with the plurality of first jugs stacked thereon stacked on a similar crate with another plurality of first jugs stacked thereon.
Figure 64:
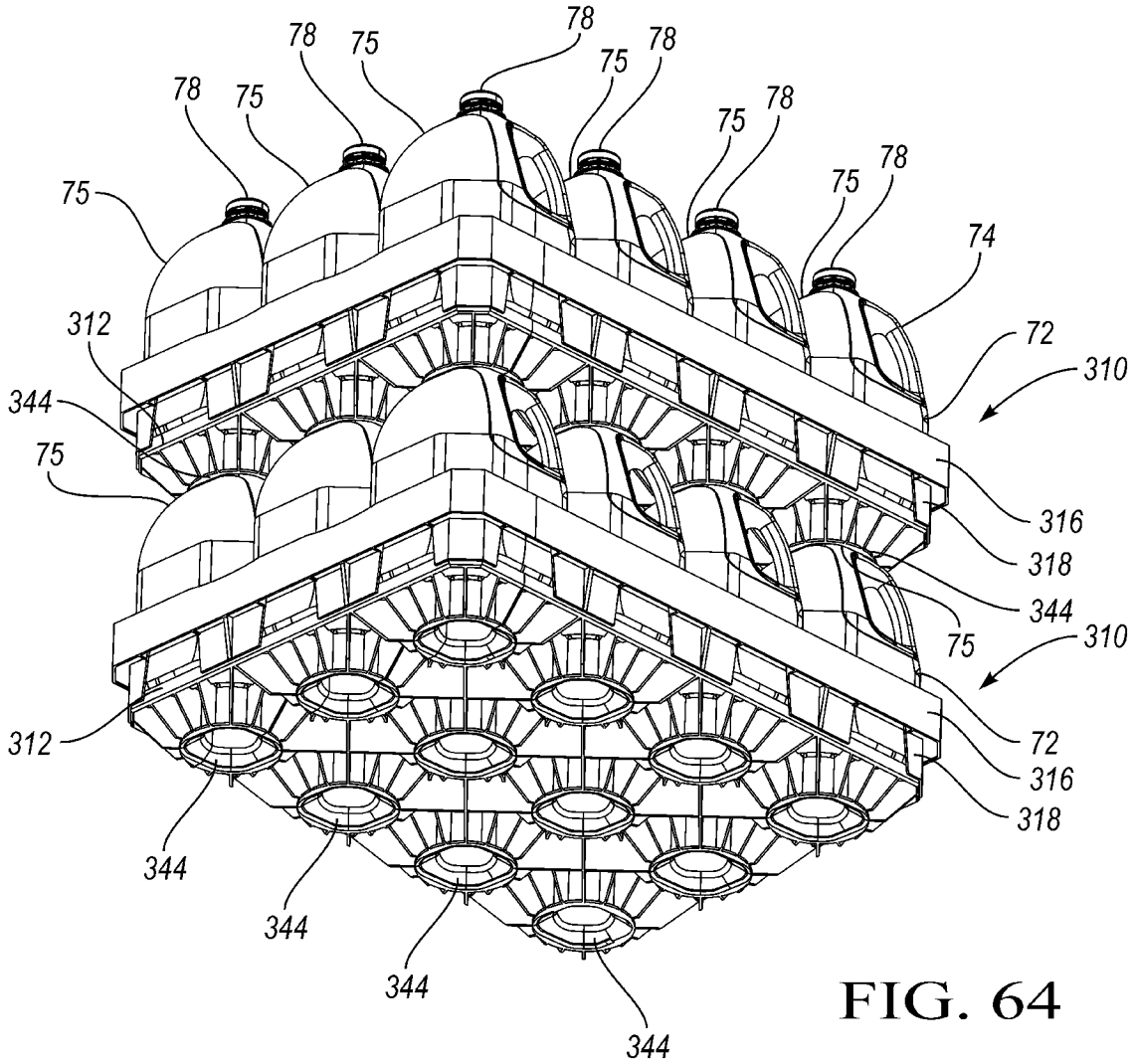
FIG. 64 is a bottom perspective view of the crate of FIG. 47 with the plurality of first jugs stacked thereon stacked on a similar crate with another plurality of first jugs stacked thereon.

FIGS. 63 and 64 show the crate 310 and the jugs 70 with an identical crate 310 with jugs 70 also stacked thereon. The upper crate 310 is stacked directly on the jugs 70 of the lower crate 310. The upper wall portion 316 contacts the jugs 70 along a mid portion of the body portion 72 so the jugs 70 would not tip from the crate 310 during transit or bow outward from the crate 310 beyond the base 312 before an identical crate 310 is placed on the jugs 70. Referring to FIG. 64, the caps 78 and shoulder portions 75 of the jugs 70 on the lower crate 310 are received within the bottle support recesses 344 of the upper crate 310. This improves the stability of a stack of crates 310 and jugs 70.

Figure 65:
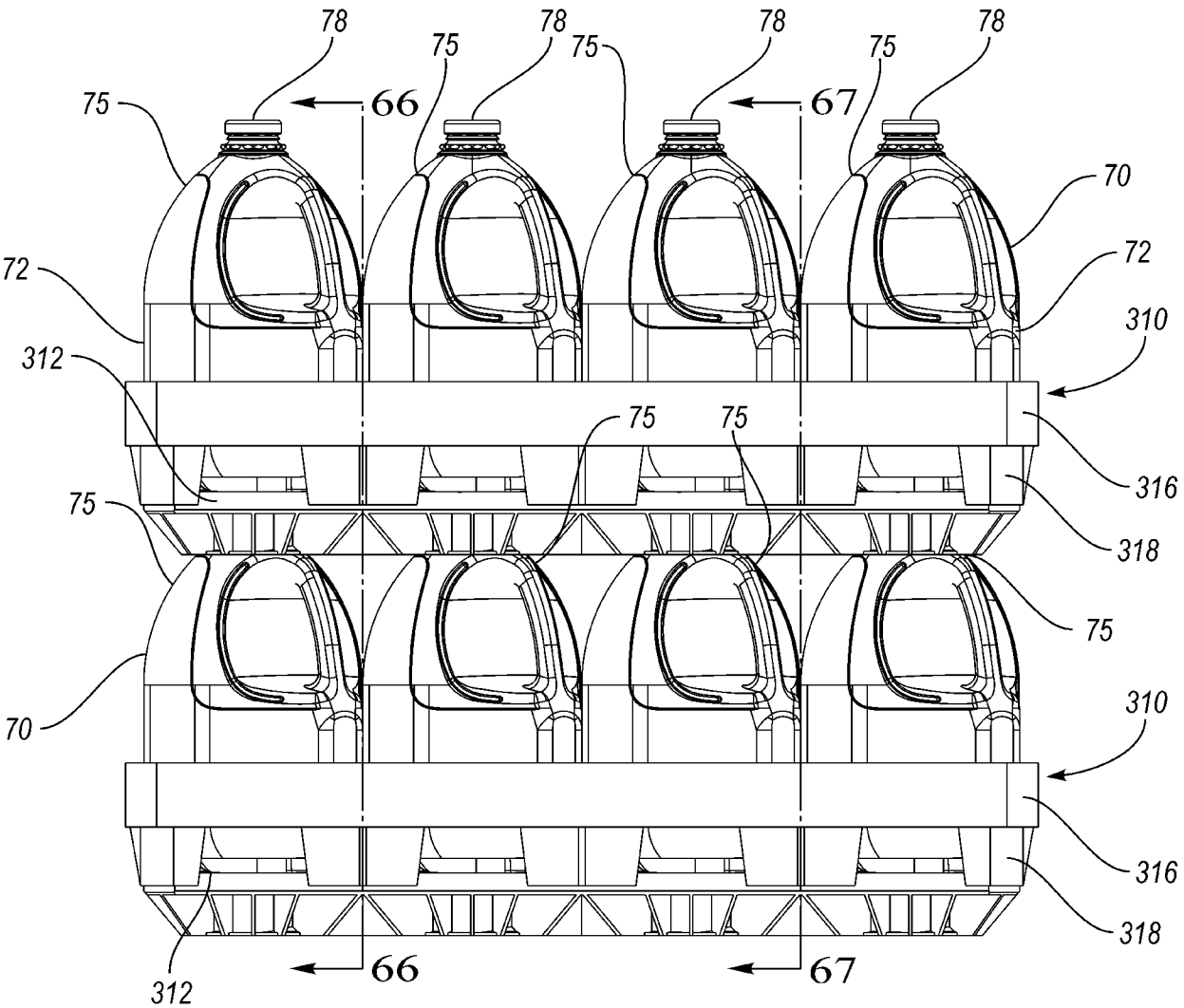
FIG. 65 is a side view of the crate of FIG. 47 with the plurality of first jugs stacked thereon stacked on a similar crate with another plurality of first jugs stacked thereon.
Figure 67:
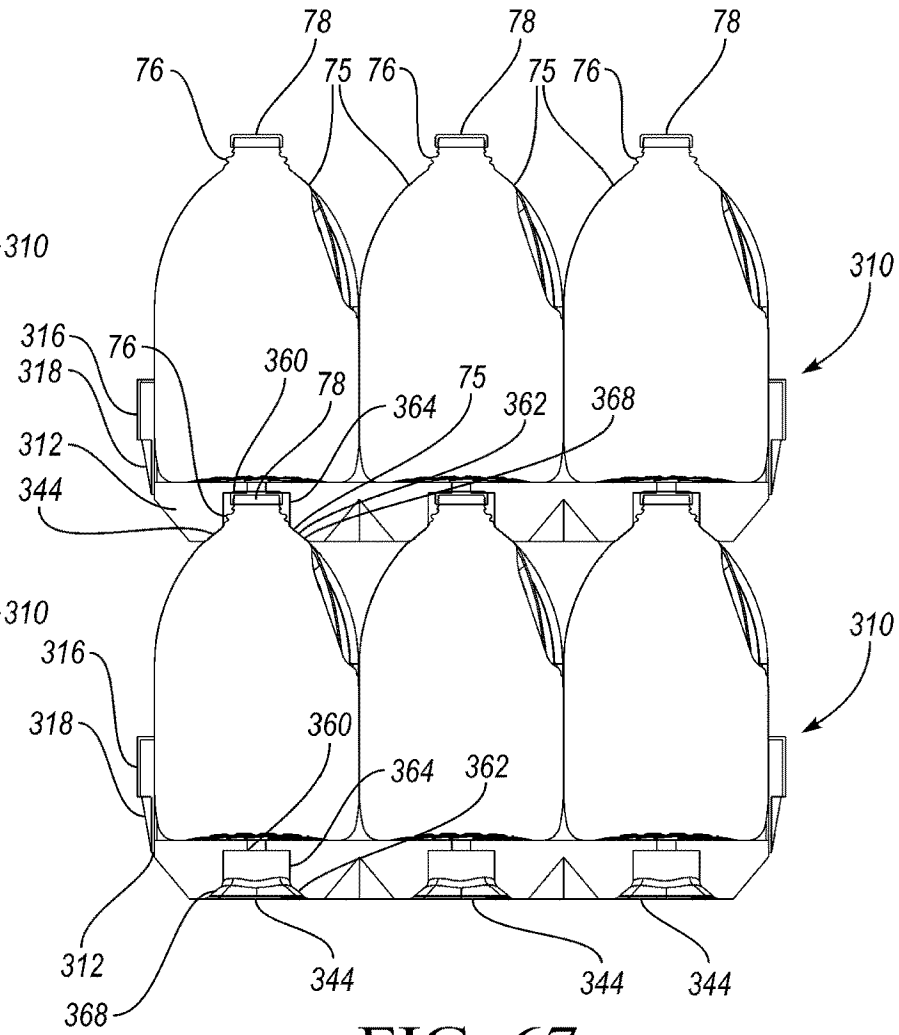
FIG. 67 is a sectional view taken along line 67-67 of FIG. 65.
Figure 66:
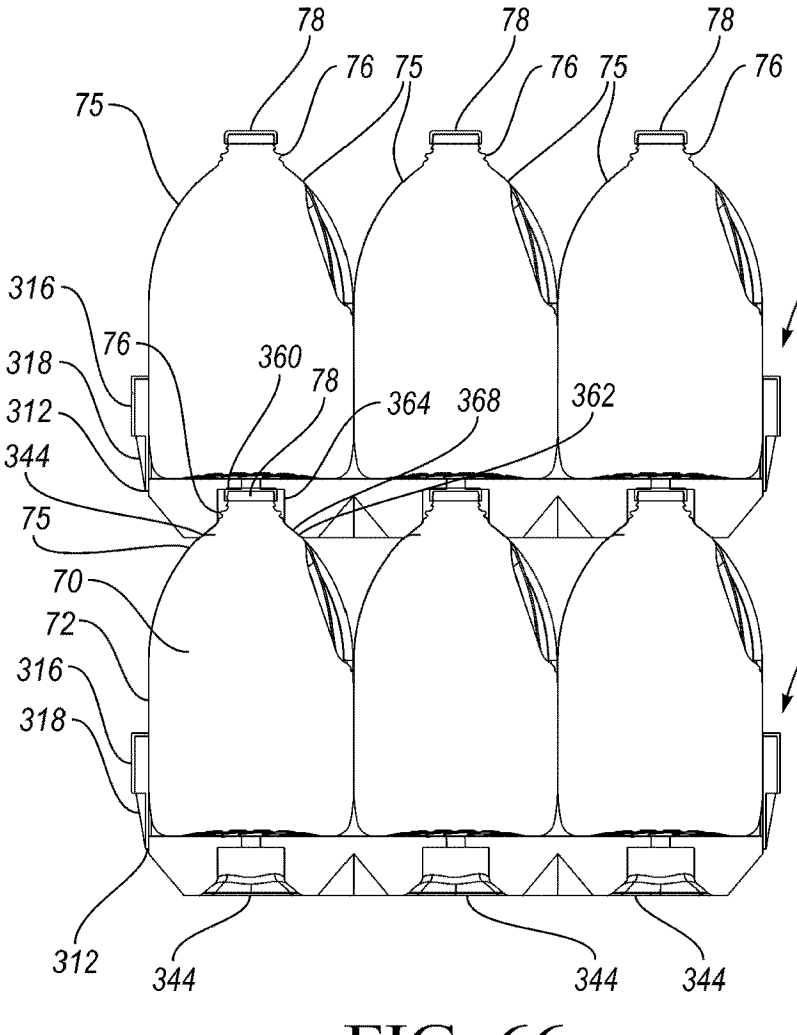
FIG. 66 is a sectional view taken along line 66-66 of FIG. 65.

FIG. 65 is a side view of the crate 310 and the jugs 70 with an identical crate 310 with the jugs 70 also stacked thereon. FIGS. 66 and 67 are cross-section views taken along line 66/67 of FIG. 65. As shown in FIGS. 66 and 67, the caps 78 and shoulder portions 75 of the jugs 70 on the lower crate 310 are received in the bottle support recess 344 on the identical upper crate 310. The cap 78 contacts the bottle cap support region 360 in a distal end of the bottle support recess 344 and the bottle shoulder support region 362 contacts the shoulder portion 75 of the jugs 70. The collar portion 364 accepts the neck portion 76 of the jug 70.

By having the bottle support recess 344 engage both the cap 78 and the shoulder portion 75 of the jugs 70 on the lower crate 310, the weight of the upper crate 310 and jugs 70 is distributed over a greater portion of the jugs 70 on the lower crate 310 to reduce damage caused by the weight of the upper crate 310 and jugs 70. Although the illustrated example only shows two levels of jugs 70 and crates 310 stacked on each other, additional levels of jugs 70 and crates 310 could be stacked on each other.

Figure 68:
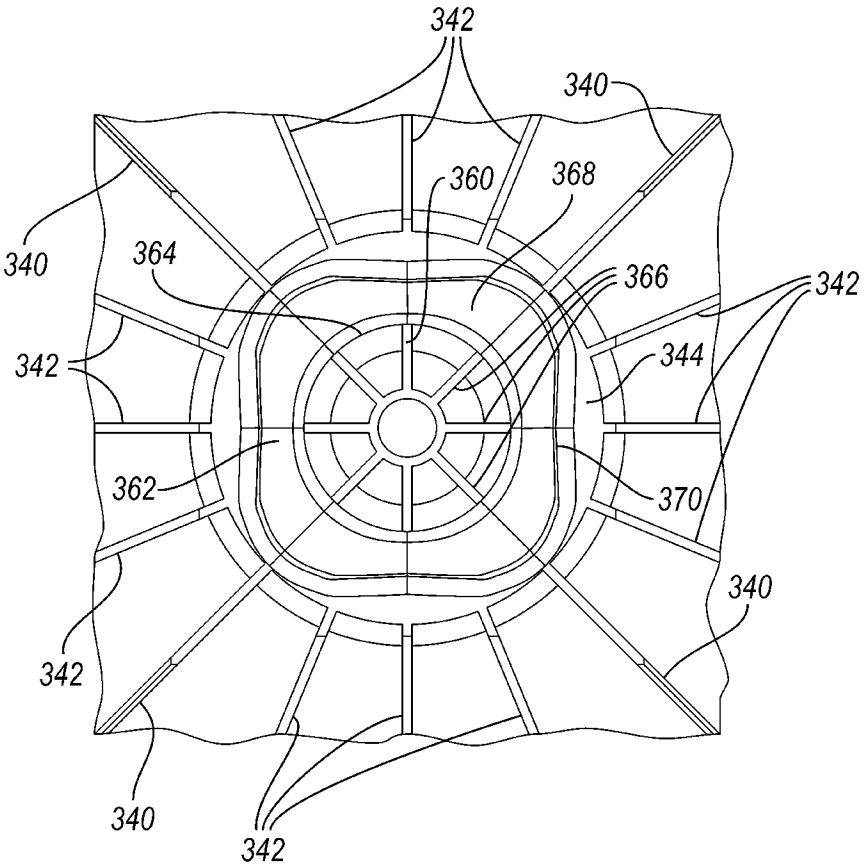
FIG. 68 shows an example bottle support recess on the bottom of the crate of FIG. 47.

FIG. 68 illustrates an enlarged view of the bottle support recess 344. The bottle support recess 344 is generally symmetric about a plane defined by the vertical ribs 340. The support surface 368 of the bottle shoulder support region 362 includes a generally rectangular perimeter 370 with generally concave opposing sides and rounded corners. The bottle cap support region 360 is generally centrally located within the bottle shoulder support region 362.

Figure 69:
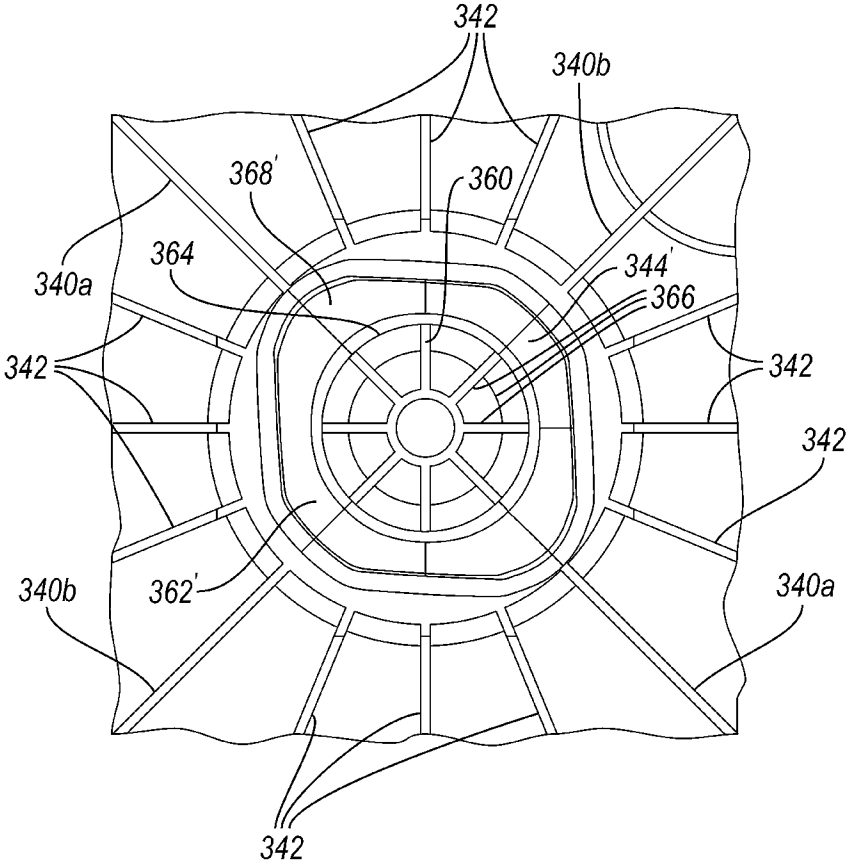
FIG. 69 shows another example bottle support recess on a bottom of another crate similar to the crate of FIG. 47.

FIG. 69 illustrates another example bottle support recess 344'. The bottle support recess 344' is similar to the bottle support recess 344 except where described below or shown in the Figures. The support surface 368' of the bottle shoulder support region 362' is generally symmetric about the plane defined by the vertical ribs 340*a* and 340*b*. The support surface 368' includes a first dimension between a first set of opposing vertical ribs 340*a* that is greater than a second dimension between a second set of vertical ribs 340*b* which gives the support surface 368' an asymmetric profile.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A crate for storing containers comprising:

a base having an upper support surface;

a plurality of collar portions extending downward from the base;

a plurality of ribs extending outward from each of the collar portions;

a body portion contact surface extending radially from each of the plurality of collar portions, wherein each body portion contact surface is concave, a recess defined within each of the body portion contact surfaces; and a plurality of walls extending upward from the base, each of the plurality of walls including a plurality of columns connecting an upper wall portion to the base, the columns spaced inwardly of the upper wall portions such that the base and columns of an identical crate can be nested in the upper wall portion of the crate.

2. The crate of claim 1 wherein the plurality of walls each include an upper portion attached to the base with a lower portion, wherein the lower portions are positioned inwardly of the upper portions such that the lower portions of the crate can be received between the upper portions of an identical crate to nest therein.

3. The crate of claim 2 wherein the body portion contact surfaces each include a generally conical shape.

4. The crate of claim 3 wherein the body portion contact surfaces each extend downwardly of the lower portions of the plurality of walls.

5. The crate of claim 4 wherein the body portion contact surfaces are positioned inwardly of the lower portions of the plurality of walls.

6. The crate of claim 5 further including a plurality of ribs connecting the collar portions to one another.

7. The crate of claim 6 in combination with a plurality of containers located on the crate, wherein each of the plurality of containers include a body portion, a neck portion, a shoulder portion, and a cap secured over an opening on the neck portion, wherein each cap of the plurality of containers is received within one of the collar portions and wherein the shoulder portion of each of the plurality of containers contacts the body portion contact surface.

8. The crate of claim 7 wherein the plurality of walls includes a pair of opposed side walls, a pair of opposed end walls, and an angled corner portion connecting each side wall to each end wall, wherein the angled corner portions are each generally planar and are each in a plane transverse to the each side wall and the each end wall and perpendicular to the upper support surface.

9. The crate of claim 8 wherein the plurality of collar portions are entirely below the upper support surface of the base.

10. The crate of claim 1 wherein the plurality of collar portions are generally cylindrical.

11. The crate of claim 1 wherein the plurality of walls includes a pair of opposed side walls, a pair of opposed end walls, and an angled corner portion connecting each side wall to each end wall, wherein the angled corner portions are each generally planar and are each in a plane transverse to the each side wall and the each end wall and perpendicular to the upper support surface.

12. A crate for storing containers comprising:

a base having an upper support surface;

a plurality of collar portions extending downward from the base;

a plurality of ribs extending outward from each of the collar portions;

a body portion contact surface extending radially from each of the plurality of collar portions, wherein each body portion contact surface is concave, a recess defined within each of the body portion contact surfaces; and a plurality of walls extending upward from the base, wherein the plurality of walls each include an upper portion and a lower portion, the upper portion attached to the base via the lower portion, each of the plurality of walls including a plurality of alternating upper ledges and upwardly-opening recesses inward of the upper portion, wherein the lower portions of an identical crate can be nested in the upper portions of the crate.

13. The crate of claim 12 wherein the lower portions are positioned inwardly of the upper portions such that the lower portions of the crate can be received between the upper portions of an identical crate to nest therein.

14. The crate of claim 13 wherein the body portion contact surfaces each include a generally conical shape.

15. The crate of claim 14 wherein the body portion contact surfaces each extend downwardly of the lower portions of the plurality of walls.

16. The crate of claim 15 wherein the body portion contact surfaces are positioned inwardly of the lower portions of the plurality of walls.

17. The crate of claim 16 wherein the plurality of walls includes a pair of opposed side walls, a pair of opposed end walls, and an angled corner portion connecting each side wall to each end wall, wherein the angled corner portions are each generally planar and are each in a plane transverse to the each side wall and the each end wall and perpendicular to the upper support surface.

18. The crate of claim 17 in combination with a plurality of containers located on an upper support surface of an identical crate, wherein each of the plurality of containers include a body portion, a neck portion, a shoulder portion, and a cap secured over an opening on the neck portion, wherein each cap of the plurality of containers is received within one of the collar portions and wherein the shoulder portion of each of the plurality of containers contacts the body portion contact surface.

19. The crate of claim 18 wherein the plurality of collar portions are entirely below the upper support surface of the base.

20. The crate of claim 12 wherein the plurality of collar portions are generally cylindrical.

21. The crate of claim 16 wherein the lower portion includes a plurality of windows therethrough, wherein the plurality of windows are positioned below the plurality of upper ledges.

22. The crate and containers of claim 18 wherein the body portions of the plurality of containers abut one another, and wherein the body portions of the plurality of containers abut the opposed side walls and the opposed end walls.

23. The crate and containers of claim 22 wherein the body portions of the plurality of containers have flat surfaces that abut one another.

24. The crate of claim 16 wherein the upper portion of each of the plurality of walls includes a generally continuous outer surface and wherein the upwardly-opening recesses are defined inward of an inner surface of the upper portion.

25. A crate for storing containers comprising:

a base having an upper support surface;

a plurality of collar portions extending downward from the base;

a plurality of ribs extending outward from each of the collar portions;

a body portion contact surface extending radially from each of the plurality of collar portions, wherein each body portion contact surface is concave, a recess defined within each of the body portion contact surfaces;

a plurality of columns extending upward from a periphery of the upper support surface of the base; and an upper wall portion extending upward from upper ends of the plurality of columns, the plurality of columns connecting the upper wall portion to the base, the plurality of columns spaced inward relative to the upper wall portion, a plurality of alternating upper ledges formed at an upper edge of the upper wall portion and inward of the upper wall portion, a plurality of upwardly-opening recesses defined by an inner surface of the upper wall portion and above the columns, wherein the plurality of columns of an identical crate can be nested between the upper wall portions of the crate.

26. The crate of claim 25 wherein the body portion contact surfaces each extend downwardly further than the plurality of columns, wherein the body portion contact surfaces are positioned inwardly of the plurality of columns, wherein the upper wall portion includes a pair of opposed side walls, a pair of opposed end walls, and an angled corner portion connecting each side wall to each end wall.

27. The crate of claim 1 wherein the plurality of ribs taper upward away from the plurality of collar portions.

* * * * *